US005482824A

United States Patent [19]

Ogawa

[11] Patent Number: 5,482,824

[45] **Date of Patent: *Jan. 9, 1996**

[54] SILVER HALIDE PHOTOGRAPHIC MATERIAL AND SILVER HALIDE EMULSION

[75] Inventor: Tadashi Ogawa, Kanagawa, Japan

[73] Assignee: Fuji Photo Film Co., Ltd., Kanagawa, Japan

[ * ] Notice: The term of this patent shall not extend beyond the expiratin date of Pat. No. 5,258,272.

[21] Appl. No.: 95,832

[22] Filed: Jul. 22, 1993

Related U.S. Application Data

[62] Division of Ser. No. 645,928, Jan. 25, 1991, Pat. No. 5,258,272.

[30] Foreign Application Priority Data

Jan. 25, 1990 [JP] Japan ..... 2-15772

[51] Int. Cl.[6] ..... G03C 1/035

[52] U.S. Cl. ..... 430/567; 430/570

[58] Field of Search ..... 430/567, 505, 430/570

[56] References Cited

U.S. PATENT DOCUMENTS

| | | | |
|---|---|---|---|
| 3,885,970 | 5/1975 | Miyahara | 430/567 |
| 4,820,624 | 4/1989 | Hasebe et al. | 430/567 |
| 4,939,080 | 7/1990 | Hioki et al. | 430/567 |
| 5,258,272 | 11/1993 | Ogawa | 430/505 |

*Primary Examiner*—Janet C. Baxter
*Attorney, Agent, or Firm*—Sughrue, Mion, Zinn, Macpeak & Seas

[57] ABSTRACT

A silver halide emulsion having a high silver chloride content of about 95 mol % or more, wherein about 30% by number or by weight or more of the silver halide grains are those having one twin plane in the crystal such that the crystal planes constituting the surface of each grain consist essentially of (100) planes and having a silver bromide-localized phase having a relatively higher silver bromide content in the part of intersection of the twin plane and the surface of the grain and suitable for rapid processing with high sensitivity and excellent gradation characteristic and reciprocity law characteristic.

14 Claims, No Drawings

SILVER HALIDE PHOTOGRAPHIC MATERIAL AND SILVER HALIDE EMULSION

This is a divisional of patent application Ser. No. 07/645,928 filed Jan. 25, 1991, U.S. Pat. No. 5,258,272.

FIELD OF THE INVENTION

The present invention relates to a silver halide photographic material and silver halide emulsion and, more precisely, to a silver halide photographic material which has high sensitivity, excellent gradation and good reciprocity law characteristic and which can be processed by rapid processing. The present invention also relates to a silver halide emulsion to be in such a photographic material.

BACKGROUND OF THE INVENTION

Recently, it has become desirable to obtain silver halide photographic materials which can be processed by rapid processing and which have high sensitivity and can form good images with high image quality with respect to tone reproducibility.

For instance, in photographic laboratories for color development, the necessity of rapid processing is increasing since shortening of processing time improves photographic production efficiency and reduces production cost. Additionally, elevation of the sensitivity of not only picture-taking photographic materials but also printing photographic materials is also desired, since shortening the exposure time for printing produces the same effects noted above.

Various approaches have heretofore been suggested for a rapid processing system for both picture-taking and printing photographic materials themselves, as well as the processing solutions to be used for processing the materials. For instance, with respect to color development procedure, various means of elevation of the temperature of processing solutions, elevation of the pH value thereof and addition of color developing agents of high concentration have been attempted. Additionally, a means of adding various additives such as a development promoter has also been known.

As examples of usable development promoters, there are known 1-phenyl-3-pyrazolidone described in British Patent 811,185, N-methyl-p-aminophenol described in U.S. Pat. No. 2,417,514, and N,N,N',N'-tetramethylphenylenediamine described in JP-A-50-15554. (The term "JP-A" as used herein means an "unexamined published Japanese patent application".)

However, the known means could not attain sufficiently rapid processing and are often accompanied by undesirable deterioration of characteristics of processed materials such as elevation of fog.

On the other hand, it is known that the shape, size and composition of silver halide grains in the silver halide emulsions to be in photographic materials have a great influence on the rate of development. In particular, the halogen composition has an especially great influence thereon. In this connection, it is known that a silver halide emulsion having a high silver chloride content displays an extremely high rate of development.

However, such a high-silver chloride emulsion is not always advantageous for elevating of the sensitivity of photographic materials. As for such high silver chloride emulsions, JP-A-58-108533 corresponding to U.S. Pat. No. 4,564,591 and JP-A-60-222845 corresponding to U.S. Pat. No. 4,605,610, European Patents 0,273,430 and 0,273,429 and JP-A-l-177531 mention that providing a silver halide-localized phase in high-silver chloride grains is effective for elevating the sensitivity of photographic materials containing the grains.

Regarding a silver halide emulsion comprising grains having different halogen composition-localized phases, there are known, for example, a silver chloride-conjugated silver iodide emulsion described in JP-A-53- 103725 corresponding to U.S. Pat. No. 4,094,684 and a silver chlorobromide emulsion comprising cubic grains with different halogen composition in the corners thereof described in JP-A-55-124139 corresponding to U.S. Pat. No. 4,496,652.

JP-A-62-89949 corresponding to U.S. Pat. No. 4,735,894 describes grains having different halogen compositions as grown on the (100) plane of the silver halide crystal.

In order to meet the demand for rapid processing in the photographic market, it is advantageous to employ high-silver chloride emulsion-containing photographic materials.

However, high-silver chloride emulsions are not always advantageous for elevation of the sensitivity of photographic materials, as mentioned above. Though the sensitivity of such high-silver chloride emulsion-containing photographic materials could be improved to some degree by the methods described in the above-mentioned patent publications, the improvement is limited.

For instance, in any of the techniques described in JP-A-58-108533 and JP-A-60-222845 and European Patent 0,273,430, the photographic materials containing the proposed silver halide emulsions have a disadvantage in that the gradation of the image to be formed thereon is softer, especially in the shoulder part, than the originally intended image.

JP-A-53-103725 mentions emulsions which are not applicable to rapid processing since the emulsions have a high silver iodide content. Emulsions proposed in JP-A-55-124139 give a soft gradation, and emulsions proposed in JP-A-62-89949 do not have a sufficient reciprocity law characteristic.

Thus, all the known high-silver chloride emulsions are not satisfactorily practical but need to be improved with respect to both sensitivity and gradation. Additionally, with respect to the reciprocity law characteristic, the emulsions also have various problems with the soft contrast in high intensity exposure, the soft contrast in low intensity exposure and the low sensitivity.

Accordingly, there is an extremely strong demand for high-silver chloride emulsions and high-silver chloride photographic materials having a higher sensitivity, a harder gradation and a better reciprocity law characteristic.

SUMMARY OF THE INVENTION

An object of the present invention is to provide a high-silver chloride emulsion which is suitable for rapid processing and which has high sensitivity and excellent gradation characteristic and reciprocity law characteristic arid to provide a silver halide photographic material which contains such a high-silver chloride emulsion and which has a high sensitivity and an excellent tone reproducibility.

The object of the present invention has been attained by a high-silver chloride emulsion having a silver chloride content of about 95 mol % or more and about 30% or more by number or by weight of the silver halide grains having one twin plane in the crystal such that the crystal planes of the surface of each grain consist essentially of (100) planes and having a silver bromide-localized phase having a relatively higher silver bromide content in the area of intersection of the twin plane and the surface of the grain, compared with the silver bromide content in the other area of the intersection.

Accordingly, the present invention provides a silver halide photographic material having at least one silver halide emulsion layer on a support, wherein the silver halide emulsion of the emulsion layer is a high-silver chloride emulsion having a silver chloride content of about 95 mol % or more wherein at least about 30% or more by number or by weight of the silver halide grains have one twin plane in the crystal such that the crystal planes constituting the surface of each grain consist essentially of (100) planes and have a silver bromide-localized phase having a relatively higher silver bromide content in the area of intersection of the twin plane and the surface of the grain compared with the silver bromide content in the other area of the intersection.

As one preferred embodiment of the present invention, the silver halide photographic emulsion has at least one yellow coupler-containing light-sensitive silver halide emulsion layer, at least one magenta coupler-containing light-sensitive silver halide emulsion layer and at least one cyan coupler-containing light-sensitive silver halide emulsion layer on a support.

As another preferred embodiment of the present invention, formation of the silver bromide-localized phase having a relatively higher silver bromide content in the high-silver chloride emulsion, compared with the silver bromide content in the other area of the high-silver chloride in the photographic material is effected by recrystallization or halogen conversion by the use of fine crystals of silver bromide or silver chlorobromide having a relatively higher silver bromide content than that in the surface of the host grains.

As still another preferred embodiment of the present invention, the yellow coupler-containing light-sensitive silver halide emulsion layer, the magenta coupler-containing light-sensitive silver halide emulsion layer and the cyan coupler-containing light-sensitive silver halide emulsion layer in the photographic material are a blue-sensitive layer, a green-sensitive layer and a red-sensitive layer, respectively.

As still another preferred embodiment of the present invention, at least two of the yellow coupler-containing light-sensitive silver halide emulsion layer, the magenta coupler-containing light-sensitive silver halide emulsion layer and the cyan coupler-containing light-sensitive silver halide emulsion layer in the photographic material each have a spectral sensitivity peak in a different wavelength range of 720 nm or more.

As still another preferred embodiment of the present invention, formation of the silver bromide-localized phase having a relatively higher silver bromide content in the high-silver chloride emulsion to be in the photographic material, compared with silver bromide content in the other area of the high-silver chloride is effected in the presence of a cyanine dye, a nitrogen-containing heterocyclic compound, a nitrogen-containing heterocyclic mercapto compound or a diaminostilbene compound.

BRIEF EXPLANATION OF THE DRAWING

FIG. 1 is an electromicroscopic photograph of silver halide crystals as formed in the preparation of Emulsion (A1) in Example 1, magnified about 20,000 times.

DETAILED DESCRIPTION OF THE INVENTION

The silver halide emulsion of the present invention preferably contains substantially no silver iodide. If present, the silver iodide content in the emulsion is 1 mol % or less, preferably 0.4 mol % or less. Most preferably, the emulsion contains no silver iodide.

The silver chloride content in the emulsion of the invention may be 95 mol % or more, preferably 98 mol % or more, more preferably 99 mol % or more. The silver bromide content in the emulsion is at least 0.03 mol % or more, preferably 0.1 mol % or more.

The high-silver chloride emulsion of the present invention contains silver halide grains which have one twin plane in the grain crystal such that the crystal planes of the surface of each grain consist essentially of (100) plane and which have a silver bromide-localized phase having a relatively higher silver bromide content in the part of the intersection of the twin plane and the surface of the grain, in an amount of about 30% by number or by weight or more. The silver bromide-localized phase may be either on the surface of the silver halide grain or near the surface thereof or both on and near the surface.

The silver halide grain which has one twin plane in the grain crystal and in which the crystal planes of the grain surface consist essentially of (100) plane may be formed by the method described in JP-A-50-3329 corresponding to U.S. Pat. No. 3,885,970.

In accordance with the disclosure of the patent publication of JP-A-50-3329, a silver halide grain of the type which has one twin plane and in which the crystal planes of the grain surface consist essentially of (100) plane may be formed when the following conditions are satisfied.

(1) Grains are formed by the double jet method where the silver ion concentration is maintained within the range of the equivalent point plus/minus pAg of 1.

(2) The silver ion solution and the halide ion concentration to be added are maintained within the range of from 2 normal equivalents to the solubility.

(3) No silver halide solvent is present in the reaction system at least on the initial stage of formation of precipitates.

(4) The silver ion concentration variation is controlled to be 2 mV or less in the step of forming grains by the double jet method, and addition of reactants is effected rapidly.

In accordance with the above method, silver halide grains having one twin plane in the crystal, which may be host grains for the emulsion of the present invention, can be prepared. In addition, varying the kind of gelatin to be used in forming the grains and using a smaller amount of gelatin than conventionally used has been found to be effective for advantageously preparing the emulsion of the present invention.

The silver halide emulsion thus formed is said to have a higher contrast, less reciprocity law failure and higher color sensitization percentage, as described in the patent publication of JP-A-50-3329. The silver halide emulsion containing silver halide grains each having one twin plane has a characteristic feature that it has a higher sensitivity than any other silver halide emulsion containing not irregular but cubic grains. Both emulsions were compared with each other in JP-A-50- 3329, and the sensitivity of the silver halide emulsion having one twin plane could still not be comparable to that of the high-sensitivity silver halide emulsions described in the above-mentioned JP-A-58-108533 and JP-A-60222845, European Patent 0,273,430 and 0,273,429 and JP-A-1-177531.

In the emulsion of the present invention, it is necessary that the silver bromide-localized phase is at least in the part of intersection of the twin plane and the surface of the grain. Additionally the silver bromide localized phase may be in other parts. However, it is preferred that the silver bromide-localized phase is not in any other part than the part of intersection of the twin plane and the surface of the grain. If any, the amount of the silver bromide-localized phase in the other parts is preferably small compared with the part of intersection.

The part of intersection of the twin plane and the surface of the grain is such that at least two crystal surfaces cross with each other at the same time, generally, with respect to the crystal surface, and the part forms an edge or a depressed angle. The edge is distinctly differentiated from the edge in a general normal crystal. Where the edge or depressed angle to be formed from the two crystal surfaces of a normal crystal is not in the twin plane but the two surfaces cross with each other, the part is to be a corner or a depressed point with respect to the outward shape of the twin plane-having crystal. The corner or depressed point is also distinctly differentiated from the corner of a normal crystal, as the former is on the twin plane.

In the present invention, it is preferred that the silver bromide-localized phase is in the edge or corner on the twin plane or in the depressed angle or depressed point on the twin plane. More preferably, the silver bromide-localized phase is in the corner or depressed point on the twin plane. Even if it is in the edge on the twin plane, this embodiment may often be preferred provided that the position of the phase and the number thereof are limited.

In the present invention, the number of the silver bromide-localized phases on the surface of the grain is limited and is preferably smaller. The corner and the depressed point on the twin plane are advantageous for limiting the number of the localized phases to be on the surface of the grain. Most preferably, only one silver bromide-localized phase is on the corner of the twin plane of the silver halide grain.

The silver bromide composition in the silver bromide-localized phase may be from 5 mol % to 100 mol %, preferably from 10 mol % to 90 mol %, more preferably from 20 mol % to 60 mol %, most preferably from 30 mol % to 60 mol %.

It is preferred that the proportion of the localized phase is from 0.03 mol % to 35 mol %, more preferably from 0.1 mol % to 25 mol %, of the silver halide composition of all the silver halide grains of the emulsion.

The silver bromide-localized phase is not necessarily composed of a single halogen composition. Two or more localized phases each having a distinctly different silver bromide content may be in one grain, or the localized phase may be conjugated with the other phase of the grain in such a way that the halogen composition gradually and continuously varies from the localized phase to the adjacent phase due to the interface between the two phases.

Various methods may be employed for forming the silver bromide-localized phase mentioned above. For instance, a water-soluble silver salt and a water-soluble halide composition containing a water-soluble bromide may be added to an emulsion containing already formed silver chloride or high-silver chloride grains by the double jet method to form precipitates of grains with the intended silver bromide-localized phase; or a part of already formed silver chloride or high-silver chloride grains are converted into a silver bromide-rich phase by a halogen conversion method; or silver bromide or high-silver bromide grains having a smaller grain size of already formed silver chloride or high-silver chloride grains are added to the already formed silver chloride or high-silver chloride grains so as to form a silver bromide-localized phase on the surface of the silver chloride or high-silver chloride grain by recrystallization.

If it is necessary to uniformly distribute the ions for forming the intended silver bromide-localized phase to all the grains in the reaction system, it is preferred to fully agitate the contens of the system during introduction of the ions into the system. Further, it is also preferred to introduce the ions into the system in the form of a solution having a low concentration or to introduce them gradually and slowly. As a means of gradually and slowly introducing the ions, for example, an organic halogen compound such as bromosuccinimide or bromopropionic acid or a halogen compound covered with a semipermeable capsule membrane may be used.

Controlling compounds for halogen conversion or recrystallization as described in European Patents 0,273,430 and 0,273,429 can be used. In particular, where fine silver bromide or high-silver bromide grains are added so as to form the intended silver bromide-localized phase on the surfaces of silver chloride grains by recrystallization, such controlling compounds are preferably used for the purpose of obtaining the limited localized phase of the present invention.

The silver bromide content in the localized phase can be analyzed by X-ray diffraction method (for example, as described in *New Experimental Chemistry, Lecture VI, Analysis of Structure* (edited by Japan Chemical Society and published from Maruzen, Japan) or XPS method (for example, as described in *Surface Analysis—Application of IMA, Auger Electron and Photoelectronic Spectrography* (published by Kodan-sha, Japan). Additionally, the silver bromide-localized phase can be observed with an electronic microscope or by the method described in the above-mentioned EP-A- 0,273,430.

It is preferred to incorporate a metal ion other than silver ion (for example, metal ions of the Group VIII of the Periodic Table, transition metal ions of the group II, lead ion of the Group IV, gold ion or copper ion of the Group I) or complex ions of such metals into the silver halide grains for use in the present invention for the purpose of attaining the effects of high sensitivity and hard contrast under various conditions. Such metal ions or complex ions may be incorporated into the entire silver halide grain or partly into the above-mentioned silver bromide-localized phase or any other phase.

Especially advantageous, metal ions or complex ions can be selected from iridium ion, palladium ion, rhodium ion, zinc ion, iron ion, platinum ion, gold ion and copper ion. These metal ions and complex ions are preferably used in combination of two or more rather than singly to obtain more desirable photographic properties. In particular, it is preferred to vary the kind of ions to be added and the amount thereof between the localized phase and the other part of one grain. Especially preferably, iridium ion and rhodium ion are incorporated into the localized phase.

For incorporating metal ions or complex ions into the silver bromide-localized phase and/or other part of the silver halide grains of the present invention, the necessary metal ion(s) and/or complex ion(s) may be added directly to the reaction container before, during or after formation of the silver halide grains and during physical ripening thereof, or they may previously be added to the water-soluble halide salts-containing solution or the water-soluble silver salt-containing solution to be reacted for forming the silver halide grains. Where the localized phase is formed by addition of fine grains of silver bromide or high-silver bromide grains, the necessary metal ion(s) and/or complex ion(s) may previously be added to the fine silver bromide or high-silver bromide grains in the same manner as mentioned above, and then added to a silver chloride or high-silver chloride emulsion. If desired, relatively insoluble metal bromides except silver salts (for example, those mentioned above) may be directly added to the silver halide grains in the form of a solid or powder, whereupon the metal ion(s) may be incorporated into the grains during formation of the localized phase.

The silver halide grain matrix of the silver bromide-localized phase-having grains to be used in the present invention may have a regular grain crystalline form such as cubic, octahedral, tetradecahedral or rhombic dodecahedral crystalline form or an irregular grain crystalline form such as spherical or tabular crystalline form, provided that about 30% by number or by weight or more of the grains are those having one twin plane in the crystal in such a way that the crystal planes of the grain surface consist essentially of (100) plane. The emulsion containing the localized phase-having grains may further contain any other grains having a further complicated shape composed of plural crystal planes in combination or other grains having further higher poly-dimensional crystal planes.

In accordance with the present invention, the content of the high-silver chloride emulsion having a silver chloride content of about 95 mol % or more where the silver halide grains are those having one twin plane in the crystal in such a way that the crystal planes to constitute the surface of each grain consist essentially of (100) plane and having a silver bromide-localized phase having a relatively higher silver bromide content in the part of intersection of the twin plane and the surface of the grain must be about 30% by number or by weight or more, of the grains, and it is preferably 40% or more, more preferable 50% or more, most preferably 70% or more, by number or by weight thereof.

The size of the grains in the silver halide emulsions to be used in the present invention is not specifically limited, but the mean grain size is preferably from 0.1 to 1.7 microns, measured by the diameter of the circle corresponding to the projected area of the grain. The size distribution of the silver halide grains may be either broad or narrow, but a mono-dispersed emulsion is preferred for the purpose of more effectively obtaining high sensitivity and hard contrast. Especially preferably, the value (S/d) to be obtained by dividing the the standard deviation (S) of the distribution of the diameter of the silver halide grain, the diameter being calculated on the basis of the circle corresponding to the projected area of the grain, by the mean diameter (d) is 20% or less, more preferably 15% or less.

The high-silver chloride emulsion of the present invention can be prepared in accordance with the methods described in P. Glafkides, *Chimie et Physique Photographique* (published by Paul Montel, 1967), G. F. Duffin, *Photographic Emulsion Chemistry* (published by Focal Press, 1966), and V. L. Zelikman et al, *Making and Coating Photographic Emulsion* (published by Focal Press, 1964), provided that the above-mentioned conditions are satisfied.

The atmosphere in preparing the host silver halide emulsion from a water-soluble silver salt solution and a water-soluble halide solution may be any one of the acidic method, neutral method, alkaline method or ammonia method. In particular, the atmasphere of the acidic method and neutral method is preferred with respect to the reduction of fog. For obtaining an emulsion of monodispersed grains, which is preferably employed in the present invention, a double jet method is preferably used as mentioned above. As one system of the double jet method, a controlled double jet method for keeping a constant silver ion concentration in a liquid phase for forming silver halide grains is preferably used. According to this method, a silver halide emulsion containing silver halide grains having a regular crystal form and having a narrow grain size distribution, which is preferred for the present invention, can be obtained.

In the step of forming or physically ripening the silver halide grains, a cadmium salt, a zinc salt, a lead salt, a thallium salt, or the above-mentioned iridium salt or complex salt thereof, rhodium salt or complex salt thereof or iron salt or complex salt thereof may be incorporated into the reaction system.

During or after formation of the grains, a slight amount, preferably about 3 g or less per liter of aqueous reaction solution comprising silver nitrate aqueous solution and halide aqueous solution, of a silver halide solvent (for example, known materials of ammonia or thiocyanates, and thioethers and thione compounds described in U.S. Pat. No. 3,271,157, and JP-A- 51-12360, JP-A-53-82408, JP-A-53-144319, JP-A-54-100717 and JP-A-54-155828) may be added to the reaction system. Where addition of such a silver halide solvent is combined with the above-mentioned doublt jet method, a silver halide emulsion having a regular silver halide crystal form and a narrow grain size distribution, which is preferred for the present invention, can be obtained.

For removing soluble salts from the physically ripened emulsion, noodle washing, flocculation or ultra-filtration may be employed.

The atmosphere in forming the silver bromide-localized phase may be acidic, neutral or alkaline; and formation of the phase may be effected at any time during the formation of the grains or before or after chemical sensitization of the grains.

The emulsion for use in the present invention may be chemically sensitized by sulfur sensitization, selenium sensitization, reduction sensitization and/or noble metal sensitization. Specifically, the emulsion may be sensitized by sulfur sensitization using a sulfur-containing compound capable of reacting with an active gelatin or silver ion (for example, thiosulfates, thiourea compounds, mercapto compounds, rhodanine compounds); reduction sensitization using a reducing compound (for example, stannous salts, amines, hydrazine derivatives, foramidine-sulfinic acids, silane compounds); noble metal sensitization using a noble metal compound for example, the above-mentioned gold complexes or complexes of metals of Group VIII of the Periodic Table such as platinum, iridium; palladium, rhodium or iron); or by combination of these methods.

For preparing the emulsion of the present invention, sulfur sensitization or selenium sensitization is preferably employed, which preferably may be combined with gold sensitization. In the chemical sensitization, it is also preferred to use a hydroxy-azaindene compound or nucleic acid for the purpose of well controlling the sensitivity and gradation.

In the present invention, use of color sensitizing dyes is necessary. Examples of color sensitizing dyes for use in the present invention include cyanine dyes, merocyanine dyes, and complex merocyanine dyes. Additionally, complex cyanine dyes, holopolar cyanine dyes, hemicyanine dyes, styryl dyes and hemioxonole dyes may also be employed. As cyanine dyes, preferred are simple cyanine dyes and carbocyanine dyes. Such cyanine dyes are represented by the following general formula (I):

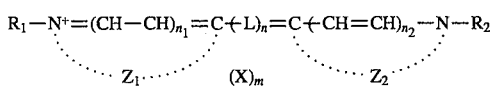

(I)

wherein L represents a methine group or a substituted methine group; $R_1$ and $R_2$ each represents an alkyl group or a substituted alkyl group; $Z_1$ and $Z_2$ each represent an atomic group for forming a nitrogen-containing 5-membered or 6-membered heterocyclic nucleus; X represents an anion; n represents a number of 1, 3 or 5; $n_1$ and $n_2$ each represent 0 or 1; when n=5, both $n_1$ and $n_2$ are 0; and when n=3, either $n_1$ or $n_2$ is 0; m represents 0 or if and it is 0 when the formula forms an internal salt; and when n is 5, plural L's may be bonded to each other to form a substituted or unsubstituted 5-membered or 6-membered ring.

The cyanine dyes of formula (I) will be explained in more detail below.

As substituents to be in the substituted methine group represented by L, there are mentioned a lower alkyl group (e.g., methyl, ethyl), and an aralkyl group (e.g., benzyl, phenethyl).

The alkyl group as represented by $R_1$ or $R_2$ may be linear, branched or cyclic. The number of the carbon atoms in the group is not specifically limited, but is preferably from 1 to 8, more preferably from 1 to 4. As the substituents in the substituted alkyl group, there are mentioned, for example, a sulfonic acid group, a carboxylic acid group, a hydroxyl group, an alkoxy group, an acyloxy group and an aryl group (e.g., phenyl, substituted phenyl). These groups may be bonded to the alkyl group singly or in combination of two or more. The sulfonic acid group or carboxylic acid group as the substituent may form a salt with an alkali metal ion. Combination of two or more substituents also includes the case when the plural substituents are bonded to the alkyl group independently. As examples of the latter case, there are mentioned a sulfoalkoxyalkyl group, a sulfoalkoxyalkoxyalkyl group, a carboxyalkoxyalkyl group and a sulfophenylalkyl group.

As examples of $R_1$ and $R_2$, these are mentioned a methyl group, an ethyl group, an n-propyl group, an n-butyl group, a vinylmethyl group, a 2-hydroxyethyl group, a 4-hydroxybutyl group, a 2-acetoxyethyl group, a 3-acetoxypropyl group, a 2-methoxyethyl group, a 4-methoxybutyl group, a 2-carboxyethyl group, a 3-carboxypropyl group, a 2-(2-carcboxyethoxy)ethyl group, a 2-sulfoethyl group, a 3-sulfopropyl group, a 3-sulfobutyl group, a 4-sulfobutyl group, a 2-hydroxy- 3-sulfopropyl group, a 2-(3-sulfopropoxy-)ethyl group, a 2-acetoxy-3-sulfopropyl group, a 3-methoxy-2-(3-sulfopropoxy)propyl group, a 2-[2-(3-sulfopropoxy-)ethoxy]ethyl group, and a 2-hydroxy-3-(3-sulfopropoxy)propyl group.

Examples of the nitrogen-containing heterocyclic nucleus to be formed by $Z_1$ or $Z_2$ are an oxazole nucleus, a thiazole nucleus, a selenazole nucleus, an imidazole nucleus, a pyridine nucleus, an oxazoline nucleus, a thiazoline nucleus, a selenazoline nucleus, an imidazoline nucleus; as well as condensed nuclei formed by condensing benzene or naphthalene ring(s) and/or other saturated or unsaturated hydrocarbon ring(s) to the above-mentioned nuclei. Such nitrogen-containing hetero rings may further be substituted by substituent(s) (for example, an alkyl group, a trifluoromethyl group, an alkoxycarbonyl group, a cyano group, a carboxylic acid group, a carbamoyl group, an alkoxy group, an aryl group, an acyl group, a hydroxyl group and a halogen atom). As examples of the anion to be represented by X, there are mentioned $Cl^-$, $Br^-$, $I^-$, $SO_4^{--}$, $NO_3^{--}$, and $ClO_4^{--}$.

The silver halide emulsion of the present invention is suitable not only for color sensitization in the visible light range but also to color sensitization in the infrared range. Color sensitizing dyes which are preferably used in the present invention for red-sensitization or infrared-sensitization may be selected from those of general formulae (II), (III) and (IV) which will be described below.

These color sensitizing dyes are characterized in that they adsorb to the surfaces of silver halide grains relatively strongly and are hardly desorbed from the grains even though the color photographic material contains couplers along with the dyes.

In accordance with the present invention, at least one compound may be selected from the compounds of formulae (II), (III) and (IV) and incorporated into the emulsion in order that the emulsion is color-sensitized to have a color sensitization peak at 720 nm or more. In the color photographic material of the present invention, at least one light-sensitive layer may be color-sensitized with the compound selected from those of formulae (II), (III) and (IV) in order that it may have a color sensitization peak at 720 nm or more. More preferably, two or more light-sensitive layers are color-sensitized with different compounds selected from the compounds of the above formulae.

Compounds of formulae (II), (III) and (IV) include those which adsorb to silver halide emulsion grains to color-sensitize them in such a way that they have a color sensitization peak at 720 nm or more, but they also include other compounds which may color-sensitize silver halide emulsion grains so that the grains are to have a color sensitization peak at less than 720 nm.

Thus, in the color photographic material of the present invention, provided that at least one light-sensitive layer is color-sensitized in such a way that it has a color sensitization peak at 720 nm or more, any other light-sensitive layer(s) having a color sensitization peak at less than 720 nm may be color-sensitized with compounds of the defined general formulae or also with any other compounds not included in the scopes of the formulae, for example, compounds of the above-mentioned formula (I).

Next, sensitizing dyes of formulae (II), (III) and (IV) will be explained in detail below.

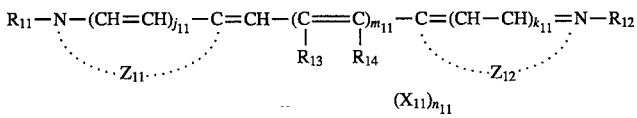

(II)

where $Z_{11}$ and $Z_{12}$ each represent an atomic group necessary for forming a hetero ring.

As the hereto ring, a 5-membered or 6-membered ring containing nitrogen, sulfur, oxygen, selenium and/or tellurium atom(s) in addition to carbon atoms is preferred. The ring may be in the form of a condensed ring or may be substituted by substituent(s).

Examples of the hetero ring nucleus are a thiazole ring nucleus, a benzothiazole ring nucleus, a naphthothiazole ring nucleus, a selenazole ring nucleus, a benzoselenazole ring nucleus, a naphthoselenazole ring nucleus, an oxazole ring nucleus, a benzoxazole ring nucleus, a naphthoxazole ring nucleus, an imidazole ring nucleus, a benzimidazole ring nucleus, a naphthoimidazole ring nucleus, a 2-quinoline ring nucleus, a 4-quinline ring nucleus, a pyrroline ring nucleus, a pyridine ring nucleus, a tetrazole ring nucleus, an indolenine ring nucleus, a benzindolenine ring nucleus, an indole ring nucleus, a tellurazole ring nucleus, a benzotellurazole ring nucleus, and a naphthotellurazole ring nucleus.

$R_{11}$ and $R_{12}$ each represents an alkyl group, an alkenyl group, an alkynyl group or an aralkyl group. These groups and the groups mentioned below can also be substituted. For instance, the alkyl group includes an unsubstituted alkyl group and a substituted alkyl group, in which the alkyl moiety may be linear, branched or cyclic. The number of carbon atoms of the alkyl moiety is preferably from 1 to 8. As examples of the substituents to be in the substituted alkyl group, there are mentioned a halogen atom (e.g., chlorine, bromine, fluorine), a cyano group, an alkoxy group, a substituted or unsubstituted amino group, a carboxylic acid group, a sulfonic acid group and a hydroxyl group. One or more of these substituents may be bonded to the alkyl moiety, singly or in combination.

As an example of the alkenyl group, a vinyl-methyl group is mentioned.

Examples of the aralkyl group include a benzyl group and a phenethyl group.

$m_{11}$ represents an integer of 1, 2 or 3.

$R_{13}$ represents a hydrogen atom. $R_{14}$ represents a hydrogen atom, a lower alkyl group or an aralkyl group, or it may be bonded to $R_{12}$ to form a 5-membered or 6-membered ring. Where $R_{14}$ is a hydrogen atom, $R_{13}$ may be bonded to the other $R_{13}$ to form a hydrocarbon ring or a heterocyclic ring. The ring is preferably 5-membered or 6-membered.

$j_{11}$ and $k_{11}$ each represents 0 or 1; $x_{11}$ represents an acid anion; and $n_{11}$ represents 0 or 1.

In the formula, $Z_{31}$ represents an atomic group necessary for forming a hetero ring. As examples of the ring, there are mentioned, those mentioned above with respect to $Z_{11}$ and $Z_{12}$, a thiazolidine ring, a thiazoline ring, a benzothiazoline ring, a naphthothiazoline ring, a selenazolidine ring, a selenazoline ring, a benzoselenazoline ring, a naphthaselenazoline ring, a benzoxazoline ring, a naphthoxazoline ring, a dihydropyridine ring, a dihydroquinoline ring, a benzimidazoline ring, and a naphthoimidazoline ring.

$Q_{31}$ has the same meaning as $Q_{21}$. $R_{31}$ has the same meaning as $R_{11}$ or $R_{12}$; and $R_{32}$ has the same meaning as $R_{23}$. $m_{31}$ represents 2 or 3. $R_{33}$ has the same meaning as $R_{23}$, or it may be bonded to the other $R_{33}$ to form a hydrocarbon ring or heterocyclic ring. $j_{31}$ has the same meaning as $j_{11}$.

Of the sensitizing dyes of formula (II), those in which the heterocyclic nuclei of $Z_{11}$ and/or $Z_{12}$ are a naphthothiazole ring, a naphthoselenazole ring, a naphthoxazole ring, a naphthoimidazole ring and/or a 4-quinoline ring are preferred.

The above rings are also preferred for $Z_{21}$ and/or $Z_{22}$ in formula (III) and $Z_{31}$ in formula (IV). Additionally, sensitizing dyes of the formulae in which the methine chain forms a hydrocarbon ring or heterocyclic ring are also preferred.

Infrared sensitization is, in general, effected by the M band of sensitizing dyes and, therefore, the spectral sensitivity distribution resulting from the sensitization is generally broader than that from sensitization with the J band. Accordingly, it is preferable to provide a colorant layer containing a dye, pigment such as a colloidal silver, or the like in the position of the colloid layer nearer to the surface to be exposed to light than the determined light-sensitive layer for the purpose of controlling the spectral sensitivity distribution. The colorant layer is also effective for preventing color mixing due to a filter effect.

As red-sensitive or infrared-sensitive sensitizing dyes for use in the present invention, compounds having a reducing potential of −1.00 V (vs SCE) or lower are preferred and

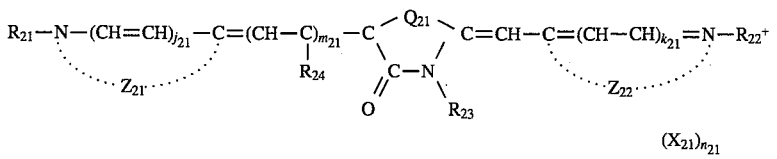

(III)

In the formula, $Z_{21}$ and $Z_{22}$ have the same meanings as the above-mentioned $Z_{11}$ and $Z_{12}$. $R_{21}$ and $R_{22}$ have the same meanings as the above-mentioned $R_{11}$ and $R_{12}$; $R_{23}$ represents an alkyl group, an alkenyl group, an alkynyl group or an aryl group (e.g., substituted or unsubstituted phenyl). $m_{21}$ represents 1, 2 or 3. $R_{24}$ represents a hydrogen atom, a lower alkyl group or an aryl group, or $R_{24}$ may be bonded to the other $R_{24}$ to form a hydrocarbon ring or heterocyclic ring. The ring is preferably a 5-membered or 6-membered one.

$Q_{21}$ represents a sulfur atom, an oxygen atom, a selenium atom or $=N-R_{25}$; and $R_{25}$ has the same meaning as $R_{23}$ above. $j_{21}$, $k_{21}$, $x_{21}$ and $n_{21}$ have the same meanings as $j_{11}$, $k_{11}$, $x_{11}$ and $n_{11}$, respectively.

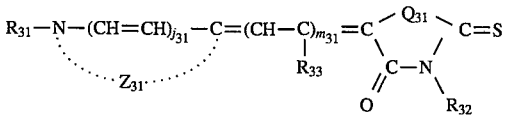

(IV)

compounds having reducing potential of −1.10 or lower are more preferred. Sensitizing dyes having this potential characteristic are advantageous for elevation of sensitivity, and especially for stabilization of the elevated high sensitivity and latent images.

Determination of the reducing potential may be effected by phase differentiation type secondary higher harmonics alternating current polarography, where a dropping mercury electrode is used as the working electrode, a saturated calomel as the reference electrode, and a platinum electrode as the counter electrode.

Determination of the reducing potential from the phase differentiation type secondary higher harmonics alternating current voltammetry used as the working electrode is described in *Journal of Imaging Science,* Vol. 30, pages 27 to 35 (1986).

Further, compounds of formulae (IV), (V), (VI) and (VII) as well as compounds selected from the group of formaldehyde condensates of compounds of formulae (VII-a), (VII-b) and (VII-c) all described in Japanese Patent Application No. 63-310211 may also be used along with the above-mentioned sensitizing dyes.
Next, specific examples of sensitizing dyes of formulae (II), (III) and (IV) are mentioned below.
(V-1)
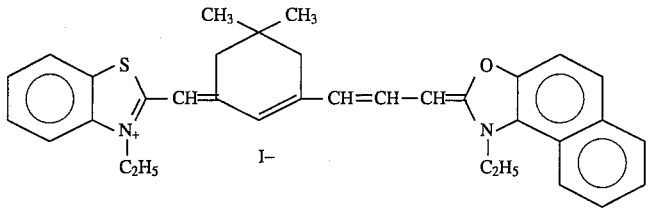
(V-2)
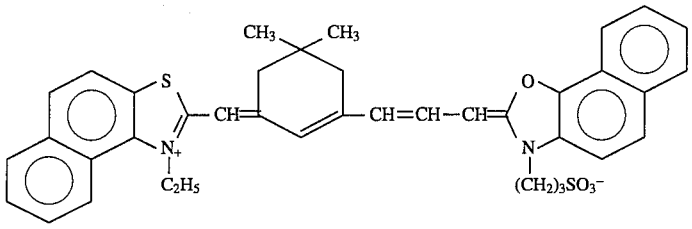
(V-3)
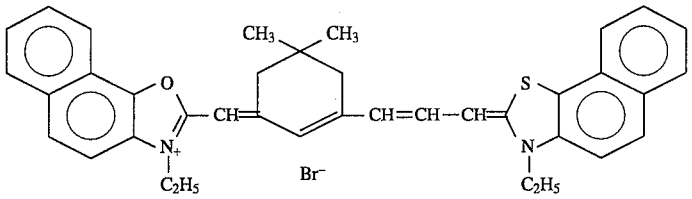
(V-4)
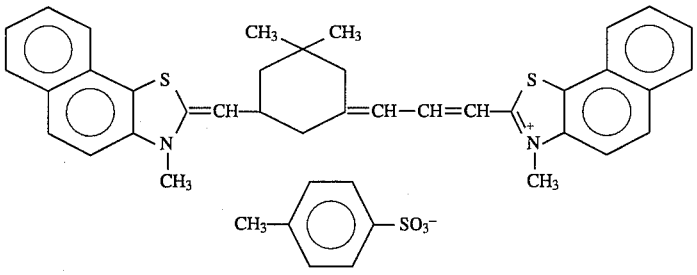
(V-5)
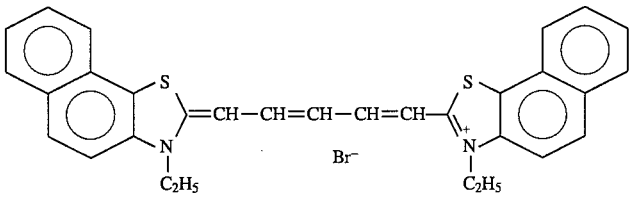
(V-6)
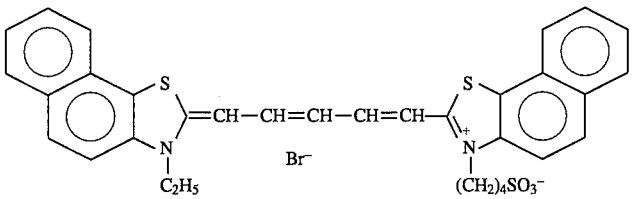
(V-7)
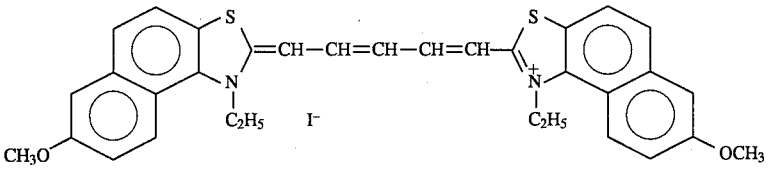

-continued
(V-8)
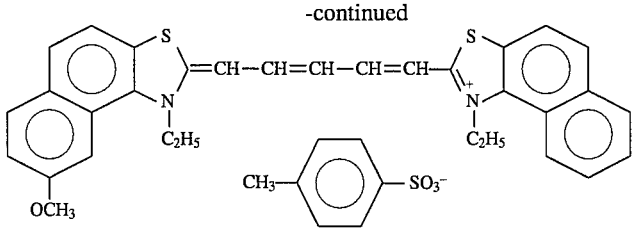
(V-9)
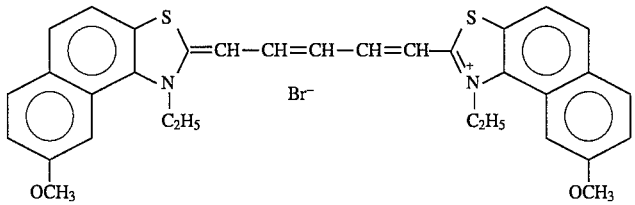
(V-10)
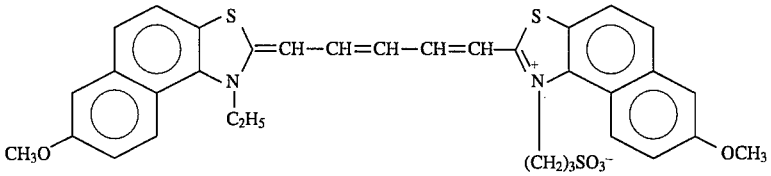
(V-11)
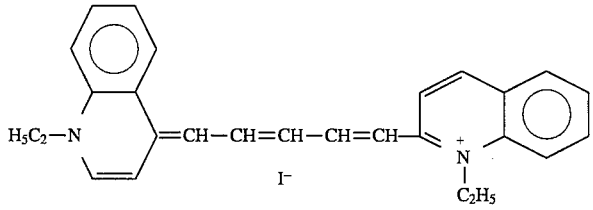
(V-12)
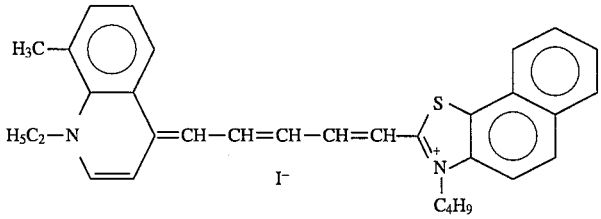
(V-13)
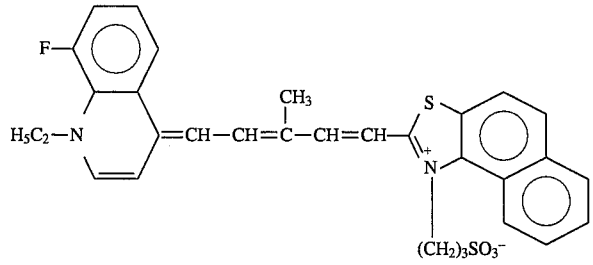
(V-14)
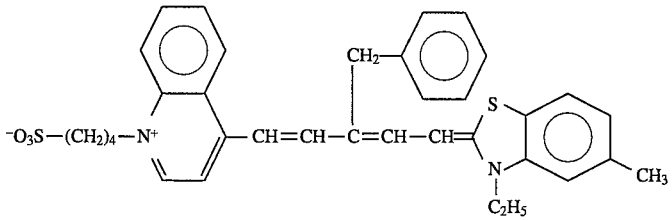

-continued
(V-15)
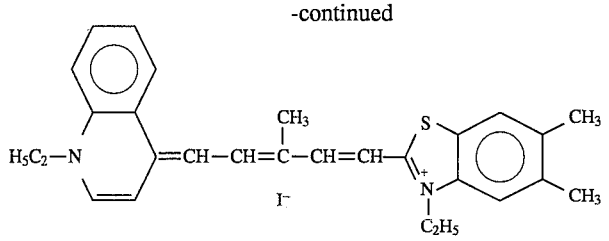
(V-16)
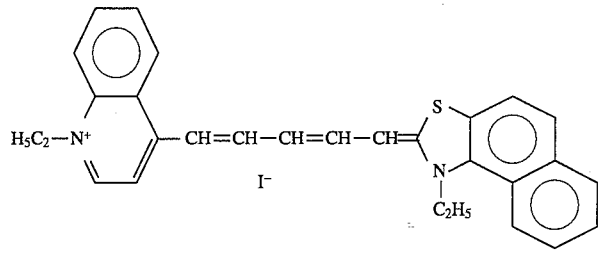
(V-17)
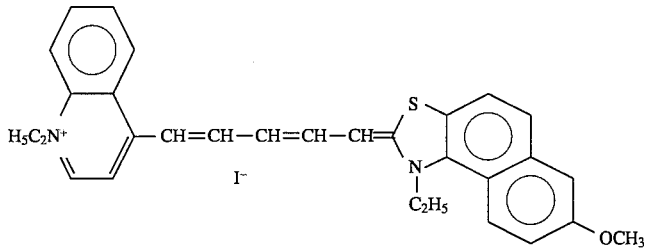
(V-18)
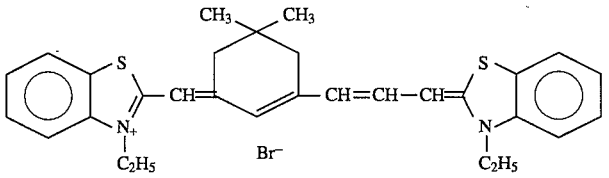
(V-19)
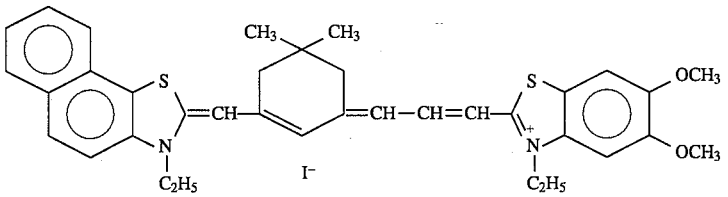
(V-20)
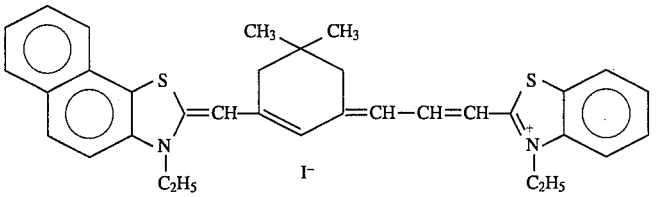
(V-21)
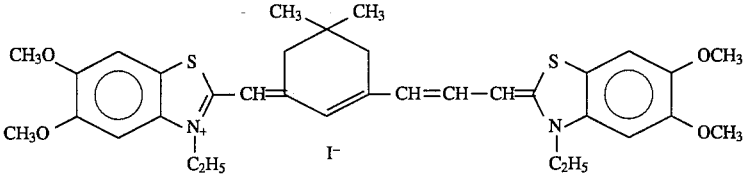

-continued
(V-22)
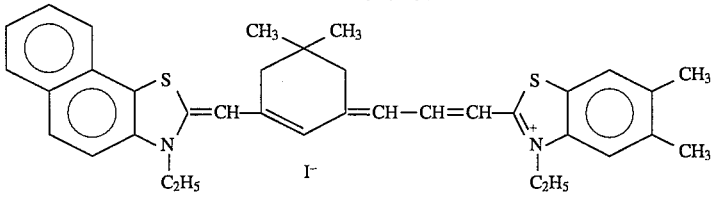
(V-23)
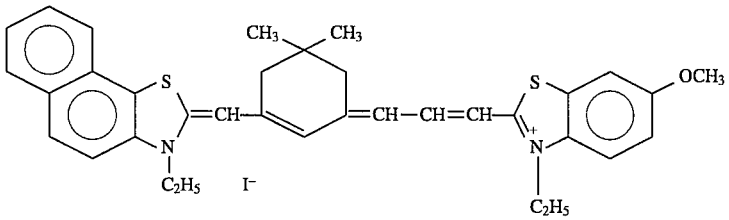
(V-24)
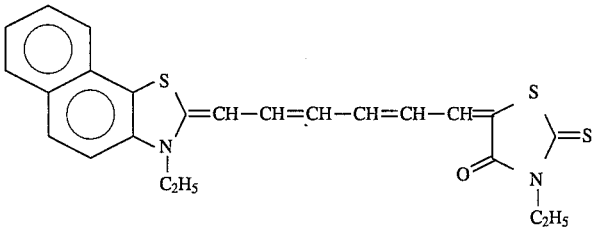
(V-25)
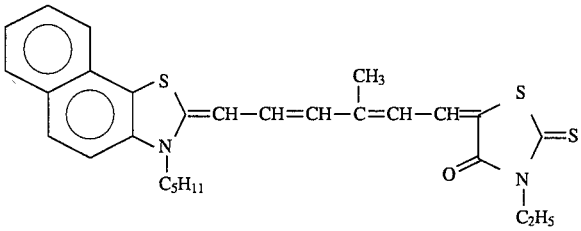
(V-26)
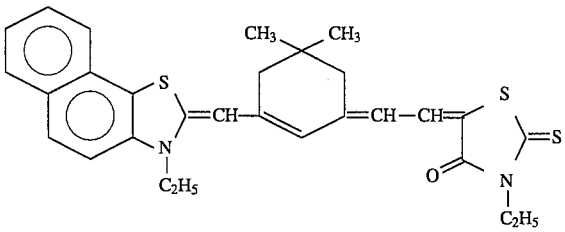
(V-27)
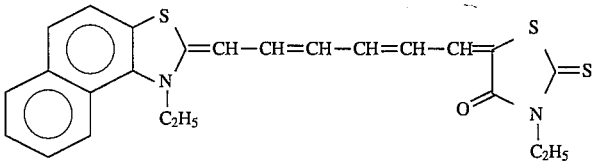
(V-28)
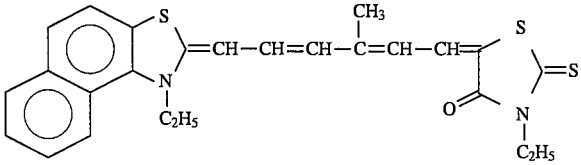
(V-29)
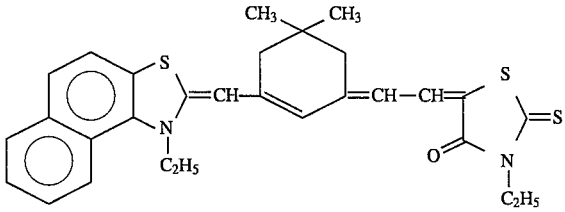

-continued
(V-30 )
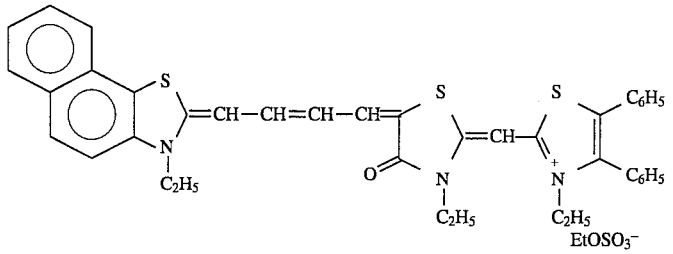
(V-31)
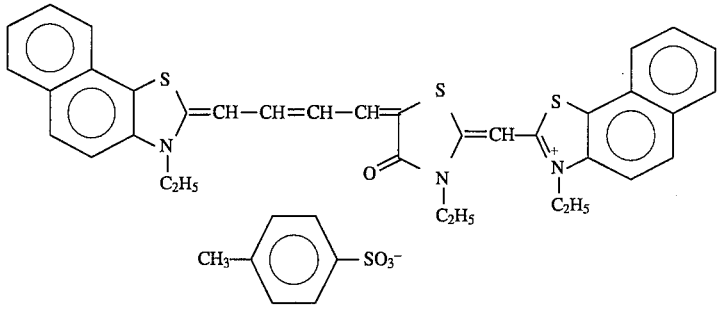
(V-32)
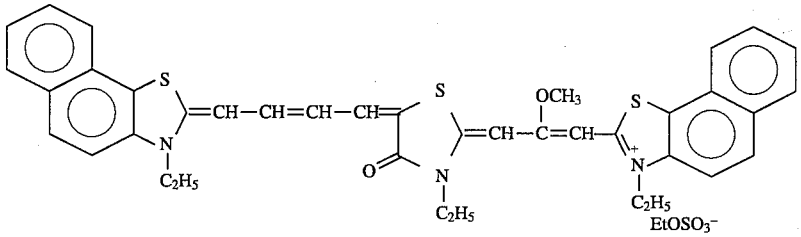
(V-33)
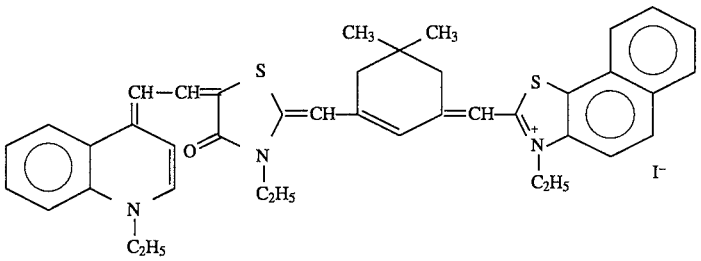
(V-34)
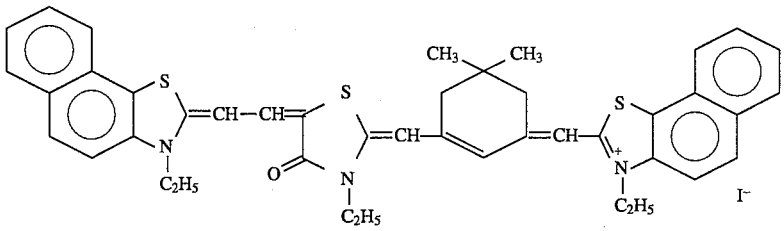
(V-35)
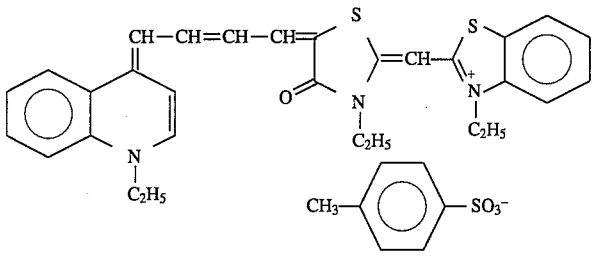

-continued
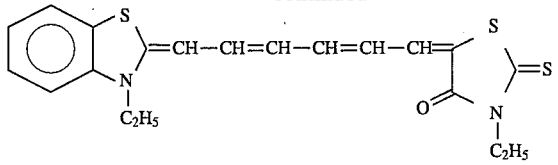
(V-36)
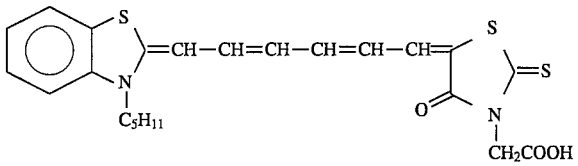
(V-37)
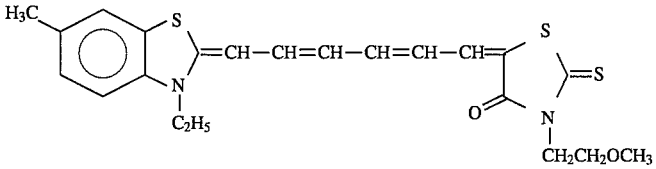
(V-38 )
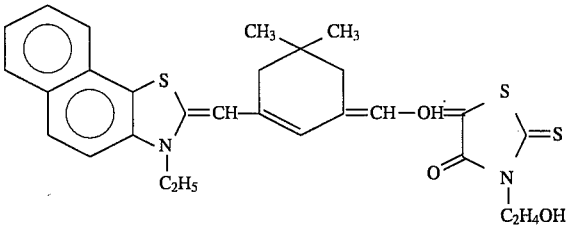
(V-39 )
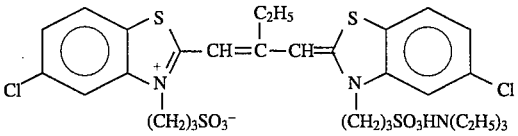
(V-40)
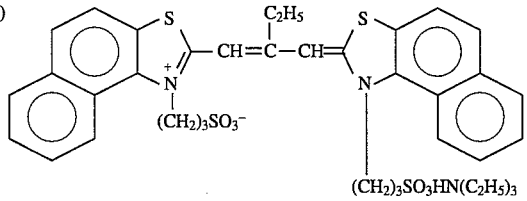
(V-41)
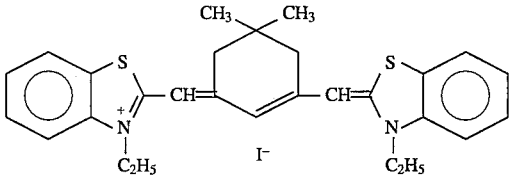
(V-42)
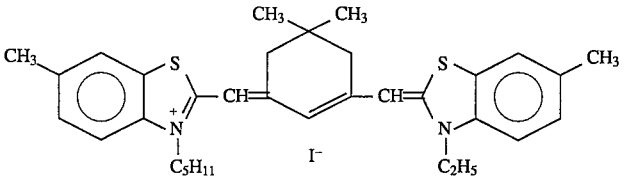
(V-43)
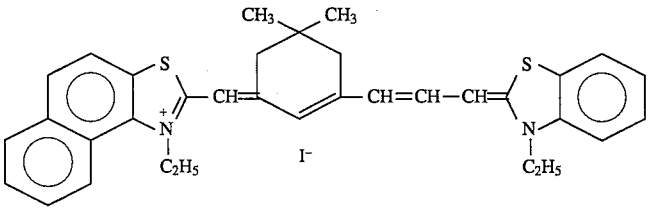
(V-44)

-continued
(V-45)
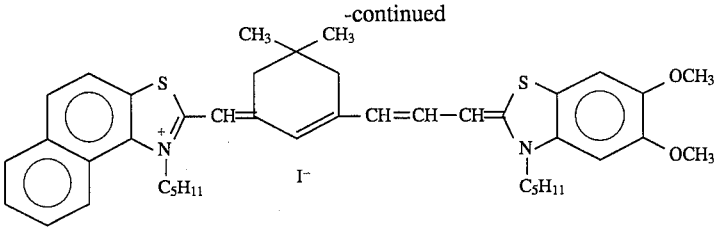
(V-46)
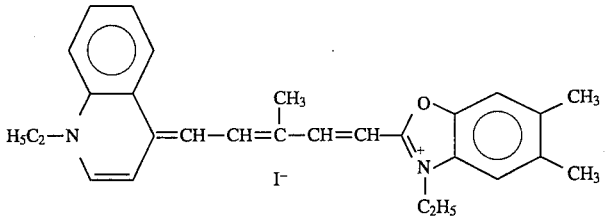
(V-47)
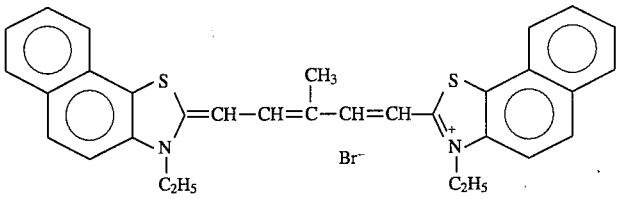
(V-48)
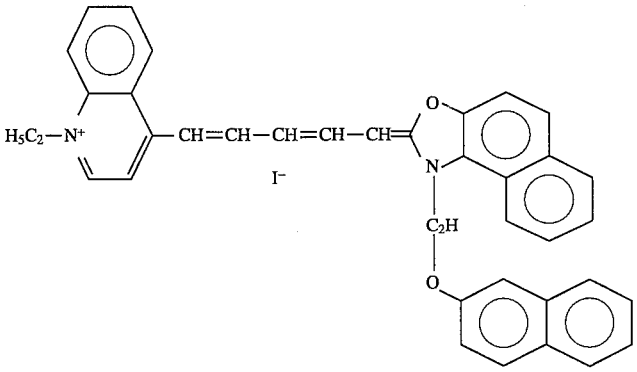
(V-49)
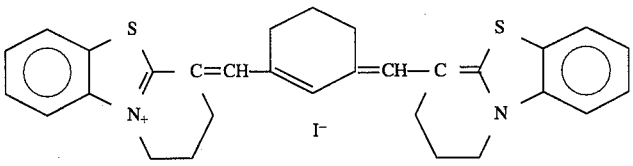
(V-50)
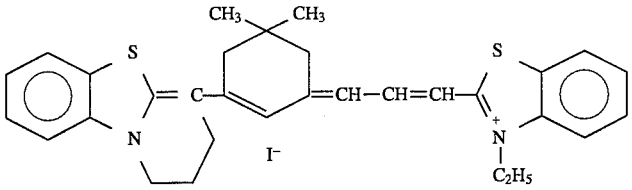
(V-51)
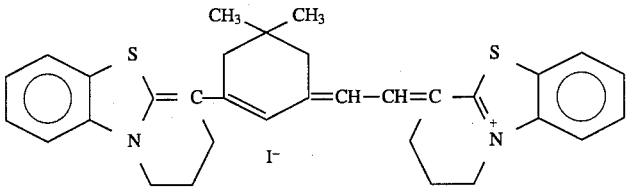

-continued
(V-52)
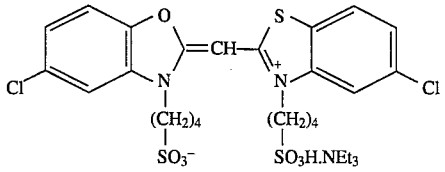
(V-53)
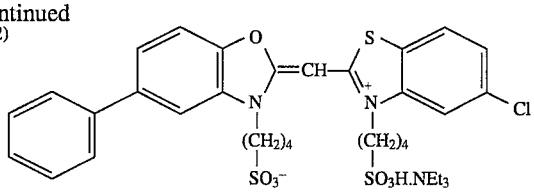
(V-54)
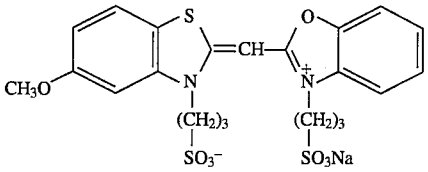
(V-55)
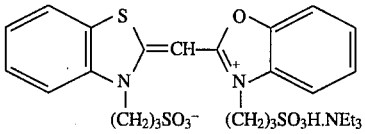
(V-56)
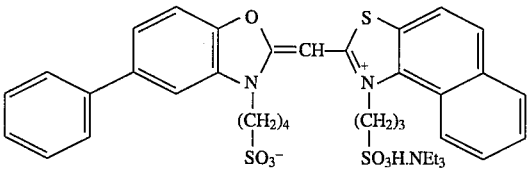
(V-57)
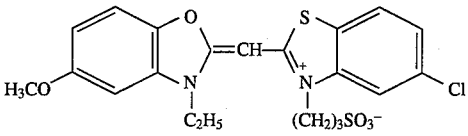
(V-58)
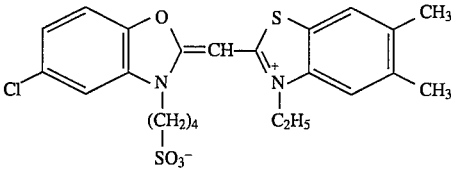
(V-59)
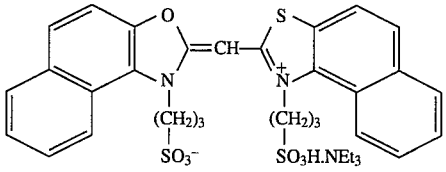
(V-60)
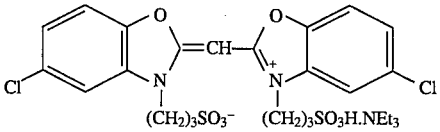
(V-61)
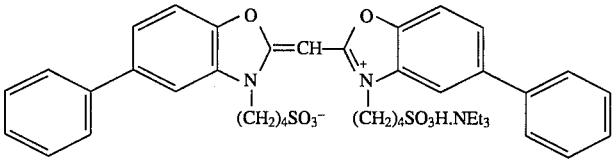
(V-62)
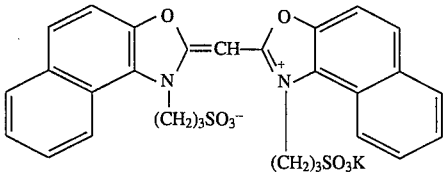
(V-63)
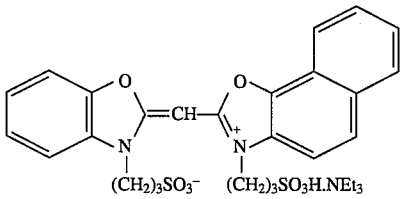
(V-64)
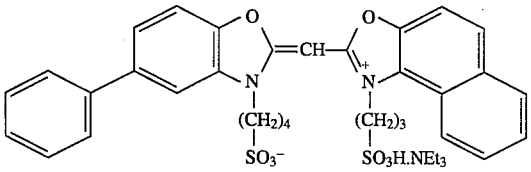
(V-65)
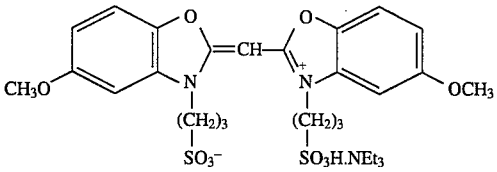
(V-66)
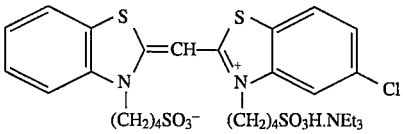
(V-67)
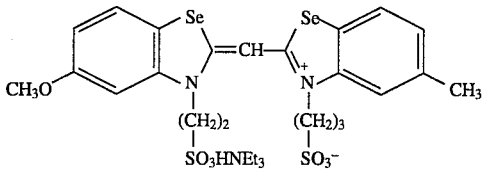

-continued
(V-68)
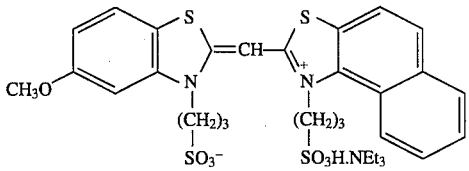
(V-69)
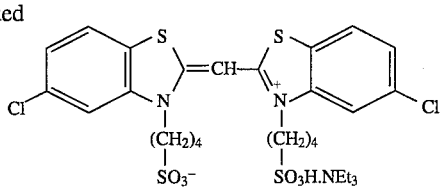
(V-70)
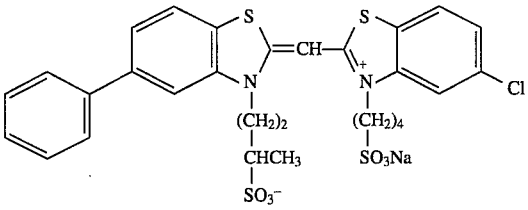
(V-71)
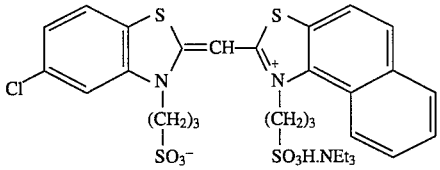
(V-72)
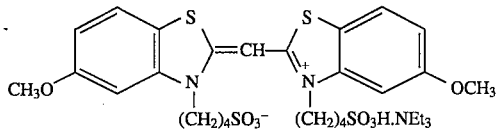
(V-73)
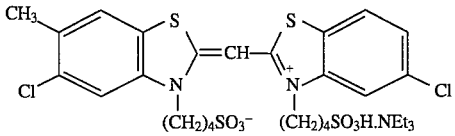
(V-74)
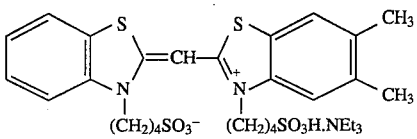
(V-75)
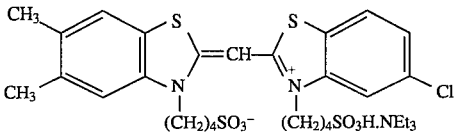
(V-76)
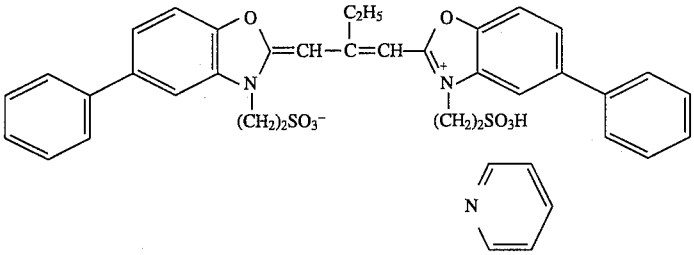
(V-77)
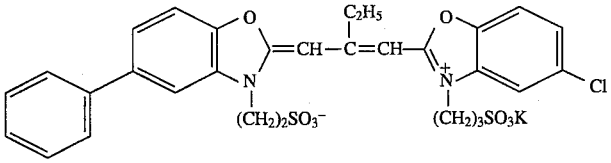
(V-78)
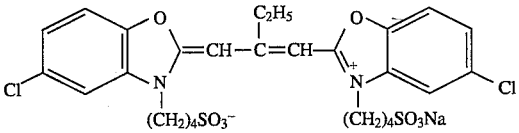
(V-79)
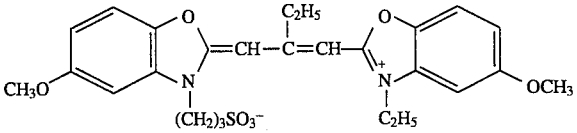
(V-80)
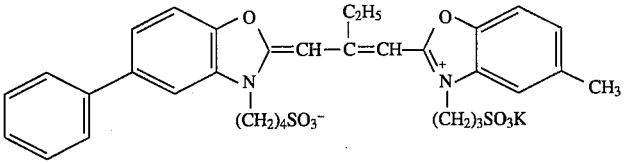

-continued
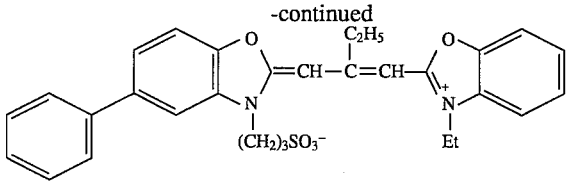
(V-81)
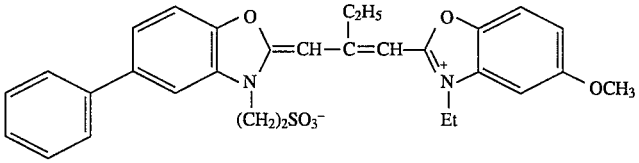
(V-82)
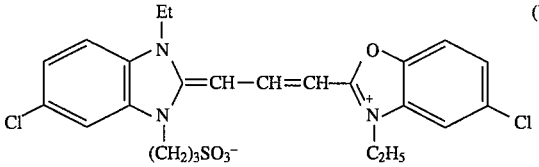
(V-83)
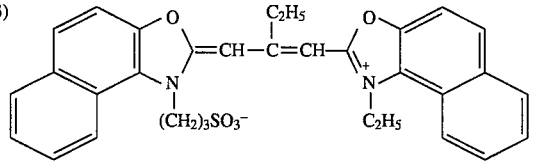
(V-84)
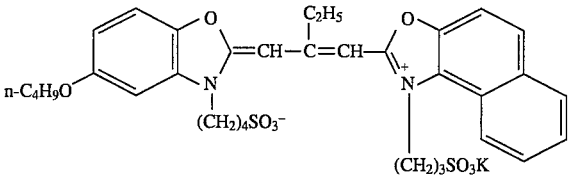
(V-85)
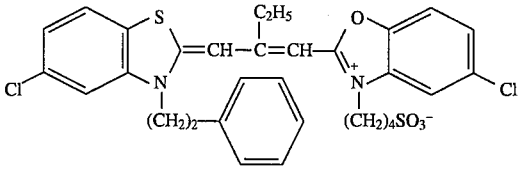
(V-86)
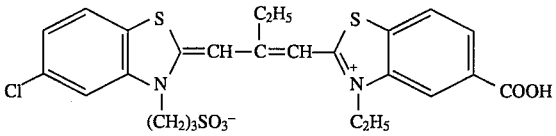
(V-87)
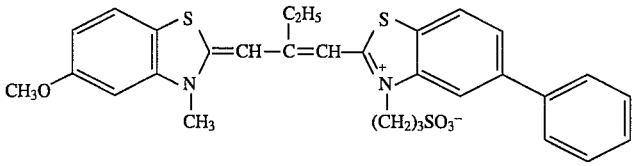
(V-88)
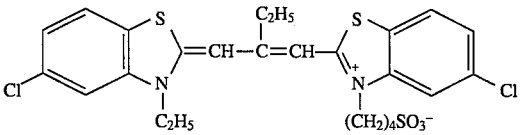
(V-89)
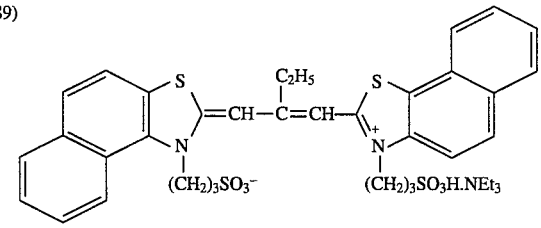
(V-90)
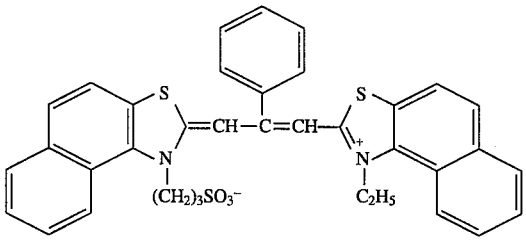
(V-91)

-continued
(V-92)
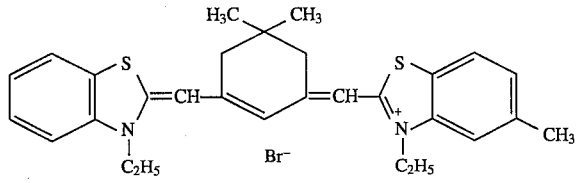
(V-93)
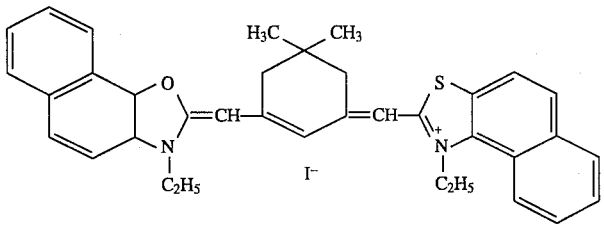
(V-94)
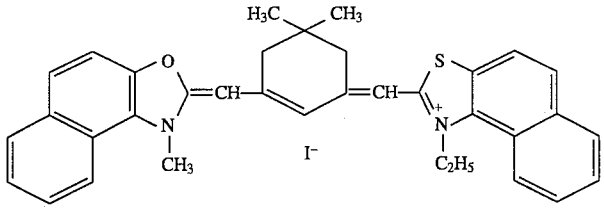
(V-95)
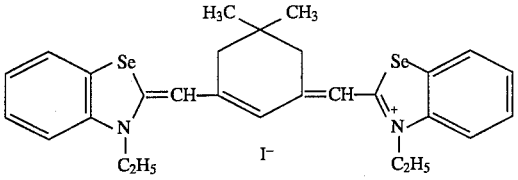
(V-96)
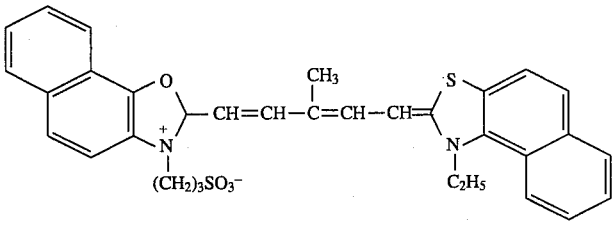
(V-97)
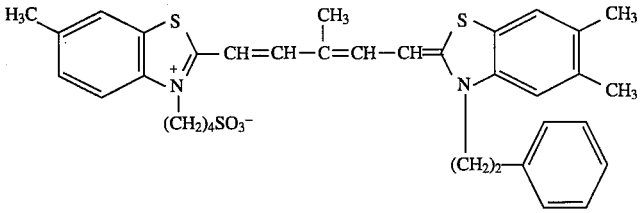
(V-98)
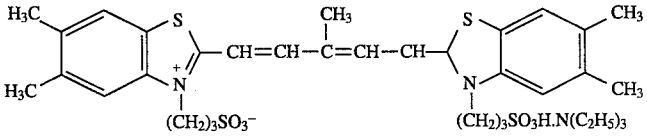
(V-99)
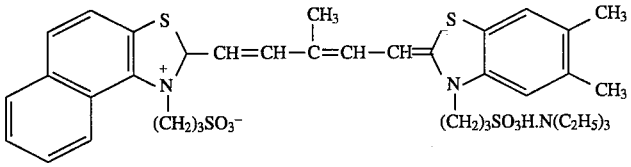

In accordance with the present invention, the content of the sensitizing dye in the silver halide photographic emulsion is from $5\times10^{-7}$ mol to $5\times 10^{-3}$ mol, preferably from $1\times10^{-6}$ mol to $1\times10^{-3}$ mol, especially preferably from $2\times10^{-6}$ mol to $5\times10^{-4}$ mol, per mol of silver halide.

The sensitizing dye may be directly dispersed into the emulsion. Alternatively, the dye is first dissolved in an appropriate solvent, such as methyl alcohol, ethyl alcohol, methyl cellosolve, acetone,water, pyridine or a mixed solvent thereof, and then the resulting solution may be added to the emulsion. Dissolution of the dye into the solvent may be effected ultrasonically. For instance, for adding an infrared sensitizing dye to the emulsion of the present invention, the following methods can be employed: the method described in U.S. Pat. No. 3,469,987 where a dye is dissolved in a volatile organic solvent, the resulting solution is dispersed in a hydrophilic colloid, and the resulting dispersion is added to an emulsion; the method described in JP-B-46-24185 (the term "JP-B" as used herein means an "examined Japanese patent publication") where a water-insoluble dye is directly dispersed in a water-soluble solvent without dissolution and the resulting dispersion is added to an emulsion; the method described in U.S. Pat. No. 3,822,135 where a dye is dissolved in a surfactant and the resulting solution is added to an emulsion; the method described in JP-A-51- 4624 where a dye is dissolved in the presence of a red-shifting compound and the resulting solution is added to an emulsion; and the method described in JP-A-50-80826 where a dye is dissolved in an acid substantially free of water and the resulting solution is added to an emulsion. Additionally other methods as described in U.S. Pat. Nos. 2,912,343, 3,342,605, 2,996, 287 and 3,429,835 may also be employed for adding infrared sensitizing dyes to the emulsion of the present invention. Infrared sensitizing dyes may be uniformly dispersed in the silver halide emulsion, before the emulsion is coated onto an appropriate support. Preferably, such dyes are added to the emulsion, before chemical sensitization or in the latter half stage of the step of forming the silver halide grains.

It is preferred that couplers having a higher molar ratio of the coloring coupler moiety to the developed silver halide are incorporated into the silver halide color photographic material of the present invention in order that the material may be well adapted to rapid processing for color development, so that the amount of the light-sensitive silver halide to be in the material may be reduced. In particular, so-called 2-equivalent couplers are preferred for the purpose. Additionally, use of 1-equivalent couplers is also acceptable in the present invention. Using a 1-equivalent coupler, the coupler is coupled with the quinone-diimine form of an aromatic amine of a color developing agent and, thereafter, oxidized with any oxidizing agent other then silver halide in the subsequent mono-electron oxidizing coloration step.

In general, color photographic materials contain color couplers such that the maximum color density is 3 or more as a trasmission density and 2 or more as a reflection density. In the image forming method used in the present invention using an exposure unit, color correction and color gradation conversion are simultaneously carried out in the image-processing device. Therefore, an excellent color image may be obtained in the photographic material of the present invention, when the- maximum reflection color density is approximately from 1.2 to 2.0, preferably from about 1.6 to 2.0. Therefore, the amount of the color couplers and the amount of the light-sensitive silver halide in the material may be reduced.

The amount of the yellow coupler, magenta coupler and cyan coupler in the color photographic material of the present invention, especially in a reflective color photographic material thereof, are from $5\times10^{-4}$ to $10\times10^{-4}$ mol/$m^2$, from $15\times10^{-4}$ to $8\times 10^{-4}$ mol/$m^2$ and from $1.5\times10^{-4}$ to $7\times10^{-4}$ mol/$m^2$, respectively.

Next, couplers which are suitable for the color photographic materials of the present invention will be explained below.

Cyan couplers, magenta couplers and yellow couplers which are preferably used in the present invention are those of the following general formulae (C-I), (C-II), (M-I), (M-II) and (Y).

(C-I)

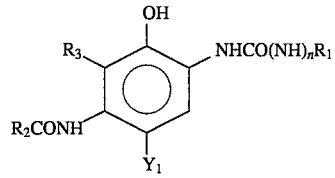

(C-II)

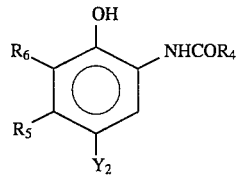

(M-I)

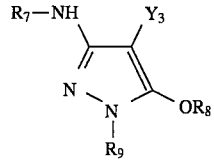

(M-II)

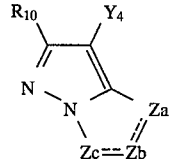

(Y)

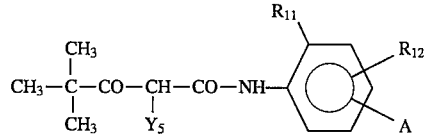

In formulae (C-I) and (C-II), $R_1$, $R_2$ and $R_4$ each represents a substituted or unsubstituted aliphatic, aromatic or heterocyclic group; $R_3$, $R_5$ and $R_6$ each represent a hydrogen atom, a halogen atom, an aliphatic group, an aromatic group or an acylamino group; and $R_3$ and $R_2$ may together be a non-metallic atomic group for forming a nitrogen-containing 5-membered or 6-membered ring in the formula. $Y_1$ and $Y_2$ each represents a hydrogen atom or a group capable of splitting from the formula in a coupling reaction with the oxidation product of a developing agent. n represents 0 or 1.

In formula (C-II), $R_5$ is preferably an aliphatic group, such as a methyl group, an ethyl group, a propyl group, a butyl group, a pentadecyl group, a tert-butyl group, a cyclohexyl group, a cyclohexylmethyl group, a phenylthiomethyl group, a dodecyloxyphenylthiomethyl group, a butanamidomethyl group or a methoxymethyl group.

Preferred examples of cyan couplers of formulae (C-I) and (C-II) are mentioned below.

In formula (C-I), $R_1$ is preferably an aryl group or a heterocyclic group, and is more preferably an aryl group as substituted by one or more substituents selected from a halogen atom, an alkyl group, an alkoxy group, an aryloxy group, an acylamino group, an acyl group, a carbamoyl group, a sulfonamido group, a sulfamoyl group, a sulfonyl group, a sulfamide group, an oxycarbonyl group and a cyano group.

In formula (C-I) where $R_3$ does not form a ring with $R_2$, $R_2$ is preferably a substituted or unsubstituted alkyl or aryl group, and is especially preferably a substituted aryloxy-substituted alkyl group, and $R_3$ is preferably a hydrogen atom.

In formula (C-II), $R_4$ is preferably a substituted or unsubstituted alkyl or aryl group, and is especially preferably a substituted aryloxy-substituted alkyl group.

In formula (C-II), $R_5$ is preferably an alkyl group having from 2 to 15 carbon atoms or a methyl group having substituent(s) with one or more carbon atoms. Substituents of the methyl group are preferably an arylthio group; an alkylthio group, an acylamino group, an aryloxy group and an alkyloxy group.

In formula (C-II), $R_5$ is more preferably an alkyl group having from 2 to 15 carbon atoms and is especially preferably an alkyl group having from 2 to 4 carbon atoms.

In formula (C-II), $R_6$ is preferably a hydrogen atom or a halogen atom and is especially preferably a chlorine atom or a fluorine atom. In formulae (C-I) and (C-II), $Y_1$ and $Y_2$ each are preferably a hydrogen atom, a halogen atom, an alkoxy group, an aryloxy group, an acyloxy group or a sulfonamido group.

In formula (M-I), $R_7$ and $R_9$ each represents an aryl group; $R_8$ represents a hydrogen atom, an aliphatic or aromatic acyl group, or an aliphatic or aromatic sulfonyl group; and $Y_3$ represents a hydrogen atom or a splitting group. Suitable substituents of the aryl group (preferably, a phenyl group) represented by $R_7$ and $R_9$ are those which are acceptable to the above-mentioned $R_1$ group. Where the aryl group has two or more substituents, they may be same or different. $R_8$ is preferably a hydrogen atom, or an aliphatic acyl or sulfonyl group, and is especially preferably a hydrogen atom. $Y_3$ is preferably a splitting group of such a type that splits via any one of sulfur, oxygen and nitrogen atoms. It is especially preferably a sulfur atom-splitting group as described in U.S. Pat. No. 4,351,987 or International Patent Laid-Open No. WO88/04795.

In formula (M-II), $R_{10}$ represents a hydrogen atom or a substituent. $Y_4$ represents a hydrogen atom or a splitting group, and is especially preferably a halogen atom or an arylthio group. Za, Zb and Zc each represent a methine group, a substituted methine group, =N— or —NH—. One of Za-Zb bond and Zb-Zc bond is a double bond and the other is a single bond. Where Zb-Zc bond is a carbon-carbon double bond, it may be a part of forming an aromatic ring in the formula. The formula may also be in the form of a dimer or a higher polymer at the position of $R_{10}$ or $Y_4$, or at the position of the substituted methine group of Za, Zb or Zc.

Of pyrazoloazole couplers of formula (M-II), imidazo[1,2-b]pyrazoles described in U.S. Pat. No. 4,500,630 are preferred because the colored dyes therefrom give little yellow side-absorption and an excellent light-fastness. Pyrazole[1,5-b][1,2,4]triazoles described in U.S. Pat. No. 4,540,654 are especially preferred.

Additionally, pyrazolotziazole couplers having a branched alkyl group as directly bonded to the 2-, 3- or 6-position of the pyrazolotriazole ring, as described in JP-A-61-65245; pyrazoloazole couplers having a sulfonamido group in the molecule, as described in JP-A-61- 65246; pyrazoloazole couplers having an alkoxyphenylsulfonamido ballast group, as described in JP-A-61- 147254; and pyrazolotriazole couplers having an alkoxy or aryloxy group at the 6-position, as described in European Patents 226,849 and 294,785 are also preferably used.

In formula (Y), $R_{11}$ represents a halogen atom, an alkoxy group, a trifluoromethyl group or an aryl group; $R_{12}$ represents a hydrogen atom, a halogen atom or an alkoxy group; A represents $—NHCOR_{13}$, $—NHSO_2—R_{13}—$, $—SO_2NHR_{13}$, $—COOR_{13}$ or $$—SO_2\underset{\underset{R_{14}}{|}}{N}—R_{13};$$

and $R_{13}$ and $R_{14}$ each represents an alkyl group, an aryl group or an acyl group. $Y_5$ represents a splitting group. As substituents of $R_{12}$, $R_{13}$ and $R_{14}$, those of the above-mentioned group $R_1$ are referred to. The splitting group of $Y_5$ is preferably a group of a type that may split from the formula via an oxygen atom or a nitrogen atom, and it is especially preferably a nitrogen atom-splitting group.

Specific examples of couplers of formulae (C-I), (C-II), (M-I), (M-II) and (Y) are mentioned below.

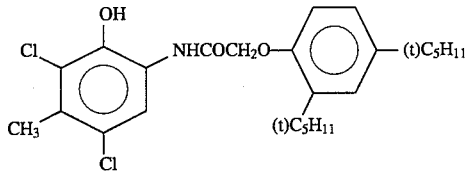

(C-1)

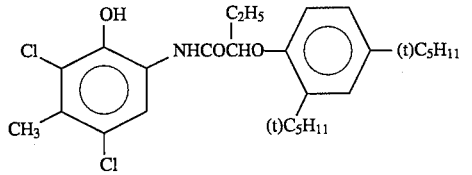

(C-2)

-continued
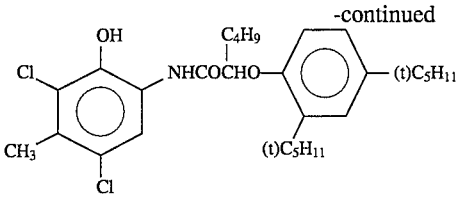
(C-3)
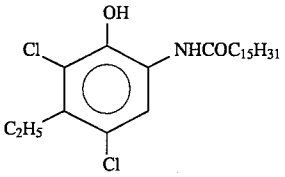
(C-4)
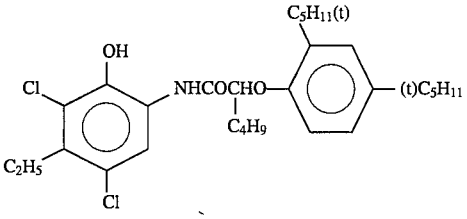
(C-5)
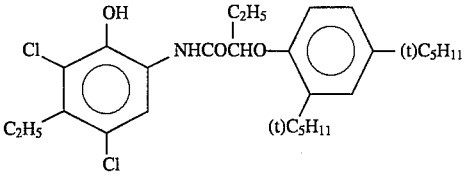
(C-6)
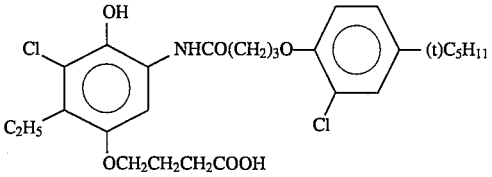
(C-7)
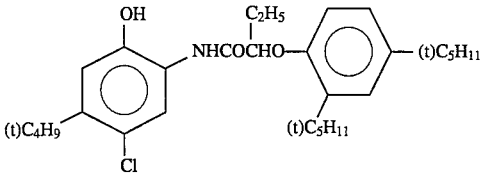
(C-8)
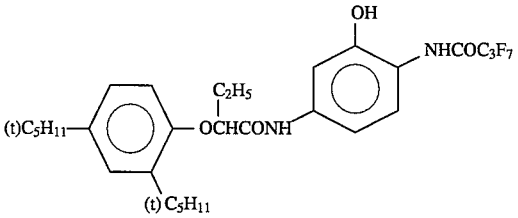
(C-9)
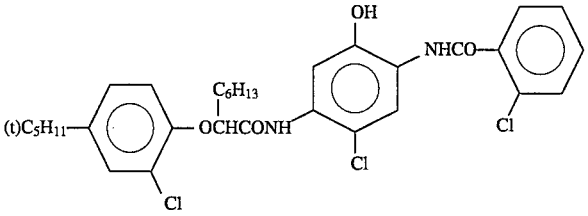
(C-10)

-continued
(C-11)
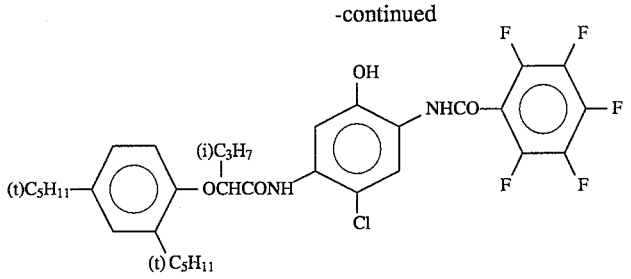
(C-12)
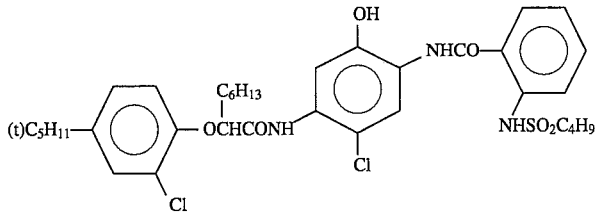
(C-13)
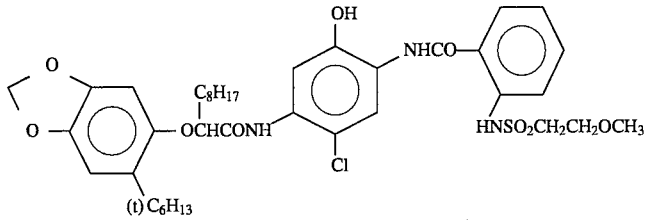
(C-14)
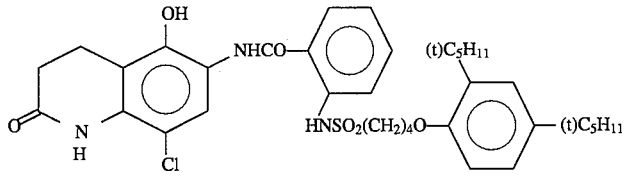
(C-15)
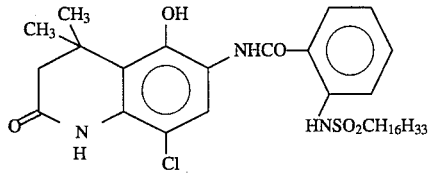
(C-16)
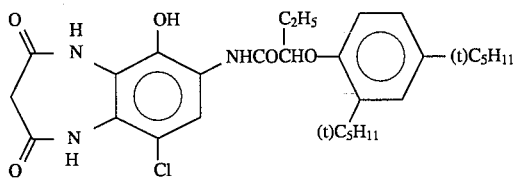
(C-17)
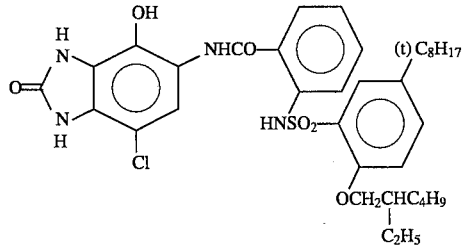

-continued
(C-18)
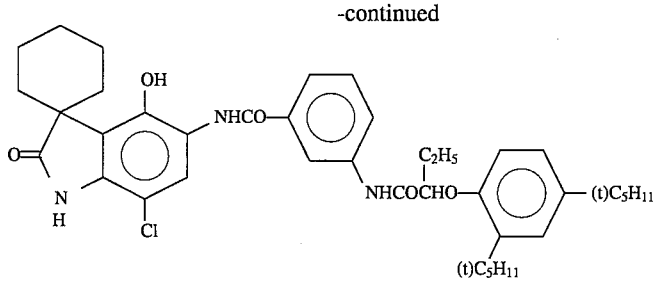
(C-19)
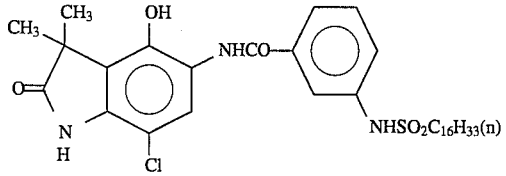
(C-20)
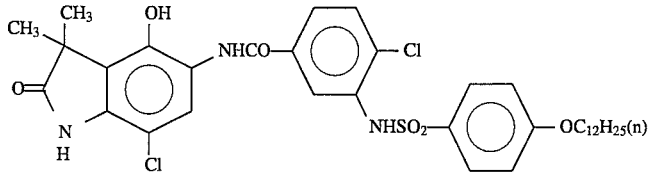
(C-21)
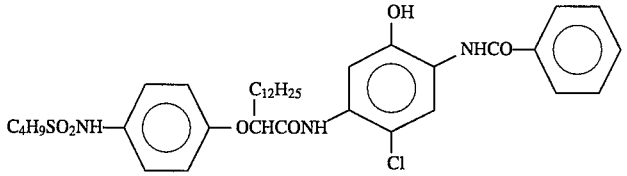
(C-22)
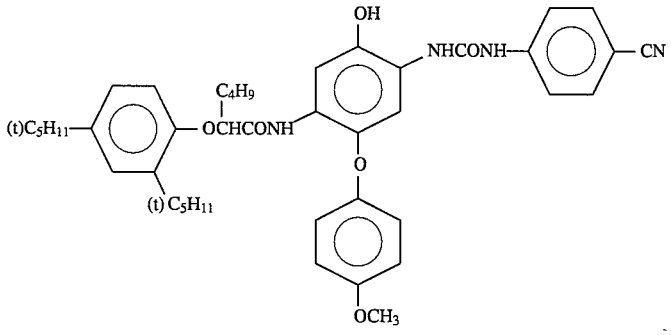
(M-1)
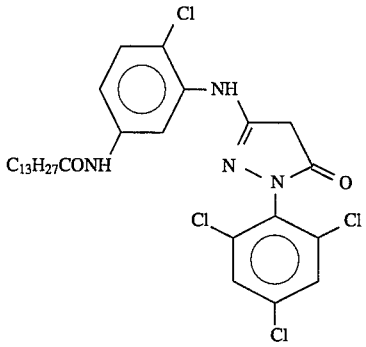

-continued
(M-2)
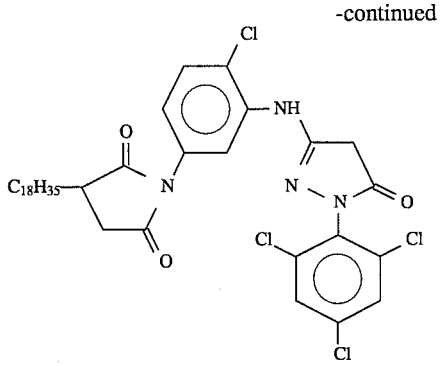
(M-3)
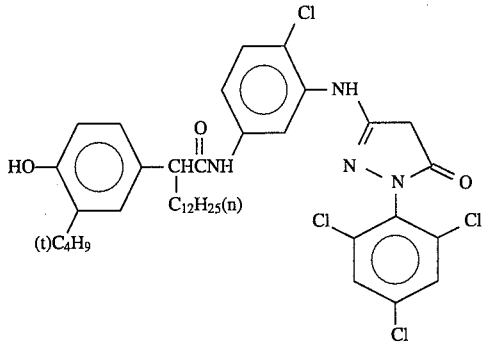
(M-4)
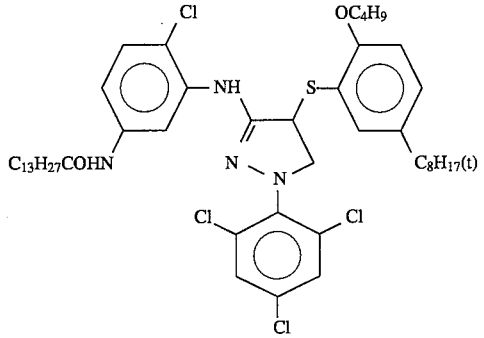
(M-5)
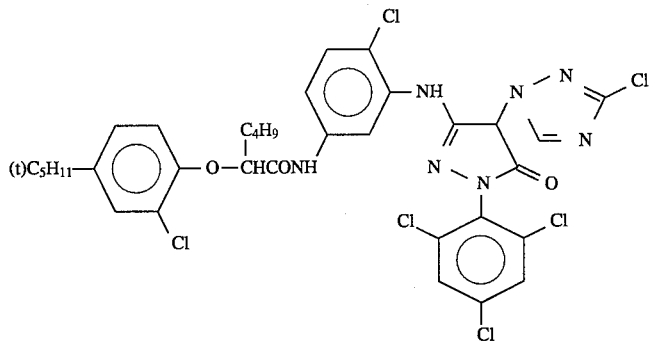

-continued
(M-6)
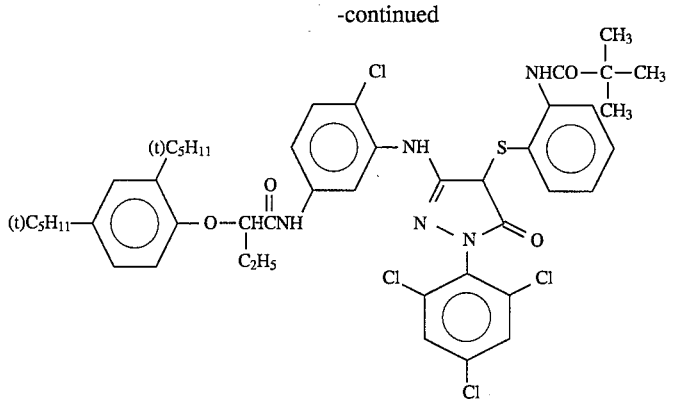
(M-7)
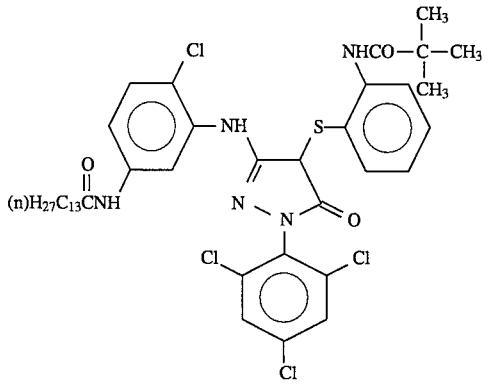
(M-8)
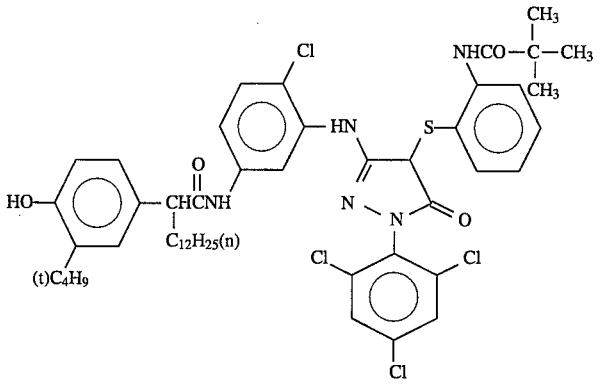

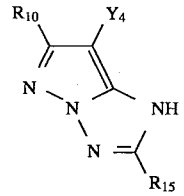
| Compound | $R_{10}$ | $R_{15}$ | $Y_4$ |
|---|---|---|---|
| M-9 | $CH_3-$ | 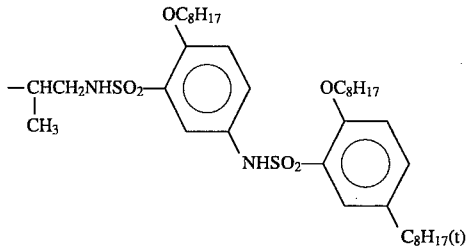 | Cl |
| M-10 | $CH_3-$ | 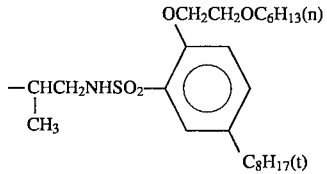 | Cl |
| M-11 | $(CH_3)_3C-$ | 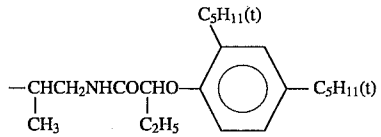 | 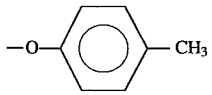 |
| M-12 | 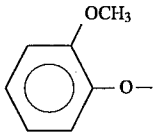 | 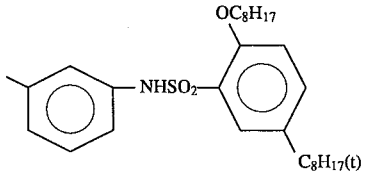 | 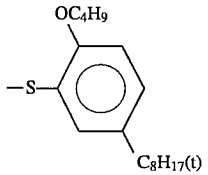 |

-continued
| | | | |
|---|---|---|---|
| M-13 | $CH_3$— | 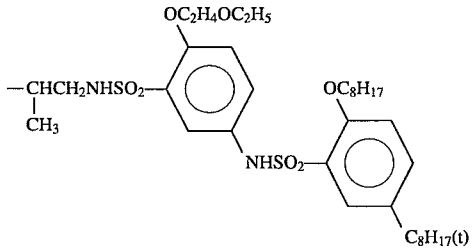 | Cl |
| M-14 | $CH_3$— | 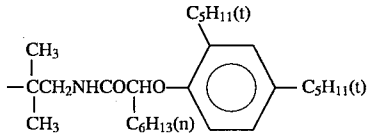 | Cl |
| M-15 | $CH_3$— | 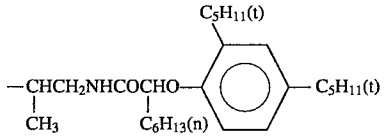 | Cl |
| M-16 | $CH_3$— | 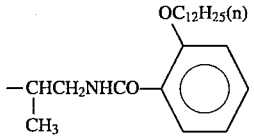 | Cl |
| M-17 | $CH_3$— | 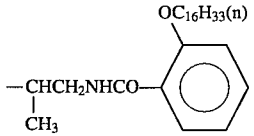 | Cl |

-continued
| | | | |
|---|---|---|---|
| M-18 | 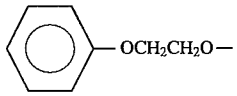 | 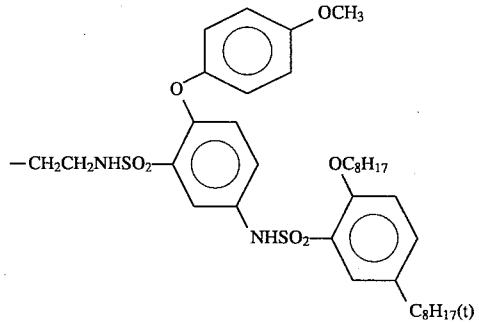 | 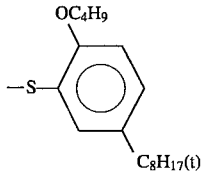 |
| M-19 | $CH_3CH_2O-$ | 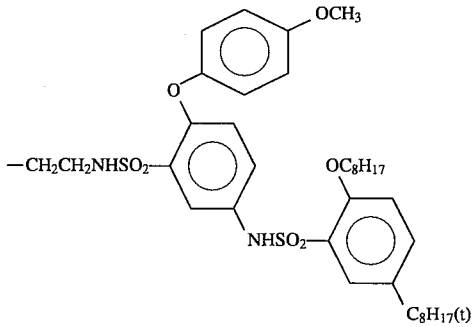 | 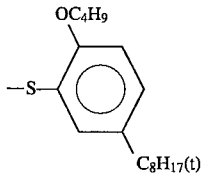 |
| M-20 | 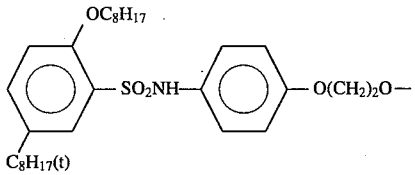 | 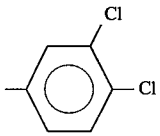 | 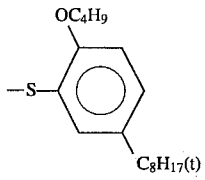 |
| M-21 | 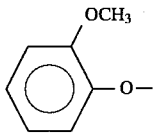 | 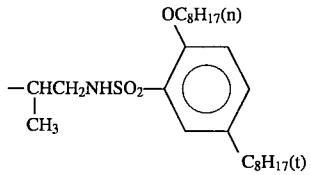 | Cl |

-continued
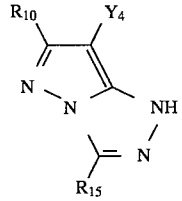
| Compound | $R_{10}$ | $R_{15}$ | $Y_4$ |
|---|---|---|---|
| M-22 | $CH_3-$ | 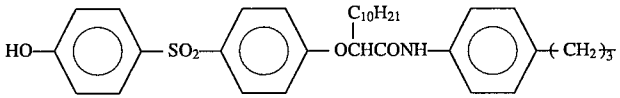 | Cl |
| M-23 | $CH_3-$ | 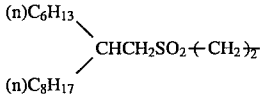 | Cl |
| M-24 | 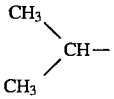 | 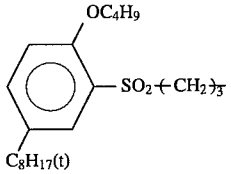 | Cl |
| M-25 | 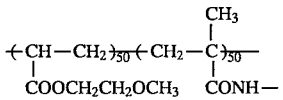 | 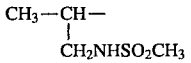 | Cl |
| M-26 | 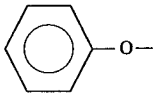 | 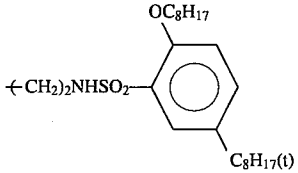 | Cl |

-continued
| | | | |
|---|---|---|---|
| M-27 | $CH_3-$ | 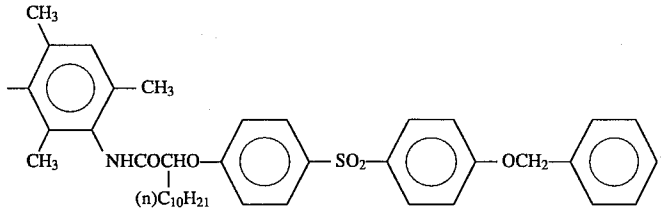 | Cl |
| M-28 | $(CH_3)_3C-$ | 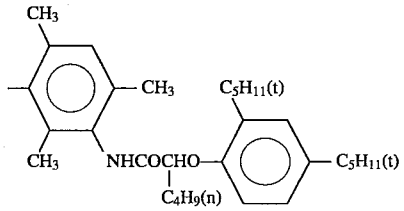 | Cl |
| M-29 | 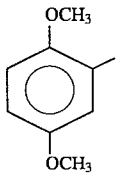 | 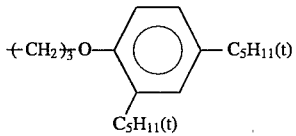 | Cl |
| M-30 | $CH_3-$ | 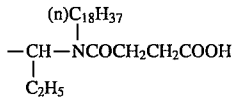 | Cl |

(Y-1)
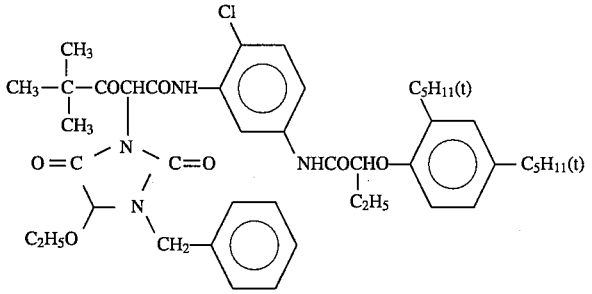
(Y-2)
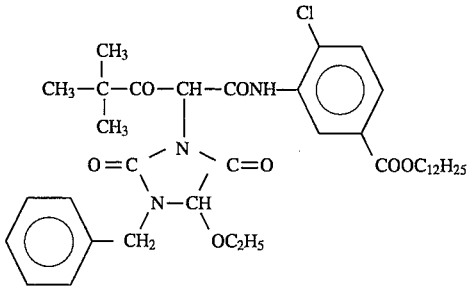
(Y-3)
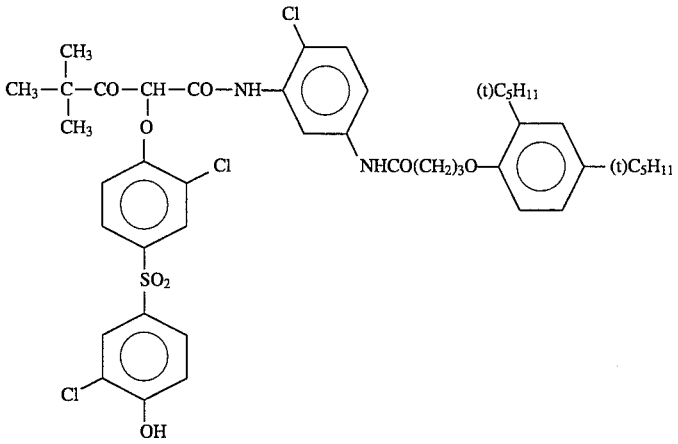
(Y-4)
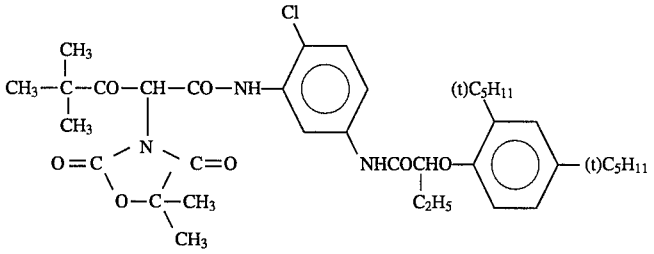
(Y-5)
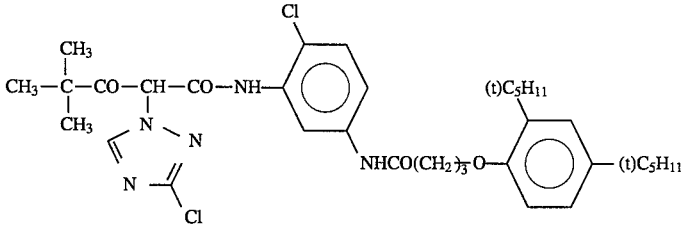

-continued
(Y-6)
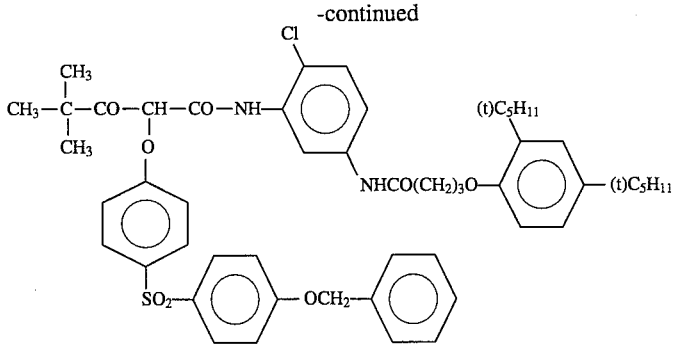
(Y-7)
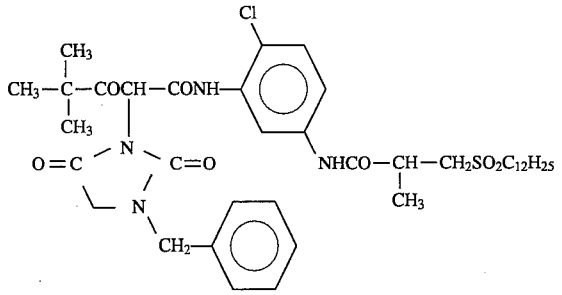
(Y-8)
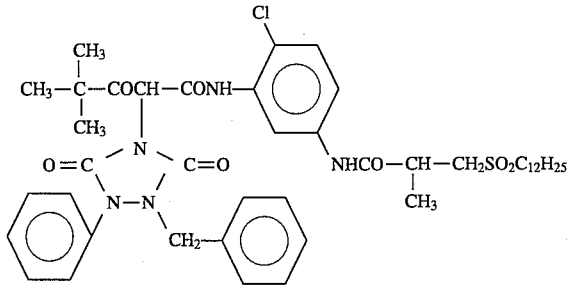
(Y-9)
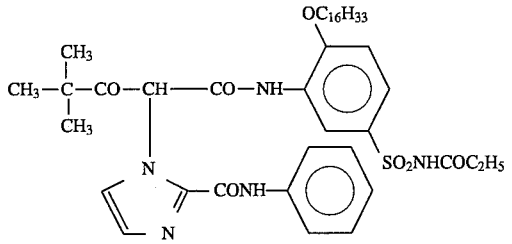
(Y-10)
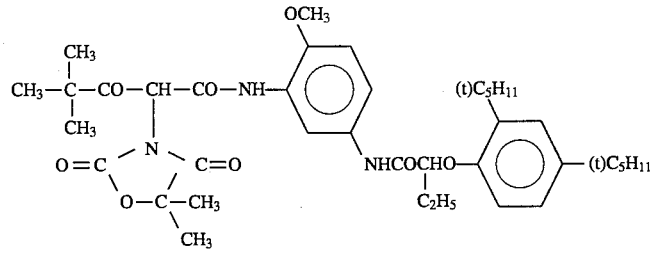

-continued

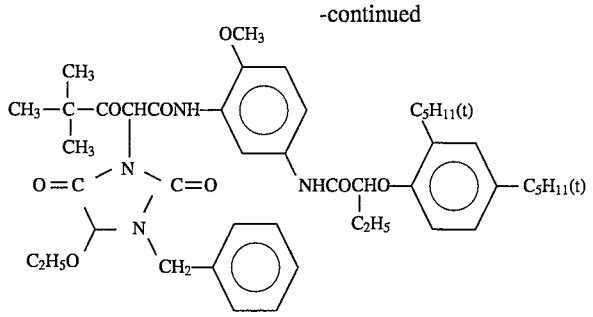

(Y-11)

The couplers of the above-mentioned formulae (C-I) to (Y) may be incorporated into the silver halide emulsion layers of the light-sensitive layer of the photographic material of the present invention, in an amount of generally from 0.1 to 1.0 mol, preferably from 0.1 to 0.5 mol, per mol of silver halide.

In the present invention, various known techniques may be employed for introducing the above-mentioned couplers into the light-sensitive layers. In general, a conventional oil-in-water dispersion method, which is known as an oil-protecting method, is employed. In this method, a coupler is first dissolved in a solvent and the resulting solution is dispersed in a gelatin-containing aqueous solution by emulsification. Alternatively, water or a gelatin-containing aqueous solution may be added to a surfactant-containing coupler dispersion to form an oil-in-water dispersion by phase conversion. Alkali-soluble couplers can be dispersed by the Fisher dispersion method. The low boiling point organic solvent, if any, is removed from the coupler dispersion by distillation, noodle washing or ultra-filtration, and thereafter, the resulting dispersion may be blended with a photographic emulsion.

As a coupler dispersion medium of the type, in general, it is preferred to use high boiling point organic solvents and/or water-insoluble polymer compounds having a dielectric constant (at 25° C.) of from 2 to 20 and a refractive index (at 25° C.) of from 1.5 to 1.7.

As high boiling point organic solvents of this type, those of the following general formulae (A) to (E) are preferably used.

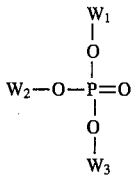

(A)

$W_1-COO-W_2$ (B)

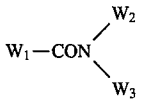

(C)

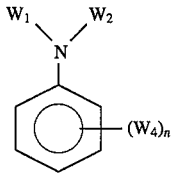

(D)

-continued $W_1-O-W_2$ (E)

In these formulae, $W_1$, $W_2$ and $W_3$ each represents a substituted or unsubstituted alkyl, cycloalkyl, alkenyl, aryl or heterocyclic group; $W_4$ represents $W_1$, $OW_1$ or $SW_1$; n represents an integer of from 1 to 5; and when n is 2 or more, plural $W_4$'s may be same or different. In formula (E), $W_1$ and $W_2$ may form a condensed ring.

In addition to compounds of the above-mentioned formulae (A) to (E), water-immiscible compounds having a melting point of 100° C. or lower and a boiling point of 140° C. or higher, which are good solvents for couplers, may also be used in the present invention. The high boiling point organic solvents for use in the invention preferably have a melting point of 80° C. or lower. They preferably have a boiling point of 160° C. or higher, more preferably 170° C. or higher.

The details of the high boiling point organic solvents are described in JP-A-62-215272, from page 137, right-lower column to page 144, right-upper column.

As other methods, the couplers may be immersed in a loadable latex polymer (for example, as described in U.S. Pat. No. 4,203,716) in the presence or absence of the above-mentioned high boiling point organic solvent, or may be dissolved in a water-insoluble and organic solvent-soluble polymer, and the resulting polymer or solution may be dispersed in an aqueous hydrophilic colloid solution by emulsification.

Preferably, homopolymers or copolymers described in International Patent Application Laid-Open No. WO88/00723, pages 12 to 30 are employed. In particular, use of acrylamide polymers is especially preferred for the purpose of stabilizing the color images formed.

The photographic material of the present invention may contain, as a color-fogging inhibitor, hydroquinone derivatives, aminophenol derivatives, gallic acid derivatives and ascorbic acid derivatives.

The photographic material of the present invention may contain various anti-fading agents. For instance, usable organic anti-fading agents for cyan, magenta and/or yellow images are hindered phenols such as hydroquinones, 6-hydroxychromans, 5-hydroxycoumarans, spirochromans, p-alkoxyphenols and hisphenols; gallic acid derivatives; methylenedioxybenzenes; aminophenols; hindered amines; as well as ether or ester derivatives thereof prepared by silylating or alkylating the phenolic hydroxyl group in the said compounds. In addition, metal complexes such as (bissalicylaldoximato)nickel complexes and (bis-N,N-dialkyldithiocarbamato)nickel complexes may also be employed.

Specific examples of organic anti-fading agents which are usable in the present invention are mentioned in the following patent publications.

Hydroquinones are described in U.S. Pat. Nos. 2,360,290, 2,418,613, 2,700,453, 2,701,197, 2,728,659, 2,732,300, 2,735,765, 3,982,944 and 4,430,425, British Patent 1,363, 921, and U.S. Pat. Nos. 2,710,801 and 2,816,028; 6-hydroxychromans, 5-hydroxycoumarans, and spirochromans are described in U.S. Pat. Nos. 3,432,300, 3,573,050, 3,574, 627, 3,698,909 and 3,764,337, and JP-A- 52-152225; spiroindanes are described in U.S. Pat. No. 4,360,589; p-alkoxyphenols are described in U.S. Pat. No. 2,735,765, British Patent 2,066,975, JP-A-59- 10539 and JP-B-57-19765; hindered phenols are described in U.S. Pat. No. 3,700,455, JP-A-52-72224, U.S. Pat. No. 4,228,235 and JP-B-52-6623; gallic acid derivatives, methylenedioxybenzenes and aminophenols are described in U.S. Pat. Nos. 3,457,079 and 4,332,886 and JP-B-56- 21144; hindered amines are described in U.S. Pat. Nos. 3,336,135 and 4,268,593, British Patents 1,326,889, 1,354,313 and 1,410, 846, JP-B-51-1420, and JP-A-58-114036, JP-A-59- 53846 and JP-A-59-78344; and metal complexes are described in U.S. Pat. Nos. 4,050,938 and 4,241,155 and British Patent 2,027,731(A). These compounds are added to the light-sensitive layer by coemulsifying with the corresponding coupler generally in an amount of from 5 to 100% by weight to the coupler, whereby the intended object is attained.

For preventing deterioration of cyan color images by heat and especially by light, incorporation of an ultraviolet absorbent into the cyan coloring layer or into the both adjacent layers is more effective.

As examples of ultraviolet absorbents suitable for this purpose, there are mentioned aryl group-substituted benzotriazole compounds (for example, those described in U.S. Pat. No. 3,533,794), 4-thiazolidone compounds (for example, those described in U.S. Pat. Nos. 3,314,794 and 3,352,681), benzophenone compounds (for example, those described in JP-A-46-2784), cinnamate compounds (for example, those described in U.S. Pat. Nos. 3,705,805 and 3,707,395), butadiene compounds (for example, those described in U.S. Pat. No. 4,045,229), and benzoxazole compounds (for example, those described in U.S. Pat. Nos. 3,406,070, 3,677,762 and 4,271,307). Additionally, ultraviolet-absorbing couplers (for example, alpha-naphthol type cyan color-forming couplers) and ultraviolet-absorbing polymers may also be used. Such ultraviolet absorbents may be mordanted in particular layers.

Aryl group-substituted benzotriazole compounds are most preferred.

Additionally, the following compounds are preferably employed together with the above-mentioned couplers. In particular, such compounds are especially preferably employed in combination with pyrazoloazole couplers.

Sepcifically, compounds (F) which may chemically bond with the aromatic amine developing agent as remaining after color development to give a chemically inactive and substantially colorless compound and/or compounds (G) which may chemically bond with the oxidation product of the aromatic amine developing agent as remaining after color development to give a chemically inactive and substantially colorless compound are preferably employed either simultaneously or singly. Employment of such compounds is preferred, for example, for preventing stains caused by formation of colored dyes by reaction between the developing agent or the oxidation product thereof which remains in the film and the coupler which also remains therein during storage of the material as processed. These compounds also prevent other harmful side-reactions.

As the compounds (F), preferred are compounds which react with p-anisidine with a secondary reaction speed constant k2 (in trioctyl phosphate at 80° C.) of from 1.0 liter/mol·sec to $1\times10^{-5}$ liter/mol·sec. The secondary reaction speed constant can be measured by the method described in JP-A-63-158545.

If the value k2 is larger than said range, the compounds would be unstable and would often react with gelatin and water and decompose. On the other hand, if it is smaller than this range, the reaction speed of the compound with the remaining aromatic amine developing agent would be low, and as a result, the object of the compounds (F) to prevent the harmful side effects of the remaining aromatic amine developing agent could not be attained.

More preferred examples of such compounds (F) are those represented by the following formula (FI) or (FII).

$$R_1-(A)_n-X \quad \text{(FI)}$$

$$R_2-\underset{\underset{B}{|}}{C}=Y \quad \text{(FII)}$$

In these formulae, $R_1$ and $R_2$ each represents an aliphatic group, an aromatic group or a heterocyclic group; n represents 1 or 0; A represents a group capable of reacting with an aromatic amine developing agent to form a chemical bond; X represents a group capable of reacting with an aromatic amine developing agent to split from the formula; B represents a hydrogen atom, an aliphatic group, an aromatic group, a heterocyclic group, an acyl group or a sulfonyl group; and Y represents a group of accelerating addition of an aromatic amine developing agent to the compound of formula (FII). $R_1$ and X, and Y and $R_2$ or B may be bonded to each other to form a cyclic structure.

Typical methods of reacting the compounds and the remaining aromatic amine developing agent by chemical bond are substitution reaction and addition reaction.

Specific examples of the compounds of formulae (FI) and (FII) ace described in JP-A-63-158545 and 62-283338 and European Patent Laid-Open Nos. 298,321 and 277,589 and are preferably employed in the present invention.

On the other hand, as compounds (G) which chemically bond with the oxidation product of the aromatic amine developing agent as remaining after color development to give a chemically inert and substantially colorless compound, more preferred are those represented by the following formula (GI):

$$\text{(GI)}\ R-Z$$

where R represents an aliphatic group, an aromatic group or a heterocyclic group; and Z represents a nucleophilic group or a group of releasing a nucleophilic group after decomposed in the photographic material. In the compounds of formula (GI), Z is preferably a group having a nucleophilic $^{n}CH_3I$ value (as described in R. G. Pearson, et al., *J. Am. Chem. Soc.*, 90, 319 (1968)) of 5 or more or a group derived therefrom.

Specific examples of the compounds of formula (GI) are described in European Patent Laid-Open No. 255,722, JP-A-62-143048 and JP-A-62-229145 and Japanese Patent Application Nos. 63-136724, 62-214681 and European Patent Laid-Open Nos. 298,321 and 277,589 and are preferably used in the present invention.

The details of the combination of the above-mentioned compounds (G) and compounds (F) are described in European Patent Laid-Open No. 277,589.

The photographic material of the present invention may contain an ultraviolet absorbent in the hydrophilic colloid layer. For instance, aryl group-substituted benzotriazole compounds (for example, those described in U.S. Pat. No. 3,533,794), 4-thiazolidone compounds (for example, those described in U.S. Pat. Nos. 3,314,794 and 3,352,681), benzophenone compounds (for example, those described in JP-A-46-2784), cinnamate compounds (for example, those described in U.S. Pat. Nos. 3,705,805 and 3,707,375), butadiene compounds (for example, those described in U.S. Patent 4,045,229), and benzoxazole compounds (for example, those described in U.S. Pat. No. 3,700,455) can be used as such an ultraviolet absorbent. Additionally, ultraviolet-absorbing couplers (for example, alpha-naphthol type cyan color-forming couplers) as well as ultraviolet-absorbing polymers may also be used. The ultraviolet absorbent can be mordanted in particular layers.

In the photographic material of the present invention, colloidal silver and dyes are incorporated for the purpose of anti-irradiation, anti-halation and especially for the purpose of separating the spectral sensitivity distribution of the respective light-sensitive layers and to insure safety in safelight having a wavelength range of visible rays. Such dyes include oxonole dyes, hemioxonole dyes, styryl dyes, merocyanine dyes, cyanine dyes and azo dyes. Above all, oxonole dyes, hemioxonole dyes and merocyanine dyes are useful for the purpose. Especially useful are indolenine dyes.

In particular, decolorable dyes as described in, for example, JP-A-62-3250, JP-A-62-181381, JP-A-62- 123454 and JP-A-63-197947 can be used for red-sensitive or infrared-sensitive layers. Also, dyes as described in JP-A-62-39682, JP-A-62-123192, JP-A- 62-158779 and JP-A-62-174741 as well as dyes to be prepared by introducing a water-soluble group into said dyes, which may be dissolved out from the photographic materials during processing, can be incorporated into the backing layer. The infrared dyes to be used in the present invention may be colorless ones which do not substantially have light absorption in the visible wavelength range.

When the infrared dyes to be used in the present invention are blended with a silver halide emulsion as color-sensitized in the red or infrared wavelength range, they cause some problems of desensitization, generation of fog or adsorption of the dyes of themselves to silver halide grains to cause weak and broad color sensitization. Accordingly, it is preferred that the dyes are substantially incorporated into any colloid layers other than light-sensitive layers. It is recommended that the dyes are incorporated into determined color layers under the condition that the dyes incorporated do not diffuse out. First, a ballast group is introduced into the dyes so as to make the dyes non-diffusive. In this case, however, the dyes often cause color retention and stain retention in the processed materials. Second, anionic dyes are mordanted along with a cation site-donating polymer or polymer latex. Third, dyes which are insoluble in water having a pH value of 7 or less and which may be decolored or dissolved out during the processing step are used in the form of a fine grain dispersion. For this, the dye is dissolved in a low boiling point organic solvent or solubilized in a surfactant and then dispersed in an aqueous solution of a hydrophilic colloid such as gelatin colloid. Preferably, a solid of the dye is kneaded with an aqueous surfactant-containing solution and mechanically milled with a mill into fine grains, and the resulting fine grains are dispersed in an aqueous solution of a hydrophilic colloid such as gelatin colloid.

As a binder or protective colloid which may be in the light-sensitive layers of the photographic material of the present invention, gelatin is advantageously used. Additionally, any other hydrophilic colloids may also be used singly or along with gelatin.

The gelatin to be used in the present invention for this purpose may be either lime-processed or acid-processed gelatin. The details of preparation of gelatin are described in Arther Vais, *The Macromolecular Chemistry of Gelatin* (published by Academic Press, 1964).

Various known photographic additives can be added to the color photographic material of the present invention. Especially preferably, substances which are generally used in commercial color papers containing high-silver chloride emulsions (having a grain average silver chloride content of 96 mol % or more) may be selected for use in the material of the invention. For instance, usable additives and materials are described in the *Research Disclosures* set forth below.

| Additives | RD 17643 | RD 18716 |
|---|---|---|
| 1. Chemical Sensitizer | p. 23 | p. 648, right column |
| 2. Sensitivity Enhancer | | p. 648, right column |
| 3. Spectral Sensitizer | pp. 23–24 | from p. 648, right column to p. 649, right column |
| 4. Super Color Sensitizer | " | from p. 648, right column to p. 649, right column |
| 5. Brightening Agent | p. 24 | from p. 648, right column to p. 649, right column |
| 6. Anti-foggant Stabilizer | pp. 24–25 | p. 649, right column |
| 7. Coupler | p. 25 | p. 649, right column |
| 8. Organic Solvent | p. 25 | p. 649, right column |
| 9. Light Absorbent Filter Dye | pp. 25–26 | from p. 649, right column to p. 650, left column |
| 10. UV Absorbent | " | from p. 649, right column to p. 650, left column |
| 11. Stain Inhibitor | p. 25, right-column | p. 6S0, from left to right column |
| 12. Color Image stabilizer | p. 25 | p. 6S0, from left to right column |
| 13. Hardener | p. 26 | p. 651, left column |
| 14. Hinder | p. 26 | p. 651, left column |
| 15. Plasticizer Lubricant | p. 27 | p. 650, right column |
| 16. Coating Assistant Surfactant | pp. 26–27 | p. 650, right column |
| 17. Anti-static Agent | p. 27 | p. 650, right column |

For photographically processing the photographic materials of the present invention, any known method and any known processing solution, for example, described in *Research Disclosure,* Item No. 17643, pages 28 to 30 (RD-17643) can be employed. The photographic processing may be any one having the step of forming a silver image during the procedure or directly forming the intended color image, provided that the process may finally produce the intended color image. The processing temperature is preferably within the range of from 18° C. to 50° C., but a temperature lower than 18° C. or higher than 50° C. may also be employed.

The color photographic processing method to be applied to the photographic material of the present invention is not specifically limited. For instance, as some examples, there are mentioned a system where the photographic material is exposed and then color-developed and bleach-fixed and thereafter optionally rinsed in water or stabilized; a system where the photographic material is exposed and then color-developed, bleached and fixed separately and thereafter optionally rinsed in water and stabilized; a system where the photographic material is exposed, developed with a developer containing a black-and-white developing agent, again uniformly exposed, color-developed and bleach-fixed in order and thereafter optionally rinsed in water or stabilized; and a system where the photographic material is exposed, developed with a developer containing a black-and-white developer, again developed with a color developer containing a fogging agent (such as sodium borohydride) and then bleach-fixed in order and thereafter optionally rinsed in water or stabilized.

The color developer for use in the present invention contains an aromatic primary amine color-developing agent. Any known compounds which are widely used in various color photographic processes can be utilized as the agent. Such developing agent typically includes aminophenol derivatives and p-phenylenediamine derivatives. Preferred are p-phenylenediamine derivatives among them, and specific examples of the derivatives are mentioned below, which, however, are not limitative.

Z-1: N,N-diethyl-p-phenylenediamine
Z-2: 2-Amino-5-diethylaminotoluene
Z-3: 2-Amino-5-(N-ethyl-N-laurylamino)toluene
Z-4: 4-[N-ethyl-N-(β-hydroxyethylamino]aniline
Z-5: 2-Methyl-4-[N-ethyl-N-(β -hydroxyethylamino]aniline
Z-6: N-ethyl-N-(β-methanesulfonamidoethyl)- 3-methyl-4-aminoaniline
Z-7: N-(2-amino- 5-diethylaminophenylethyl-)methanesulfonamide
Z-8: N,N-dimethyl-p-phenylenediamine
Z-9: 4-Amino-3-methyl-N-ethyl-N-methoxyethylaniline
Z-10: 4-Amino-3-methyl-N-ethyl-N-β -ethoxyethylaniline
Z-11: 4-Amino-3-methyl-N-ethyl-N-β -butoxyethylaniline These p-phenylenediamine derivatives may be in the form of salts such as sulfates, hydrochlorides, sulfites or p-toluenesulfonates. The above-mentioned compounds are described in U.S. Pat. Nos. 2,193,015, 2,552,241, 2,566,271, 2,592,364, 3,656,950 and 3,698,525. The amount of the said aromatic primary amine color-developing agent to be used for processing the photographic material of the present invention is approximately from 0.1 g to 20 more preferably approximately from 0.5 g to 10 per liter of the developer.

The color developer for use in the present invention can contain hydroxylamines.

Hydroxylamines can be used in the form of a free amine in the color developer, but they may also be used in the form of a water-soluble acid-addition salt. As examples of such salts, there are mentioned sulfates, oxalates, chlorides, phosphate, carbonates, acetates, etc. Hydroxylamines to be used for this purpose may be either substituted derivatives or unsubstituted ones. However, hydroxylamine derivatives where the nitrogen atom is substituted by alkyl group(s) (for example, N,N-diethylhydroxylamine) are especially preferably used for processing the photographic materials of the present invention which contain silver halide emulsions having a high silver chloride content.

The amount of the hydroxylamine to be added to the color developer is preferably 10 g or less, more preferably 5 g or less, per liter of the color developer. The amount of the hydroxylamine to be added to the color developer is preferably smaller, provided that the stability of the developer may be maintained.

Incorporation of a preservative, for example, a sulfite such as sodium sulfite, potassium sulfite, sodium bisulfite, potassium bisulfite, sodium metabisulfite or potassium metasulfite, or a carbonylsulfite adduct, into the developer is effective not only for improving the preservability of the developer but also for reducing color mixing by processing. The amount of the preservative to be added to the color developer is preferably 20 g or less, more preferably 5 g or less, per liter of developer. However, the content of the preservative in the color developer to be used for processing the high-silver chloride photographic material of the present invention is preferably smaller, provided that the stability of the developer may be maintained.

Other preservatives employable in the present invention are the aromatic polyhydroxy compounds described in JP-A-52-49828, JP-A-56-47038, JP-A-56-32140 and JP-A-59-160142 and U.S. Pat. No. 3,746,544; the hydroxyacetones described in U.S. Pat. No. 3,615,503 and British Patent 1,306,176; the α-aminocarbonyl compounds described in JP-A-52-143020 and 53-89425; various metal compounds described in JP-A-57-44148 and JP-A-57- 53749; various saccharides described in JP-A-52-102727; the hydroxamic acids described in JP-A-52-27638; the α,α'-dicarbonyl compounds described in JP-A-59-160141; the salicylic acids described in JP-A-59-180588; the alkanolamines described in JP-A-54-3532; the poly(alkyleneimines) described in JP-A-56-94349; the gluconic acid derivatives described in JP-A-56-75647; and the triethylenediamine derivatives described in JP-A-63- 239447. These preservatives may be used in combination of two or more. In particular, addition of 4,5-dihydroxy-m-benzenedisulfonic acid, poly(ethyleneimine), 1,4-diazabicyclo[2,2,2]octane and triethanolamine is preferred.

The color developer for use in the present invention preferably has a pH value of from 9 to 12, more preferably from 9 to 11. The color developer can contain various developer components of known compounds, in addition to the above-mentioned components.

In order to maintain the above-mentioned pH value range, various buffers are preferably added to the developer. As buffers usable for the purpose, there are mentioned, for example, carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyrates, 2-amino-2-methyl- 1,3-propanediol salts, valine salts, proline salts, trishydroxyaminomethane salts and lysine salts. In particular, carbonates, phosphates, tetraborates and hydroxybenzoates are preferred, as having a high solubility and an excellent buffering capacity in the pH range of 9.0 or higher. In addition, these buffers have further advantages in that they have no bad influence (e.g., fog) on the photographic processing capacity of the developer when they are added to the developer, and they are low-priced. Accordingly, these buffers are preferably employed.

As specific examples of these buffers, there are mentioned sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate) potassium o-hydroxybenzoate, sodium 5-sulfo-2-hydroxybenzoate (potassium 5-sulfosalicylate). However, these compounds are not limitative.

The amount of the buffer to be added to the color developer is preferably 0.1 mol/liter or more, especially preferably from 0.1 mol/liter to 0.4 mol/liter.

In addition, the color developer may further contain various chelating agents as an agent for preventing precipitation of calcium or magnesium or for the purpose of improving the stability of the color developer.

As such chelating agents, organic acid compounds are preferred. For instance, there are mentioned aminopolycarboxylic acids described in JP-B-48-030496 and JP-B-44-30232; organic phosphonic acids described in JP-A-56-97347, JP-A-56-39359 and West German Patent 2,227,639; phosphonocarboxylic acids described in JP-A- 52-102726, JP-A-53-42730, JP-A-54- 121127, JP-A-55-126241 and JP-A-55-65956; and compounds described in JP-A- 58-195845, JP-A-58-203440 and JP-B-53-40900. Specific examples of chelating agents which are employable in the present invention are mentioned below, which, however, are not limitative.

Nitrilotriacetic Acid
Diethyleneamino-pentaacetic Acid
Ethyelendiamine-tetraacetic Acid
Triethylenetetramine-hexaacetic Acid
N,N,N-trimethylenephosphonic Acid
Ethylenedimiane-N,N,N',N'-tetramethylenephosphonic Acid
1,3-Diamino-2-propanol-tetraacetic Acid
Transcyclohexanediamine-tetraacetic Acid
Nitrilotripropionic Acid
1,2-diaminopropane-tetraacetic Acid
Hydroxyethyliminodiacetic Acid
Glycoletherdiamine-tetraacetic Acid
Hydroxyethylenediamine-triacetic Acid
Ethylenediamine-orthohydroxyphenylacetic Acid
2-Phosphonobutane-1,2,4-tricarboxylic Acid
1-Hydroxyethane-1,1-diphosphonic Acid
N,N'-bis(2-hydroxybenzyl)ethylenediamine-N,N'-diacetic Acid These chelating agents can be used in combination of two or more of them, if desired. The amount of the chelating agent to be added to the color developer may be such that is sufficient for sequestering the metal ions in the color developer. For instance, the amount is approximately from 0.1 g/liter to 10 g/liter.

In addition to the above-mentioned compounds, the hydrazine derivatives described in JP-A-63-146041, JP-A-63-146042, JP-A-63-146043 and JP-A- 63-170642 (for instance, N,N-di(carboxymethyl)hydrazine) are especially preferably incorporated into the color developer for processing the high-silver chloride photographic materials of the present invention. Such compounds are effective not only for improving the preservability of the color developer but also for elevating the color forming capacity and for improving the stability of the photographic characteristics against variation of various conditions of the processing solutions used.

The color developer may optionally contain a development accelerator, if desired.

Benzyl alcohol is known as one typical color development-accelerator, and this can be incorporated into the processing solution for the photographic materials of the present invention. However, it is preferred that the processing solution for the photographic materials of the present invention does not substantially contain benzyl alcohol. Specifically, the content of benzyl alcohol in the color developer for use in the present invention is 2 cc/liter or less, preferably 0.5 cc/liter or less, and especially preferably, the color developer does not contain the same. Where the color developer not containing benzyl alcohol is used for processing the photographic materials of the present inventions, the effect of the present invention is even more remarkable.

As other development accelerators usable in the present invention, there are mentioned thioether compounds described in JP-B-37-16088, JP-B-37- 5987, JP-B-38-7826, JP-B-44-12380, JP-B- 45-9019 and U.S. Pat. No. 3,813,247; p-phenylenediamine compounds described in JP-A-52-49829 and JP-A-50-15554; quaternary ammonium salts described in JP-A-50-137726, JP-B-44-30074, JP-A-56-156826 and JP-A-52-43429; p-aminophenols described in U.S. Pat. Nos. 2,610,122 and 4,119,462; amine compounds described in U.S. Pat. Nos. 2,494,903, 3,128,182, 4,230,796 and 3,253,919, JP-B-41-11431, U.S. Pat. Nos. 2,482,546, 2,596,926 and 3,582,346; polyalkyleneoxides described in JP-B-37-16088 and 42-25201, U.S. Pat. No. 3,128,183, JP-B-41-11431 and JP-B- 42-23882 and U.S. Pat. No. 3,532,501; and other 1-phenyl- 3pyrazolidones, hydrazines, mesoionic compounds, thione compounds and imidazole compounds. These development accelerators can be added to the color developer, if desired. In particular, thioether compounds and 1-phenyl- 3-pyrazolidones are preferred.

The color developer for use in the present invention can contain any antifoggant, if desired. For instance, alkali metal halides such as potassium bromide, sodium bromide or potassium iodide as well as organic antifoggants can be used. Because the photographic materials of the present invention contain high-silver chloride emulsions, it is preferred that the content of such bromide ion in the processing solution is minimized in order that rapid processing of the materials is facilitated.

As organic antifoggants usable in the present invention, there are mentioned, for example, nitrogen containing heterocyclic compounds such as benzotriazole, 6-nitrobenzimidazole, 5-nitroisoindazole, 5-methylbenzotriazole, 5-nitrobenzotriazole, 5-chloro-benzotriazole, 2-thiazolylbenzimidazole, 2-thiazolylmethyl-benzimidazole and hydroxyazaindolidine; mercapto-substituted heterocyclic compounds such as 1-phenyl- 5-mercaptotetrazole, 2-mercaptobenzimidazole and 2-mercaptobenzothiaozle; adenine; and mercapto-substituted aromatic compounds such as thiosalicylic acid. The antifoggant may be incorporated into the silver halide color photographic materials of the present invention and dissolved out and transferred into the color developer during processing. However, the amount of the antifoggant to be transferred from the materials is preferably smaller, for the purpose of reducing the amount of waste drainage.

The color developer for use in the present invention can contain a brightening agent. For instance, 4,4'-diamino-2,2'-disulfostilbene compounds are preferred as the brightening agent. The amount of the agent to be added to the developer is 5 g/liter or less, preferably from 0.1 to 2 g/liter.

If desired, the developer may also contain various surfactants such as alkylphosphonic acids, arylphosphonic acids, aliphatic carboxylic acids and aromatic carboxylic acids.

The processing temperature when employing the color developer is preferably from 30° to 50° C., more preferably from 33° to 42° C. The amount of replenisher during processing is from 30 to 1500 cc/m$^2$, preferably from 30 to 600 cc/m$^2$, more preferably from 30 to 300 cc/m$^2$. For the purpose of reducing the amount of waste drainage from the process, the amount of the replenisher is preferably small.

The bleaching solution or bleach-fixing solution which is used for processing the photographic materials of the present invention contain a bleaching agent, which is generally a ferric complex. As the ferric complex, a complex composed of a ferric ion and a chelating agent such as aminopolycarboxylic acids, aminopolyphosphonic acids or salts thereof is preferred. As salts of aminopolycarboxylic acids or aminopolyphosphonic acids, salts of aminopolycarboxylic acids or aminopolyphosphonic acids and alkali metal salts, ammonium or water-soluble amines are preferred. The alkali metals include sodium, potassium and lithium; and the water-soluble amines include alkylamines such as methylamine, diethylamine, triethylamine and butylamine, alicyclic amines such as cyclohexylamine, arylamines such as aniline and m-toluidine, and heterocyclic amines such as pyridine, morpholine and piperidine.

Specific examples of the chelating agents of aminopolycarboxylic acids and aminopolyphosphonic acids and salts thereof are mentioned below, which, however, are not limitative.

Ethylenediamine-tetraacetic Acid
Disodium Ethylenediaminetetraacetate
Diammonium Ethylenediaminetetraacetate
Tetra(trimethylammonium) Ethylenediaminetetraacetate
Tetrapotassium Ethylenediaminetetraacetate
Tetrasodium Ethylenediaminetetraacetate
Trisodium Ethylenediaminetetraacetate
Diethylenetriamine-pentaacetic Acid
Pentasodium Diethylenetriamine-pentaacetate
Ethylenediamine-N-(β-hydroxyethyl)-N,N',N'-triacetic Acid
Trisodium Ethylenediamine-N-(β-hydroxyethyl)-N,N',N'-Triacetate
Triammonium Ethylenediamine-N-(β-hydroxyethyl)-N,N',N'-Triacetate
Propylenediaminetetraacetic Acid
Disodium Propylenediamine-tetraacetate
Nitrilotricetic Acid
Trisodium Nitrilotriacetate
Cyclohexanediamine-tetraacetic Acid
Disodium Cyclohexanediaminetetraacetate
Iminodiacetic Acid
Dihydroxyethylglycine
Ethylether-diaminetetraacetic Acid
Glycolether-diminetetraacetic Acid
Ethylenediamine-tetrapropionic Acid
Phenylenediaminetetraacetic Acid
1,3-Diaminopropanol-N,N,N',N'-tetramethylenephosphonic Acid
Ethylenediamine-N,N,N',N'-tetramethylenephosphonic Acid
1,3-Propylenediamine-N,N,N',N'-tetramethylenephosphonic Acid The ferric complex may directly be added to the solution as the complex itself; or alternatively, a ferric salt such as ferric sulfate, ferric chloride, ferric nitrate, ammonium ferric sulfate or ferric phosphate may be added to the solution together with a chelating agent such as an aminopolycarboxylic acid, aminopolyphosphonic acid or phosphonocarboxylic acid and the ferric complex may be formed in the solution. When adding the ferric complex to the solution, one complex only or two or more complexes in combination may be added thereto. On the other hand, in the latter case where the complex is formed from a ferric salt and a chelating agent in the solution, one or more ferric salts may be employed. Also one or more chelating agents may be employed. In either case, the amount of chelating agent may be more than the necessary amount for forming the intended ferric complex. Among ferric complexes, aminopolycarboxylato/ferric complexes are preferred, and the amount thereof to be added to the solution is form 0.01 to 1.0 mol/liter, more preferably from 0.05 to 0.50 mol/liter.

The bleaching solution or bleach-fixing solution may contain a bleaching accelerator, if desired. As specific examples of bleaching accelerators usable in the present invention, there are mentioned mercapto group- or disulfido group-containing compounds described in U.S. Pat. No. 3,893,858, West German Patents 1,290,812 and 2,059,988, JP-A-53-32736, JP-A-53- 57831, JP-A-53- 37418, JP-A-53-65732, JP-A-53-72623, JP-A-53-95630, JP-A-53-95631, JP-104232, JP-A-53-124424, JP-A-53-141623 and JP-A-53-28426 and *Research Disclosure,* Item No. 17129 (July, 1978); thiazolidine derivatives described in JP-A-50-140129; thiourea derivatives described in JP-B-45-8506, and JP-A-52-20832 and JP-A- 53-32735, and U.S. Pat. No. 3,706,561; iodides described in West German Patent 1,127,715 and JP-A-58-16235; polyethylene oxides described in West German Patents 966,410 and 2,748,430; polyamines described in JP-B-45-8836; compounds described in JP-A-49-42434, JP-A-49-59644, JP-A-53- 94927, JP-A-54-35727, JP-A-55-26506 and JP-A-58-163940; and iodide and bromide ions. Among them, mercapto group- or disulfido group-containing compounds are preferred, as having a large accelerating effect. In particular, the compounds described in U.S. Pat. No. 3,893,858, West German Patent 1,290,812 and JP-A- 53-95630 are preferred.

In addition, the bleaching solution or bleach-fixing solution for use in the present invention preferably contains a re-halogenating agent such as iodides (e.g., potassium bromide, sodium bromide, ammonium bromide), chlorides (e.g., potassium chloride, sodium chloride, ammonium chloride) or iodides (e.g., ammonium iodide). If desired, the solution may further contain one or more inorganic acids or organic acids or alkali metal or ammonium salts thereof which have a pH-buffering capacity, such as boric acid, borax, sodium metaborate, acetic acid, sodium acetate, sodium carbonate, potassium carbonate, phosphorous acid, phosphoric acid, sodium phosphate, citric acid, sodium citrate or tartaric acid, as well as an antiseptic such as ammonium nitrate or guanidine.

A known fixing agent can be employed in the bleach-fixing solution or fixing solution for use in the present invention. As the agent, one or more water-soluble silver halide solubilizers can be used, which include, for example, thiosulfates such as sodium thiosulfate or ammonium thiosulfate; thiocyanates such as sodium thiocyanate or ammonium thiocyanate; thioether compounds such as ethylenebisthioglycolic acid or 3,6-dithia-1,8-octanediol; and thioureas. A particular bleach-fixing solution containing the fixing agent described in JP-A-55-155354 together with a large amount of a halide such as potassium iodide can also be used. In the present invention, thiosulfates, especially ammonium thiosulfate, are preferably used.

The amount of the bleaching agent in the solution is preferably from 0.3 to 2 mol/liter, more preferably from 0.5 to 1.0 mol/liter.

The pH range of the bleach-fixing solution or fixing solution for use in the present invention is preferably from 3 to 10, more preferably from 4 to 9. If the pH value of the solution is lower than the said range, the preservability of the solution is deteriorated and leucoation of the cyan dye during processing is accelerated, although the desilvering capacity is improved. On the other hand, if the pH value is higher than the said range, the desilvering would be retarded causing an increase in stains in the processed materials.

In order to adjust the pH value of the solution, hydrochloric acid, sulfuric acid, nitric acid, acetic acid (glacial acetic acid), bicarbonates, ammonia, potassium hydroxide, sodium hydroxide, sodium carbonate or potassium carbonate can be added to the solution, if desired.

The bleach-fixing solution may further contain other various brightening agents, defoaming agents or surfactants as well as organic solvents such as polyvinyl pyrrolidone or methanol.

The bleach-fixing solution or fixing solution for use in the present invention contains, as a preservative, a sulfite ion-releasing compound such as sulfites (e.g., sodium sulfite, potassium sulfite, ammonium sulfite), bisulfites (e.g., ammonium bisulfite, sodium bisulfite, potassium bisulfite), metabisulfites (e.g., potassium metabisulfite, sodium metabisulfite, ammonium metabisulfite). The compound is preferably incorporated into the solution in an amount of approximately from 0.02 to 0.50 mol/liter, more preferably approximately from 0.04 to 0.40 mol/liter, as the sulfite ion.

As the preservative, in addition to the sulfites mentioned above, ascorbic acid, carbonyl-sulfite adducts or carbonyl compounds may also be added to the solution.

In addition, the solution may further contain a buffer, a brightening agent, a chelating agent and a fungicide, if desired.

Next, the rinsing step to be effected for processing the photographic materials of the present invention will be mentioned. In the present invention, a simplified processing method where only a "stabilization" with no substantial rinsing-in-water step is effected may be employed in place of the ordinary "rinsing-in-water" processing method. Accordingly, the "rinsing step" as referred to herein indicates the broad meaning as mentioned above.

The amount of water to be used in the rinsing step in accordance with the present invention varies, depending upon the number of the baths for multi-stage countercurrent rinsing procedure and the amount of the carry-over of the processing solution from the previous bath together with the material being processed, and therefore, the specific amount of water is difficult to define. However, in the process of the present invention, the concentration of the components of the previous bath having a bleach-fixing capacity as carried over to the final rinsing bath is preferably $5\times10^{-2}$ mol/liter or less, more preferably $2\times10^{-2}$ mol/liter or less. For instance, in the case of three-tank countercurrent rinsing, the amount of the water to be used is preferably approximately 1000 cc or more per $m^2$ of the photographic material being processed. In the case of an economized process, the amount of the water may be preferably 1000 cc or less per $m^2$ of the material.

The temperature of the rinsing solution is from 15° C. to 45° C., preferably from 20° C. to 40° C.

In the rinsing step, various known compounds may be added to the rinsing solution for the purpose of preventing precipitation or of stabilizing the rinsing solution. For instance, chelating agents such as inorganic phosphoric acids, aminopolycarboxylic acids or organic phosphonic acids; bactericides or fungicides for preventing propagation of various bacteria, algae and fungi, such as compounds described in *Journal of Antibacterial and Antifungal Agents,* Vol. 11, No. 5, pages 207 to 223 (1983) and compounds described in H. Horiguchi, *Antibacterial and Antifungal Chemistry;* metal salts such as magnesium salts or aluminium salts; alkali metal and ammonium salts; and surfactants for preventing drying load or unevenness may be added to the rinsing solution, if desired. In addition, the compounds described in West, *Photographic Science and Engineering,* Vol. 6, pages 344 to 359 (1965) may also be added.

The method illustrated in JP-A-62-288838 where a rinsing water containing reduced amounts of calcium and magnesium is used is especially preferably employed in the present invention.

Addition of a chelating agent, a bactericide and/or a fungicide to the rinsing solution in the multi-stage countercurrent rinsing step having two or more rinsing tanks for the purpose of noticeably reducing the amount of the rinsing water to be used in the step is especially effective in performing the present invention. In addition, the multi-stage countercurrent stabilization step (so-called stabilization step) described in JP-A-57-8543 is also especially effective for the present invention, in place of the ordinary rinsing step. In this case, the bleach-fixing component in the final bath may be $5\times10^{-2}$ mol/liter or less, preferably $1\times10^{-2}$ mol/liter or less.

Various compounds are added to the stabilization bath for the purpose of stabilizing the image formed in the photographic material processed. For instance, various buffers for the purpose of adjusting the film pH (for example, within the pH range of from 3 to 8) may be employed as a combination of borates, metaborates, borax, phosphate, carbonates, potassium hydroxide, sodium hydroxide, aqueous ammonia, monocarboxylic acids, dicarboxylic acids and polycarboxylic acids. In addition, aldehydes such as formalin may also be used for the purpose. Further, other various additives, such as chelating agents (e.g., inorganic phosphoric acids, aminopolycarboxylic acids, organic phosphonic acids, aminopolyphosphonic acids, phosphonocarboxylic acids), bactericides (e.g., thiazoles, isothiazoles, halogenated phenols, sulfanylamides, benzotriazoles), surfactants, brightening agents and hardening agents may also be added. Two or more compounds having the same or different purposes may be employed in combination.

As the film pH-adjusting agent for the photographic materials processed, various ammonium salts such as ammonium chloride, ammonium nitrate, ammonium sulfate, ammonium phosphate, ammonium sulfite or ammonium thiosulfate are preferably added, for the purpose of improving the image storability.

Where the amount of the rinsing solution is noticeably reduced as mentioned above, it is preferred that a part or all of the over-flow solution from the rinsing tank is recirculated back to the previous bleach-fixing bath or fixing bath for the purpose of reducing the amount of the waste drainage.

In the continuous processing procedure to be applied to the photographic materials of the present invention, replenishers for the processing solutions are preferably added to the respective steps for the purpose of inhibiting fluctuation of the composition of the processing solution and of thereby obtaining constantly finished products. The amount of the replenisher is preferably as small as possible for the purpose of reducing the processing cost, provided that the finished product may have a favorable photographic property by properly controlling the processing conditions such as the composition of the processing solution, the temperature thereof, the processing time and the stirring means.

The processing baths preferably contain a heater, a temperature sensor, a liquid level sensor, a circulating pump, a filter, various floating lids, various squeegees, a nitrogen stirrer and an air stirrer, if desired.

The silver halide photographic materials of the present invention preferably have auxiliary layers such as protective layer, interlayer, anti-halation layer, filter layer and backing layer, if desired, in addition to the silver halide emulsion layers.

As a layer constitution for ordinary color photographic materials, it is preferred that a protective layer constitution is superposed over the outermost emulsion layer and the protective layer constitution is composed of an upper protective layer containing a mat agent having a suitable grain size, a slide agent and a dispersion of a polyvinyl alcohol polymer or copolymer or a high boiling point organic solvent for the purpose of adjusting the physical and mechanical characteristics of the coated film and a lower protective layer containing an ultraviolet absorbent (especially, 2-( 2'-hydroxyphenyl)benzotriazoles), a mordant agent and the same polymer or high boiling point organic solvent as in the upper protective layer.

The silver halide emulsion-containing layer constitution for constituting the photographic materials of the present invention is composed of one layer, two layers or more plural layers. Two or more silver halide emulsions of the present invention may be blended to form the emulsion layer constitution, or the silver halide emulsions of the present invention may be blended with other silver halide emulsions. The emulsion layer constitution may be composed of two or more layers each having a different color sensitivity or a different sensitivity degree, and the order of laminating the constitutional layers may be selected freely.

An interlayer may be provided between two emulsion layers each having a different color sensitivity, and a color mixing preventing agent is preferably added to the interlayer. As the color mixing preventing agent to be employed for this purpose, there are various reducing agents such as hydroquinones. Of these alkylhydroquinones are most typical, and are described in U.S. Pat. Nos. 2,360,290, 2,419, 613, 2,728,659, 2,732,300, 3,960,570 and 3,700,453.

Suitable supports on which the above-mentioned emulsion layers and auxiliary layers are coated for preparing the photographic materials of the present invention are, for example, baryta paper, resin-coated paper, triacetate film polyethylene terephthalate film, vinyl chloride film and other plastic films, as well as synthetic papers made of the said polymers or polypropylene, and glass sheet, metal plate and metal laminate base.

The following examples are intended to illustrate the present invention in more detail but not to restrict it in any way.

Unless otherwise indicated herein, all parts, percents, ratios and the like are by weight.

EXAMPLE 1

A silver halide color photographic material having plural layers mentioned below was prepared, which was called Sample (A).

Silver halide emulsions used for preparing the layers of the sample were formed as described below.

Preparation of Emulsion (A1) for Cyan Coupler-Containing Layer:

8 g of lime-processed gelatin were added to 1000 ml of distilled water and dissolved at 40° C., and the resulting solution was adjusted with sulfuric acid to have pH of 3.8. Then, 2.2 g of sodium chloride was added thereto, and the temperature of the solution was elevated up to 52.5° C. A solution of 62.5 g of silver nitrate as dissolved in 750 ml of distilled water and a solution of 21.5 g of sodium chloride as dissolved in 500 ml of distilled water were added to and blended with the previously prepared solution at 52.5° C. over a period of 40 minutes. Further, a solution of 62.5 g of silver nitrate as dissolved in 500 ml of distilled water and a solution of 21.5 g of sodium chloride as dissolved in 300 ml of distilled water were added to and blended with the solution at a temperature of 52.5° C. over a period of 20 minutes, whereupon $1\times10^{-8}$ mol/mol(Ag) to the total silver halide amount of dipotassium iridium hexachloride and $1.5\times10^{-5}$ mol/mol(Ag) to the total silver halide amount of potassium hexacyano/Fe(II) were added thereto.

The emulsion thus obtained was observed with an electronic microscope, and was found to be a silver halide emulsion containing 39% by weight of twin-containing silver halide grains having a twin plane of (111) as surrounded by (100) planes, along with cubic grains having a mean side length of about 0.46 micron, and having a fluctuation coefficient of grain size distribution of 0.13.

The emulsion was desalted and washed with water, and then 0.2 g of nucleic acid and 1.0 mol % as silver halide of a monodispersed silver bromide emulsion having a mean grain size of 0.05 micron (containing $1.2\times10^{-4}$ mol/mol(Ag) of dipotassium iridium hexachloride) were added thereto, whereupon the emulsion was chemically sensitized with $2\times10^{-6}$ mol/mol(Ag) of triethylthiourea. Additionally, $5\times10^{-6}$ mol/mol(Ag) of Compound (V- 23), $1\times10^{-3}$ mol/mol(Ag) of Compound (I-1) and $1.8\times10^{-3}$ mol/mol(Ag) of Compound (F-1) were added to the emulsion. It was observed that the twin grains in the resulting emulsion had projected silver bromide localized phases essentially at the three corner parts of the twin plane.

Preparation of Emulsion (A2) for Magenta Coupler-Containing Layer:

8 g of lime-processed gelatin were added to 1000 ml of distilled water and dissolved at 40° C., and the temperature of the resulting solution was elevated to 50° C. Then, a solution of 62.5 g of silver nitrate as dissolved in 750 ml of distilled water and a solution of 21.5 g of sodium chloride as dissolved in 500 ml of distilled water were added to and blended with the previously prepared solution at 50° C. over a period of 40 minutes. Further, a solution of 62.5 g of silver nitrate as dissolved in 500 ml of distilled water and a solution of 21.5 g of sodium chloride as dissolved in 300 ml of distilled water were added to and dissolved with it also at 50° C. over a period of 20 minutes.

Along with the latter addition, $1.2\times10^{-8}$ mol/mol(Ag) to the total silver halide amount of dipotassium iridium hexachloride and $1.8\times10^{-5}$ mol/mol(Ag) to the total silver halide amount of potassium hexacyano/Fe(II) were added to the reaction system.

The emulsion thus obtained was observed with an electronic microscope, and was found to be a silver halide emulsion containing 42% by weight of twin-containing silver halide grains having a twin plane of (111) as surrounded by (100) planes, along with cubic grains having a mean side length of about 0.44 micron, and having a fluctuation coefficient of grain size distribution of 0.14.

The emulsion was desalted and washed with water, and then 0.2 g of nucleic acid and 0.5 mol % as silver halide of a monodispersed silver bromide emulsion having a mean grain size of 0.05 micron (containing $1.5\times10^{-4}$ mol/mol(Ag) of dipotassium iridium hexachloride) were added thereto, whereupon the emulsion was chemically sensitized with $2.4\times10^{-6}$ mol/mol(Ag) of triethylthiourea. Additionally, $1\times10^{-5}$ mol/mol(Ag) of Compound (V- 47), $0.6\times10^{-3}$ mol/mol(Ag) of Compound (I-1) and $0.9\times10^{-3}$ mol/mol(Ag) of Compound (F-1) were added to the emulsion. It was observed that the twin grains in the resulting emulsion had projected silver bromide localized phases essentially at the three corner parts of the twin plane.

Preparation of Emulsion (A3) for Yellow Coupler-Containing Layer:

An emulsion was prepared in the same manner as in the method of preparing the above-mentioned emulsion for magenta coupler-containing layer, except that $0.6\times10^{-4}$ mol/mol(Ag) of Compound (V-40) and $0.6\times10^{-4}$ mol/mol(Ag) of Compound (V-41) were added in place of Compound (V-46) and that Compound (F-1) was not added.

For comparison, Sample (B) was prepared in the same manner as above, except that silver halide emulsions (B1) to (B3) as prepared in the same manner as above with addition of no monodispersed silver bromide emulsion were used. Further, Sample (C) was also prepared in the same manner as above, except that silver halide emulsions (C1) to (C3), which had been prepared by a conventional method and which contained 96% by weight of cubic silver chloride grains having the same grain size as the above-mentioned emulsions, were used. Sample (D) was also prepared in the same manner as in preparation of Sample (C) except that emulsions (D1) to (D3) which corresponded to emulsions (C1) to (C3), respectively, and which had a localized phase were used. In the emulsions (D1) to (D-3), the localized phase was formed on the corner parts of the cubic grains.

To Samples (A) to (D) were added Compounds (D- 1), (D-2), (D-3), (D-4), (D-5) and (D- 6) in amounts of 0.120 g/m$^2$, 0.036 g/m$^2$, 0.008 g/m$^2$, 0.013 g/m$^2$, 0.018 g/m$^2$ and 0.022 g/m$^2$, respectively, for the purpose of improving the safety to safelight and to improve the sharpness of the image to be formed.

Additionally, the following three compounds were added to each sample as a gelatin-hardening agent, in a molar ratio of 3/2/1.

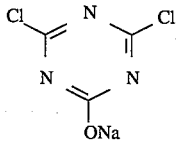

$CH_2NHCOCH_2SO_2CH{=}CH_2$
|
$CH_2NHCOCH_2SO_2CH{=}CH_2$ $OCH_2SO_2CH{=}CH_2$
|
$CH_2SO_2CH{=}CH_2$

Each of the thus prepared Samples (A) to (D) was wedgewise exposed with a light as wedgewise and electrically modulated by the use of three laser diodes each having an emitting wavelength of 670 nm, 750 nm and 810 nm, by scanning exposure for a mean exposure time for one pixture element (pixel) of $2\times10^{-7}$ second at 400 dpi. Then, the thus exposed samples were directly processed in accordance with the following color development process (1).

Layer constitution of Samples (A) to (D) was as follows:

| Support: $TiO_2$ (5 g/m$^2$)-containing Polyethylene Laminate Paper | |
|---|---|
| First Layer: Black Anti-Halation Layer | |
| Black Colloidal Silver | 0.08 g/m$^2$ as Ag |
| Gelatin | 1.32 g/m$^2$ |
| Ultraviolet Absorbent (X-1) | 0.02 g/m$^2$ |
| Ultraviolet Absorbent (X-2) | 0.09 g/m$^2$ |
| Ultraviolet Absorbent (X-3) | 0.10 g/m$^2$ |

-continued

| Support: $TiO_2$ (5 g/m$^2$)-containing Polyethylene Laminate Paper | |
|---|---|
| Color Mixing Preventing Agent (H-1) | 0.02 g/m$^2$ |
| Solvent (S-5) | 0.11 g/m$^2$ |
| Second Layer: Interlayer | |
| Gelatin | 1.00 g/m$^2$ |
| Color Mixing Preventing Agent (H-1) | 0.09 g/m$^2$ |
| Solvent (S-3) | 0.18 g/m$^2$ |
| Solvent (S-4) | 0.18 g/m$^2$ |
| Third Layer: Yellow Coupler-Containing Layer | |
| Emulsion (A3) | 0.30 g/m$^2$ as Ag |
| Gelatin | 1.44 g/m$^2$ |
| Polymer (P-1) | 0.18 g/m$^2$ |
| Yellow Coupler (Y-4) | 0.16 g/m$^2$ |
| Yellow Coupler (Y-6) | 0.20 g/m$^2$ |
| Yellow Coupler (Y-1) | 0.39 g/m$^2$ |
| Color Image Stabilizer (H-4) | 0.01 g/m$^2$ |
| Solvent (S-2) | 0.17 g/m$^2$ |
| Solvent (S-6) | 0.16 g/m$^2$ |
| Fourth Layer: Color Mixing Preventing Layer | |
| Gelatin | 1.30 g/m$^2$ |
| Color Mixing Preventing Agent (H-1) | 0.12 g/m$^2$ |
| Solvent (S-3) | 0.24 g/m$^2$ |
| Solvent (S-4) | 0.24 g/m$^2$ |
| Fifth Layer: Magenta Coupler-Containing Layer | |
| Emulsion (A2) | 0.13 g/m$^2$ as Ag |
| Gelatin | 1.36 g/m$^2$ |
| Magenta Coupler (M-13) | 0.19 g/m$^2$ |
| Magenta Coupler (M-15) | 0.07 g/m$^2$ |
| Color Image Stabilizer (E-1) | 0.09 g/m$^2$ |
| Color Image Stabilizer (A-1) | 0.07 g/m$^2$ |
| Color Image Stabilizer (B-1) | 0.03 g/m$^2$ |
| Color Image Stabilizer (H-3) | 0.01 g/m$^2$ |
| Color Image Stabilizer (H-6) | 0.02 g/m$^2$ |
| Solvent (S-1) | 0.37 g/m$^2$ |
| Solvent (S-3) | 0.19 g/m$^2$ |
| Sixth Layer: Ultraviolet Absorbing Layer | |
| Gelatin | 1.12 g/m$^2$ |
| Ultraviolet Absorbent (X-1) | 0.04 g/m$^2$ |
| Ultraviolet Absorbent (X-2) | 0.19 g/m$^2$ |
| Ultraviolet Absorbent (X-3) | 0.20 g/m$^2$ |
| Color Mixing Preventing Agent (H-1) | 0.04 g/m$^2$ |
| Solvent (S-5) | 0.18 g/m$^2$ |
| Seventh Layer: Cyan Coupler-Containing Layer | |
| Emulsion (A1) | 0.24 g/m$^2$ as Ag |
| Gelatin | 1.16 g/m$^2$ |
| Polynmer (P-1) | 0.42 g/m$^2$ |
| Cyan Coupler (C-2) | 0.07 g/m$^2$ |
| Cyan Coupler (C-5) | 0.12 g/m$^2$ |
| Cyan Coupler (C-4) | 0.09 g/m$^2$ |
| Cyan Coupler (C-3) | 0.07 g/m$^2$ |
| Color Image Stabilizer (X-1) | 0.04 g/m$^2$ |
| Color Image Stabilizer (X-2) | 0.05 g/m$^2$ |
| Color Image Stabilizer (X-4) | 0.05 g/m$^2$ |
| Color Image Stabilizer (A-1) | 0.01 g/m$^2$ |
| Color Image Stabilizer (B-1) | 0.01 g/m$^2$ |
| Color Image Stabilizer (H-4) | 0.01 g/m$^2$ |
| Color Image Stabilizer (H-2) | 0.04 g/m$^2$ |
| Solvent (S-6) | 0.11 g/m$^2$ |
| Solvent (S-7) | 0.11 g/m$^2$ |
| Eighth Layer: Ultraviolet Absorbing Layer | |
| Gelatin | 0.65 g/m$^2$ |
| Ultraviolet Absorbent (X-1) | 0.02 g/m$^2$ |
| Ultraviolet Absorbent (X-2) | 0.09 g/m$^2$ |
| Ultraviolet Absorbent (X-3) | 0.10 g/m$^2$ |
| Color Mixing Preventing Agent (H-1) | 0.02 g/m$^2$ |
| Solvent (S-5) | 0.11 g/m$^2$ |

-continued
| Support: $TiO_2$ (5 g/m$^2$)-containing Polyethylene Laminate Paper | |
|---|---|
| Ninth Layer: Protective Layer | |
| Gelatin | 1.00 g/m$^2$ |
| Acryl-Modified Polyvinyl Alcohol Polymer (modification degree: 17%) | 0.12 g/m$^2$ |
-continued
| Support: $TiO_2$ (5 g/m$^2$)-containing Polyethylene Laminate Paper | |
|---|---|
| Liquid Paraffin | 0.05 g/m$^2$ |
The compounds used above were as follows:
(D-1)
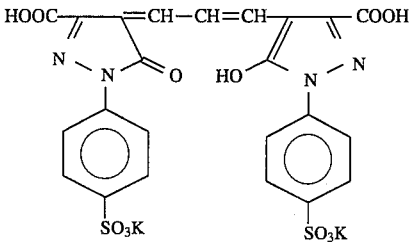
(D-2)
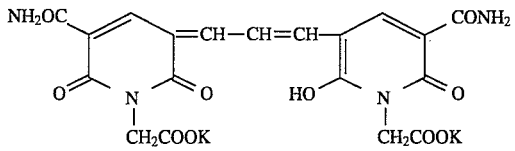
(D-3)
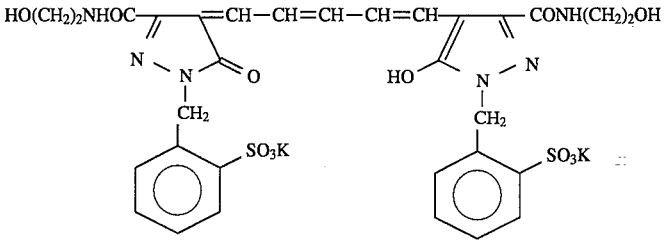
(D-4)
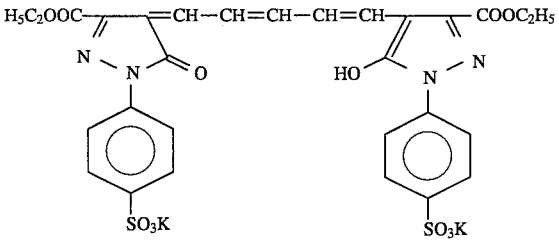
(D-5)
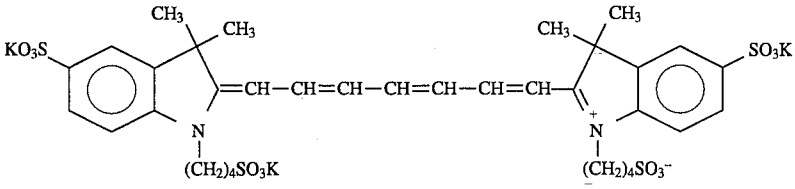
(D-6)
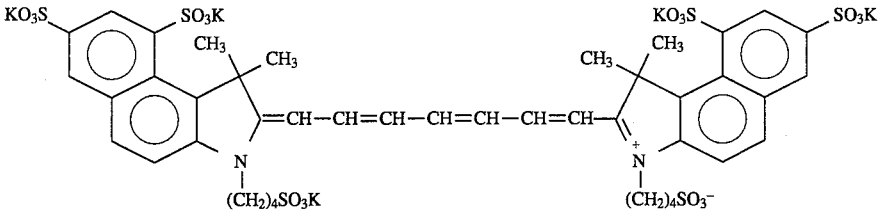
(I-1)
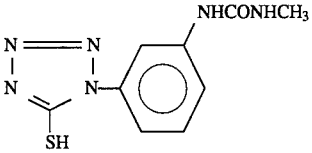

-continued
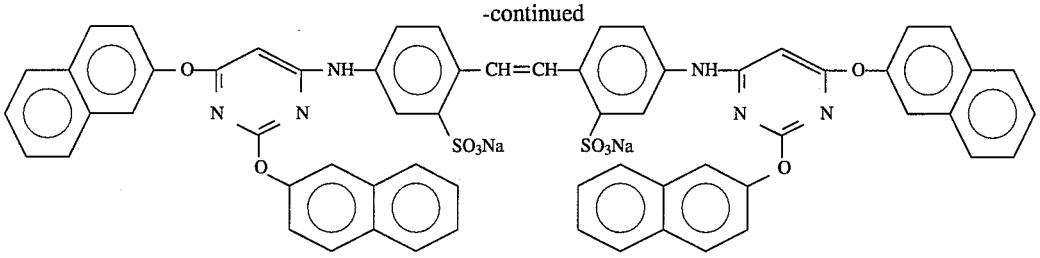
(F-1)
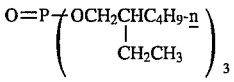
(S-1)
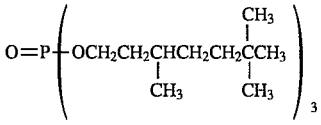
(S-2)
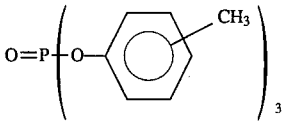
(S-3)
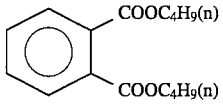
(S-4)
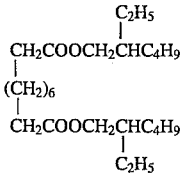
(S-5)
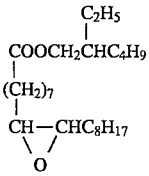
(S-6)
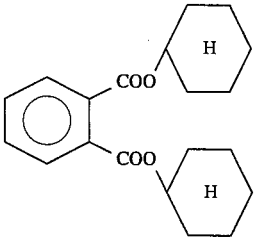
(S-7)
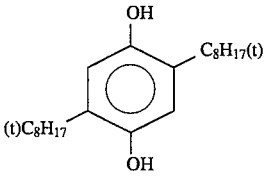
(H-1)
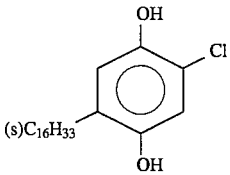
(H-2)
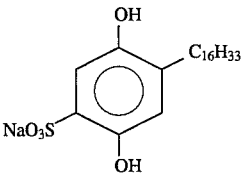
(H-3)
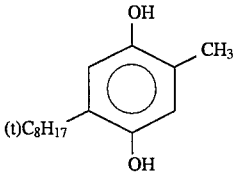
(H-4)
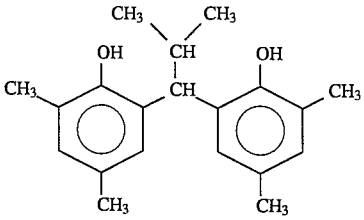
(H-6)
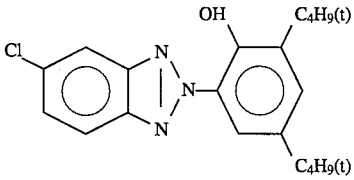
(X-1)
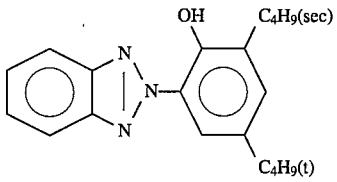
(X-2)

-continued (X-3)

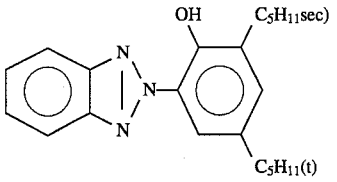

(X-4)

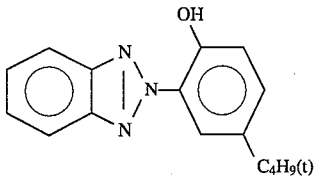

(A-1)

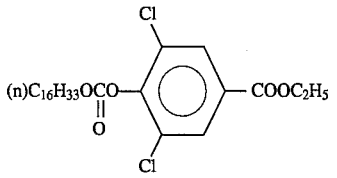

(B-1)

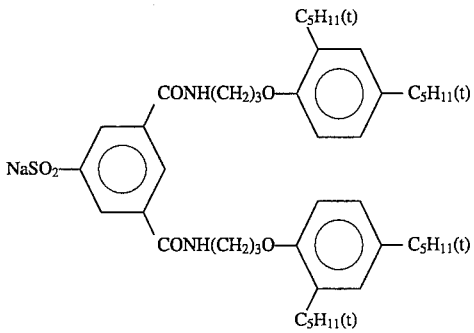

(P-1)

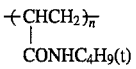

(molecular weight: 60,000)

(E-1)

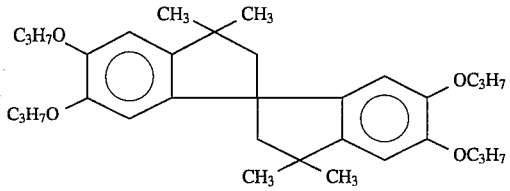

Color development process (1) comprised the following steps.

| Processing Step | Temperature | Time |
|---|---|---|
| Color Development | 50° C. | 9 seconds |
| Bleach-Fixation | 50° C. | 12 seconds |
| Rinsing (1) | 40° C. | 5 seconds |
| Rinsing (2) | 40° C. | 5 seconds |
| Rinsing (3) | 40° C. | 5 seconds |
| Drying | 90° C. | 9 seconds |

Processing solutions used in the above-mentioned steps were as follows.

| Color Developer: | |
|---|---|
| Ethylenediamine-N,N,N',N'-tetra-methylenephosphonic Acid | 3.0 g |
| N,N-di(carboxymethyl)hydrazine | 4.5 g |
| N,N-diethylhydroxylamine Oxalate | 2.0 g |
| Triethanolamine | 8.5 g |
| Sodium Sulfite | 0.14 g |
| Potassium Chloride | 1.6 g |
| Potassium Bromide | 0.01 g |
| Potassium Carbonate | 25.0 g |
| N-ethyl-N-(β-methanesulfonamidoethyl)-3-methyl-4-aminoaniline Sulfate | 5.0 g |
| WHITEX-4 (stilbene-type brightening agent, manufactured by Sumitomo Chemical) | 1.4 g |
| Water to make | 1000 ml |
| pH | 10.05 |
| **Bleach-Fixing Solution:** | |
| Ammonium Thiosulfate (55 wt % aq. soln.) | 100 ml |
| Sodium Sulfite | 17.0 g |
| Ammonium Ethylenediaminetetra-acetato/Fe(III) | 55.0 g |
| Disodium Ethylenediaminetetraacetate | 5.0 g |

-continued

| | |
|---|---|
| Ammonium Bromide | 40.0 g |
| Glacial Acetic Acid | 9.0 g |
| Water to make | 1000 ml |
| pH | 5.80 |
| **Rinsing Solution:** | |
| Ion-Exchanged Water (having calcium ion concentration of 3 ppm or less and magnesium ion concentration of 2 ppm or less). | |

Each of the cyan density, magenta density and yellow density of each of the thus processed samples was measured with a TCD Densitometer (manufactured by Fuji Photo Film Co.), and the sensitivity values obtained are shown in Table 1 below. The sensitivity is a relative value based on the sensitivity of each color layer, Sample (D) being 100.

TABLE 1

| Sample | Cyan Sensitivity | Magenta Sensitivity | Yellow Sensitivity | Remarks |
|---|---|---|---|---|
| A | 144 | 141 | 135 | Invention |
| B | 29 | 30 | 32 | Comp. Sample |
| C | 23 | 26 | 29 | Comp. Sample |
| D | 100 | 100 | 100 | Comp. Sample |

As is obvious from the results in Table 1 above, Sample (A) of the present invention has a higher sensitivity than any of the Comparative Samples (B) to (D). Comparing the increase of the sensitivity of Sample (D) containing silver bromide-localized phase-having emulsions over that of Sample (C) containing silver bromide-localized phase-free emulsions and the increase of the sensitivity of Sample (A) of the present invention containing silver bromide-localized phase-having emulsions over that of Sample (B) having silver bromide-localized phase-free twin-containing silver chloride emulsions, the effect of the present invention of elevating the sensitivity of the twin-containing high-silver chloride emulsion-containing photographic material is well demonstrated.

EXAMPLE 2

Samples of (A) to (D) as prepared in Example 1 were processed in accordance with the color development process (2) mentioned below. Exposure of the samples was effected in the same manner as in Example 1.

Color Development Process (2):

| Processing Step | Temperature | Time |
|---|---|---|
| Color Development | 35° C. | 45 seconds |
| Bleach-Fixation | 35° C. | 45 seconds |
| Rinsing (1) | 25° C. | 30 seconds |
| Rinsing (2) | 25° C. | 30 seconds |
| Rinsing (3) | 25° C. | 30 seconds |
| Drying | 80° C. | 60 seconds |

The sensitivity of each of the processed samples was measured in the same manner as in Example 1, and the same results as those in Example 1 were obtained.

EXAMPLE 3

Samples (E1) to (J1) and Samples (E2) to (J2) were prepared in the same manner as in preparation of Sample (A) and Sample (D) in Example 1, respectively, except that Compound (V-23) as used for color sensitization of the silver halide emulsion in the cyan-coloring layer in Samples (A) and (D) and Compound (V-46) as used for color sensitization of the silver halide emulsion in the magenta-coloring layer therein were replaced by the same molar amounts of compounds shown in Table 2 below.

TABLE 2

| Sample | Cyan Coloring Layer | Magenta Coloring Layer |
|---|---|---|
| E 1, 2 | V-18 | V-5 |
| F 1, 2 | V-20 | V-5 |
| G 1, 2 | V-19 | V-15 |
| H 1, 2 | V-26 | V-15 |
| I 1, 2 | V-49 | V-48 |
| J 1, 2 | V-51 | V-48 |

Samples (E1) to (J1) and (E2) to (J2) were subjected to the same test as in Example 1, whereupon the exposed samples were processed in accordance with the color development process (2) of Example 2.

The sensitivity values obtained are shown in Table 3 below, where the sensitivity of Samples (E1) to (J1) was represented by a relative value to the sensitivity of the corresponding layer of Samples (E2) to (J2) which all had a value of 100.

TABLE 3

| Sample | Cyan Coloring Layer | Magenta Coloring Layer |
|---|---|---|
| El | 138 | 138 |
| Fl | 148 | 138 |
| Gl | 141 | 135 |
| Hl | 144 | 135 |
| Il | 151 | 141 |

TABLE 3-continued

| Sample | Cyan Coloring Layer | Magenta Coloring Layer |
|---|---|---|
| J1 | 144 | 141 |

From the results in Table 3 above, it is clear that Samples (E1) to (J1) of the present invention are superior to the corresponding Comparative Samples (E2) to (J2), respectively, in that Samples (E1) to (J1) had a higher sensitivity than Samples (E2) to (J2).

EXAMPLE 4

A silver halide color photographic material having plural layers described below was prepared, and was called Sample (K).

Silver halide emulsions used for preparing the layers of constituting the sample were formed as described below.

Emulsion (K1) for Red-Sensitive Layer:

2 g of lime-processed gelatin was added to 1000 ml of distilled water and dissolved at 40° C. and the resulting solution was adjusted to have pH of 7.0. Then, 3.3 g of sodium chloride were added thereto, and the temperature of the solution was elevated to 52.5° C. A solution of 62.5 g of silver nitrate as dissolved in 750 ml of distilled water and a solution of 21.5 g of sodium chloride as dissolved in 500 ml of distilled water were added to and blended with the previously prepared solution at 52.5° C. over a period of 40 minutes. Further, a solution of 62.5 g of silver nitrate as dissolved in 500 ml of distilled water and a solution of 21.5 g of sodium chloride as dissolved in 300 ml of distilled water were added to and blended with it under the condition of 52.5° C. over a period of 20 minutes. The emulsion thus obtained was observed with an electronic microscope, and was found to be an emulsion containing 55% by weight of twin-containing silver halide grains having a twin plane of (111) as surrounded by (100) planes, along with cubic grains having a mean side length of about 0.46 micron, and having a fluctuation coefficient of grain size distribution of 0.15.

The emulsion was desalted and washed with water, and then 0.2 g of nucleic acid, $1\times10^{-4}$ mol/mol(Ag) of Compound (V-43) and 0.6 mol % as silver halide of a monodispersed silver bromide emulsion having a mean grain size of 0.05 micron (containing $2\times10^{-5}$ mol/mol(Ag) of dipotassium iridium hexachloride) were added thereto, whereupon the emulsion was chemically sensitized with $2\times10^{-6}$ mol/mol(Ag) of triethylthiourea. Additionally, $7\times10^{-4}$ mol/mol(Ag) of Compound (I-1) and $1.5\times10^{-3}$ mol/mol(Ag) of Compound (F-1) were added to the emulsion.

Emulsion (K2) for Green-Sensitive Layer:

3 g of lime-processed gelatin were added to 1000 ml of distilled water and dissolved at 40° C., and the resulting solution was adjusted to have pH of 7.0. 4.4 g of sodium chloride were added to it, and the temperature thereof was elevated to 50° C. Then, a solution of 62.5 g of silver nitrate as dissolved in 750 ml of distilled water and a solution of 21.5 g of sodium chloride as dissolved in 500 ml of distilled water were added to and blended with the previously prepared solution at 50° C. over a period of 40 minutes. Further, a solution of 62.5 g of silver nitrate as dissolved in 500 ml of distilled water and a solution of 21.5 g of sodium chloride as dissolved in 300 ml of distilled water were added to and blended with it under the condition of 50° C. over a period of 20 minutes.

The emulsion thus obtained was observed with an electronic microscope, and was found to be an emulsion containing 53% by weight of twin-containing silver halide grains having a twin plane of (111) as surrounded by (100) planes, along with cubic grains having a mean side length of about 0.44 micron, and having a fluctuation coefficient of grain size distribution of 0.16.

The emulsion was desalted and washed with water, and then 0.2 g of nucleic acid, $5\times10^{-4}$ mol/mol(Ag) of Compound (V-75), $7\times10^{-5}$ mol/mol(Ag) of Compound (V-61) and 0.4 mol % as silver halide of a monodispersed silver bromide emulsion having a mean grain size of 0.05 micron (containing $2.5\times10^{-5}$ mol/mol(Ag) of dipotassium iridium hexachloride) were added thereto, whereupon the emulsion was chemically sensitized with $2.5\times10^{-6}$ mol/mol(Ag) of triethylthiourea. Additionally, $1.1\times10^{-3}$ mol/mol(Ag) of Compound (I-1) was added to the emulsion. It was observed that the twin grains in the resulting emulsion had projected silver bromide-localized phases essentially at the three corner parts of the twin plane.

Emulsion (K3) for Blue-Sensitive Layer:

2 g of lime-processed gelatin were added to 1000 ml of distilled water and dissolved at 40° C., and the resulting solution was adjusted with sulfuric acid to have pH of 3.8. 2.2 g of sodium chloride were added thereto and the temperature thereof was elevated to 75° C. A solution of 12.5 g of silver nitrate as dissolved in 150 ml of distilled water and a solution of 4.3 g of sodium chloride as dissolved in 100 ml of distilled water were added to and blended with the previously prepared solution at 75° C. over a period of 30 minutes. Further, a solution of 112.5 g of silver nitrate as dissolved in 1100 ml of distilled water and a solution of 38.7 g of sodium chloride as dissolved in 650 ml of distilled water were added to and blended with it under the condition of 75° C. over a period of 40 minutes.

The emulsion thus obtained was observed with an electronic microscope, and was found to be an emulsion containing 61% by weight of twin-containing silver halide grains having a twin plane of (111) as surrounded by (100) planes, along with cubic grains having a mean side length of about 0.82 micron, and having a fluctuation coefficient of grain size distribution of 0.14.

The emulsion was desalted and washed with water, and then 0.2 g of nucleic acid, $2\times10^{-3}$ mol/mol(Ag) of Compound (V-69), $2\times10^{-3}$ mol/mol(Ag) of Compound (V-71) and 0.4 mol % as silver halide of a monodispersed silver bromide emulsion having a mean grain size of 0.05 micron (containing $1\times10^{-5}$ mol/mol(Ag) of dipotassium iridium hexachloride) were added thereto, whereupon the emulsion was chemically sensitized with $1.2\times10^{-6}$ mol/mol(Ag) of triethylthiourea. Additionally, $9\times10^{-4}$ mol/mol(Ag) of Compound (I-1) was added to the emulsion.

To the sample were added Compounds (D-1), (D-3), (D-7) and (D-8) in amounts of 0.008, 0.016, 0.010 and 0.040 g/m$^2$, respectively, for the purpose of improving the sharpness of the image to be formed. Additionally, the same gelatin-hardening agent as that added to Sample (A) of Example 1 was also added to the present sample.

Further, silver halide emulsions (L1) to (L3) were prepared in the same manner as in preparation of the above-mentioned emulsions (K1) to (K3) except that the 0.05 micron-silver bromide emulsions was not added; silver halide emulsions (M1) to (M3) were prepared by a conventional method to contain 90% by weight of cubic silver halide grains having the same grain size as the above-mentioned emulsions and having a silver bromide-localized phase at the corner parts; and cubic silver halide emulsions (N1) to (N3) corresponding to the previous emulsions (M1) to (M3), respectively, which, however had no silver localized phase, were prepared. Using these emulsions, Samples (L), (M) and (N) were prepared in the same manner as in preparation of Sample (K).

The layer constitution of Samples (K), (L), (M) and (N) was as follows:

| | |
|---|---|
| Support: | |
| $TiO_2$ (5 g/m$^2$)-containing Polyethylene Laminate Paper | |
| First Layer: Blue-Sensitive Layer | |
| Emulsion (K3) | 0.27 g/m$^2$ as Ag |
| Gelatin | 1.66 g/m$^2$ |
| Polymer (P-1) | 0.16 g/m$^2$ |
| Yellow Coupler (Y-4) | 0.14 g/m$^2$ |
| Yellow Coupler (Y-6) | 0.18 g/m$^2$ |
| Yellow Coupler (Y-1) | 0.35 g/m$^2$ |
| Color Image Stabilizer (H-4) | 0.01 g/m$^2$ |
| Solvent (S-2) | 0.15 g/m$^2$ |
| Solvent (S-6) | 0.14 g/m$^2$ |
| Second Layer: Color Mixing Preventing Layer | |
| Gelatin | 1.30 g/m$^2$ |
| Color Mixing Preventing Agent (H-1) | 0.06 g/m$^2$ |
| Solvent (S-3) | 0.12 g/m$^2$ |
| Solvent (S-4) | 0.12 g/m$^2$ |
| Third Layer: Green-Sensitive Layer | |
| Emulsion (K2) | 0.15 g/m$^2$ as Ag |
| Gelatin | 1.60 g/m$^2$ |
| Magenta Coupler (M-13) | 0.22 g/m$^2$ |
| Magenta Coupler (M-15) | 0.08 g/m$^2$ |
| Color Image Stabilizer (E-1) | 0.10 g/m$^2$ |
| Color Image Stabilizer (A-1) | 0.08 g/m$^2$ |
| Color Image Stabilizer (B-1) | 0.03 g/m$^2$ |
| Color Image Stabilizer (H-3) | 0.01 g/m$^2$ |
| Color Image Stabilizer (H-6) | 0.02 g/m$^2$ |
| Solvent (S-1) | 0.44 g/m$^2$ |
| Solvent (S-3) | 0.22 g/m$^2$ |
| Fourth Layer: Ultraviolet Absorbing Layer | |
| Gelatin | 1.60 g/m$^2$ |
| Ultraviolet Absorbent (X-l) | 0.06 g/m$^2$ |
| Ultraviolet Absorbent (X-2) | 0.27 g/m$^2$ |
| Ultraviolet Absorbent (X-3) | 0.29 g/m$^2$ |
| Color Mixing Preventing Agent (H-1) | 0.06 g/m$^2$ |
| Solvent (S-5) | 0.26 g/m$^2$ |
| Fifth Layer: Red-Sensitive Layer | |
| Emulsion (K1) | 0.24 g/m$^2$ as Ag |
| Gelatin | 1.76 g/m$^2$ |
| Polymer (P-1) | 0.53 g/m$^2$ |
| Cyan Coupler (C-2) | 0.07 g/m$^2$ |
| Cyan Coupler (C-5) | 0.12 g/m$^2$ |
| Cyan Coupler (C-4) | 0.09 g/m$^2$ |
| Cyan Coupler (C-3) | 0.07 g/m$^2$ |
| Color Image Stabilizer (X-l) | 0.04 g/m$^2$ |
| Color Image Stabilizer (X-2) | 0.05 g/m$^2$ |
| Color Image Stabilizer (X-4) | 0.05 g/m$^2$ |
| Color Image Stabilizer (A-1) | 0.01 g/m$^2$ |
| Color Image Stabilizer (B-1) | 0.01 g/m$^2$ |

-continued

| | |
|---|---|
| Color Image Stabilizer (H-4) | 0.01 g/m² |
| Color Image Stabilizer (H-2) | 0.04 g/m² |
| Solvent (S-6) | 0.11 g/m² |
| Solvent (S-7) | 0.11 g/m² |
| Sixth Layer: Ultraviolet Absorbing Layer | |
| Gelatin | 0.65 g/m² |
| Ultraviolet Absorbent (X-l) | 0.02 g/m² |
| Ultraviolet Absorbent (X-2) | 0.09 g/m² |
| Ultraviolet Absorbent (X-3) | 0.10 g/m² |
| Color Mixing Preventing Agent (H-1) | 0.02 g/m² |
| Solvent (S-5) | 0.11 g/m² |
| Seventh Layer: Protective Layer | |
| Gelatin | 1.30 g/m² |
| Acryl-Modified Polyvinyl Alcohol Polymer (modification degree: 17%) | 0.15 g/m² |
| Liquid Paraffin | 0.05 g/m² |

The compounds used above were same as those in Example 1, except for the following two compounds.

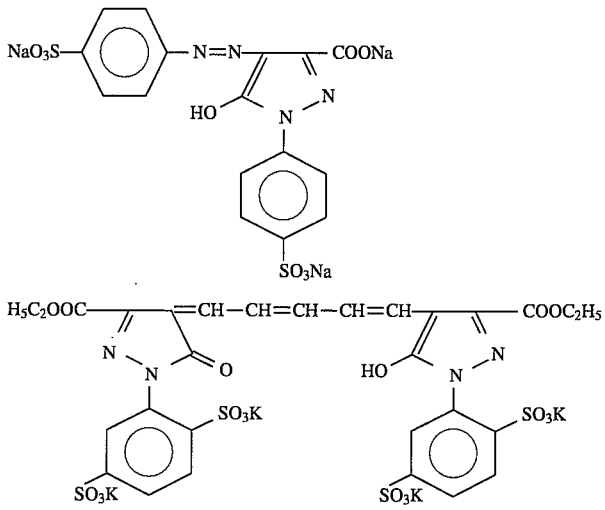

(D-7)

Each of these samples was wedgewise exposed with a white light for 0.1 second through blue, green and red filters and through an optical wedge, and thereafter processed in the same way as in Example 2.

Each Color density of each of the thus processed samples was measured with a reflection densitometer, and the results obtained are shown in Table 4. The sensitivity is represented by a relative value based on the sensitivity of each color layer of Sample (N) being 100.

TABLE 4

| Sample | Sensitivity of Red-Sensitive Layer | Sensitivity of Green-Sensitive Layer | Sensitivity of Blue-Sensitive Layer | Remarks |
|---|---|---|---|---|
| K | 589 | 562 | 526 | Invention |
| L | 129 | 120 | 112 | Comp. Sample |
| M | 417 | 389 | 372 | Comp. Sample |
| N | 100 | 100 | 100 | Comp. Sample |

As is clear from the results in Table 4 above, Sample (K) of the present invention has a higher sensitivity than the Comparative Samples (L), (M) and (N).

The increase of the sensitivity of Sample (K) of the present invention of having silver halide emulsions with silver bromide-localized phases on the twin plane over the sensitivity of Sample (L) having localized phase-free twin plane-having silver halide-emulsions is larger than that of the sensitivity of Sample (M) having silver bromide localized-phase having silver halide emulsions over that of Sample (N) having general cubic silver halide emulsions. Thus, it is clearly shown that the high-silver chloride emulsion of the present invention where the surfaces of the silver chloride grains having silver bromide-localized phases on the twin plane consist essentially of (100) planes has a high sensitivity and that the photographic material of the present invention containing such a high-silver chloride emulsion is unexpectedly superior with respect to photographic characteristics.

As will be noted from the characteristic values showing the gradation of each of the processed samples as shown in Table 5 below, Sample (K) of the present invention has the highest contrast. From the fact, it is also understood that the silver halide emulsion of the present invention is excellent.

TABLE 5

| Sample | Red-Sensitive Layer | Green-Sensitive Layer | Blue-Sensitive Layer | Remarks |
|---|---|---|---|---|
| K | 3.7 | 3.6 | 3.4 | Invention |
| L | 3.6 | 3.5 | 3.2 | Comp. Sample |
| M | 3.3 | 3.2 | 3.0 | Comp. Sample |
| N | 3.5 | 3.4 | 3.1 | Comp. Sample |

The characteristic value of gradation shown in Table 5 above is determined by the incline of the line formed by connecting the two density points (minimum density plus 1.0) and (minimum density plus 2.0) on the characteristic curve.

EXAMPLE 5

Silver halide emulsions (P1), (P2) and (P3) were prepared in the same manner as in preparation of silver halide emulsions (K1), (K2) and (K3), respectively, in Sample (K) of Example 4, except that the same molar amount of potassium bromide and the same molar amount of dipotassium iridium hexachloride were added in place of adding the monodispersed emulsion of fine silver bromide grains having a mean grain size of 0.05 micron and containing dipotassium iridium hexachloride. Sample (P) was then prepared in the same manner as in preparation of Sample (K), except that the thus prepared emulsions (P1), (P2) and (P3) were used in place of the emulsions (K1), (K2) and (K3), respectively, in Sample (K).

Sample (P) was then exposed and processed in the same manner as in Example 4 or as in Samples (K) to (N), whereupon the sensitivity values and the gradient values were also obtained in the same manner.

The results obtained are shown in Table 6 below, where the sensitivity and gradation were represented in the same way as in Example 1. The sensitivity is a relative value to the sensitivity of Sample (N) being 100.

TABLE 6

| | Red-Sensitive Layer | Green-Sensitive Layer | Blue-Sensitive Layer | Remarks |
|---|---|---|---|---|
| Sensitivity | 562 | 500 | 446 | Invention |
| Gradation | 3.5 | 3.3 | 3.1 | |

Silver halide emulsions (P1), (P2) and (P3) are all within the scope of the present invention and Sample (P) is therefore within the scope of the present invention. Sample (F) is noted to be somewhat inferior to Sample (K) of the present invention in Example 4, as the sensitivity of the former is lower than that of the latter and the gradation of the former is softener than that of the latter. However, comparing Sample (P) of the present invention and the comparative Sample (K) which is outside the scope of the present invention, the former is clearly noted to be superior to the latter with respect to sensitivity and gradation.

From the results of the present example, it is understood that recrystallization or halogen conversion by the use of fine silver bromochloride crystals having a relatively higher silver bromide content than the surface silver bromide content of host grains or by the use of fine silver bromide crystals is advantageous for forming the silver bromide-localized phase in the twin plane-having silver halide grains in the emulsion of the invention, for the purpose of more effectively displaying the effect of the present invention.

EXAMPLE 6

Silver halide emulsions (Q1), (Q2), (Q3), (R1), (R2) and (R3) were prepared in the same manner as in preparation of Emulsions (A1), (A2) and (A3) in Example 1 and Emulsions (K1), (K2) and (K3) of Example 4, except that the amounts of Compounds (I-1) and (F-1) to be added were decreased to about 1/10 of those as added in Examples 1 and 4, and the thus decreased compounds were added along with the sensitizing dye prior to addition of the fine silver bromide grains for forming the silver bromide-localized phase whereupon the time for chemical ripening was varied.

Using the thus prepared emulsions (Q1), (Q2), (Q3), (R1), (R2) and (R3), Sample (Q) was prepared in the same manner as in preparation of Sample (A); and Sample (R) was prepared in the same manner as in preparation of Sample (K). Sample (Q) was subjected to the same tests as those in Examples 1 and 2; and Sample (R) was subjected to the same test as that in Example 4.

The results obtained are shown in Table 7 below. Regarding Sample (Q), only the results obtained by the test of using the color development process (2) are shown. Representation of the sensitivity and gradation was effected in accordance with Example 1 for Sample (Q) and in accordance with Example 4 for Sample (R).

TABLE 7

| Sample | Red-Sensitive Layer | Green-Sensitive Layer | Blue-Sensitive Layer | Remarks |
|---|---|---|---|---|
| Q | | | | |
| Sensitivity | 158 | 151 | 141 | Invention |
| R | | | | |
| Sensitivity | 550 | 477 | 417 | Invention |
| Gradation | 3.8 | 3.6 | 3.5 | |

From the results in Table 7 above, it is noted that Sample (Q) has a higher sensitivity than Sample (A).

Regarding Sample (R), although the sensitivity thereof is somewhat lower than that of Sample (K), it is still higher than the sensitivity of any other sample which is outside the scope of the present invention. The gradation of Sample (R) is higher than that of Sample (K), and therefore, the contrast of the former is harder than that of the latter.

EXAMPLE 7

The samples as prepared in Example 4 were exposed with a white light for 10 seconds through blue, green and red filters and through an optical wedge, whereupon the exposure amount was same as that in Example 4. Then, the thus exposed samples were processed in the same manner as in Example 2. The sensitivity values obtained are shown in Table 8 below, where the values were represented in accordance with Example 4.

TABLE 8

| Sample | Red-Sensitive Layer | Green-Sensitive Layer | Blue-Sensitive Layer | Remarks |
|---|---|---|---|---|
| K | 479 | 479 | 458 | Invention |
| L | 42 | 45 | 52 | Comp. Sample |
| M | 289 | 288 | 282 | Comp. Sample |
| N | 35 | 38 | 40 | Comp. Sample |

The lowering of the sensitivity by 0.1 second-exposure to that by 10 second-exposure, which is the low intensity reciprocity law failure, is fairly large in Samples (L) and (N), and it is also large in Sample (M). In contrast, the lowering of the sensitivity is fairly small in Sample (K). From these results, it is understood that the sample of the present invention is also superior to any other comparative samples with respect to the photographic characteristic of the point.

As has been demonstrated in detail in the above-mentiond examples, the present invention provides a silver halide photographic emulsion having a high sensitivity, a hard gradation and an excellent reciprocity law characteristic. Accordingly, the silver halide photographic material of the present invention, which contains such an excellent silver halide emulsion, also has a high sensitivity, a hard gradation and an excellent reciprocity law characteristic. The silver halide photographic material of the present invention may well be processed by rapid processing. The present invention is well applicable to general color papers and infrared-sensitized color print materials.

While the invention has been described in detail and with reference to specific embodiments thereof, it will be apparent to one skilled in the art that various changes and modifications can be made therein without departing from the spirit and scope thereof.

What is claimed is:

1. A silver halide photographic material having at least one silver halide emulsion layer on a support, wherein the silver halide emulsion of the emulsion layer is a high-silver chloride emulsion having a silver chloride content of about 95 mol % or more, wherein at least about 30% by number or by weight of the silver halide grains in the silver halide emulsion are those having one twin plane in the crystal and the crystal planes of the surface of each grain consist essentially of (100) planes and the grains having one twin plane have a silver bromide-localized phase having a higher silver bromide content only in the part of intersection of the twin plane and the surface of the grain as compared with other areas of the grains.

2. A silver halide photographic material as in claim 1, wherein at least one yellow coupler-containing light-sensitive silver halide emulsion layer, at least one magenta coupler-containing light-sensitive silver halide emulsion Layer and at least one cyan coupler-containing light-sensitive silver halide emulsion layer are present on the support.

3. A silver halide photographic material as in claim 2, wherein the yellow coupler-containing light-sensitive silver halide emulsion layer, the magenta coupler-containing light-sensitive silver halide emulsion layer and the cyan coupler-containing light-sensitive silver halide emulsion layer are a blue-sensitive layer, a green-sensitive layer and a red-sensitive layer, respectively.

4. A silver halide photographic material as in claim 1, wherein formation of the silver bromide-localized phase having a higher silver bromide content in the grains of said high-silver chloride emulsion is effected by recrystallization or halogen conversion by the use of fine crystals of silver bromide or silver chlorobromide having a relatively higher silver bromide content than that in the surface of a host grain on which the silver bromide localized phase is formed.

5. A silver halide photographic material as in claim 1, wherein formation of the silver bromide-localized phase having a higher silver bromide content in the high-silver chloride emulsion is effected in the presence of a cyanine dye, a nitrogen-containing heterocyclic compound, a nitrogen-containing heterocyclic mercapto compound or a diaminostilbene compound.

6. A silver halide photographic material as in claim 1, wherein the silver chloride content in the emulsion is 99 mol % or more.

7. A silver halide photographic material as in claim 1, wherein the silver bromide content in the emulsion is 0.1 mol % or more.

8. A silver halide photographic material as in claim 1, wherein the composition of the silver bromide-localized phase is 30 mol % to 60 mol % silver bromide.

9. A silver halide photographic material as in claim 1, wherein the proportion of silver halide present in the silver bromide localized phase of each of said at least about 30% by number or by weight of the silver halide grains having one twin plane is from 0.1 mol % to 25 mol % of the silver halide composition of the entire grain.

10. A silver halide photographic material as in claim 1, wherein at least 40% by number or by weight of the silver halide grains are those having one twin plane in the crystal and the crystal planes of the surface of each grain consist essentially of (100) planes.

11. A silver halide photographic material as in claim 1, wherein at least 50% by number or by weight of the silver halide grains are those having one twin plane in the crystal and the crystal planes of the surface of each grain consist essentially of (100) planes.

12. A silver halide photographic material as in claim 1, wherein at least 60% by number or by weight of the silver halide grains are those having one twin plane in the crystal and the crystal planes of the surface of each grain consist essentially of (100) planes.

13. A silver halide photographic material as in claim 1, wherein at least 70% by number or by weight of the silver halide grains are those having one twin plane in the crystal and the crystal planes of the surface of each grain consist essentially of (100) planes.

14. A silver halide photographic material as in claim 1, wherein the silver halide emulsion contains a cyanine dye represented by the following general formula (I):

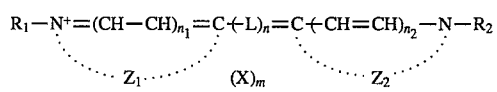

(I)

wherein L represents a methine group; $R_1$ and $R_2$ each represents an alkyl group or a substituted alkyl group; $Z_1$ and $Z_2$ each represent an atomic group for forming a nitrogen-containing 5-membered or 6-membered heterocyclic nucleus; X represents an anion; n represents a number of 1, 3 or 5; $n_1$ and $n_2$ each represent 0 or 1; when n= 5, both $n_1$ and $n_2$ are 0; and when n=3, either $n_1$ or $n_2$ is 0; m represents 0 or 1, and it is 0 when the dye forms an internal salt; and when n is 5, plural L's may be bonded to each other to form a 5-membered or 6-membered ring.

* * * * *